364-422
12/1/81 OR 4,303,975 SR

United States Patent [19]
Hepp

[11] 4,303,975
[45] Dec. 1, 1981

[54] DIPMETER DISPLACEMENT QUALIFYING TECHNIQUE

[75] Inventor: Vincent R. Hepp, Ridgefield, Conn.

[73] Assignee: Schlumberger Technology Corporation, New York, N.Y.

[21] Appl. No.: 94,595

[22] Filed: Nov. 15, 1979

Related U.S. Application Data

[63] Continuation of Ser. No. 537,310, Dec. 30, 1974, abandoned.

[51] Int. Cl.³ ..... G06F 15/20
[52] U.S. Cl. ..... 364/422; 324/323
[58] Field of Search ..... 364/422, 300; 324/323

[56] References Cited

U.S. PATENT DOCUMENTS

| | | | |
|---|---|---|---|
| 3,068,400 | 12/1962 | Castel et al. | 324/323 |
| 3,466,532 | 9/1969 | Kolb | 324/323 |
| 3,521,154 | 7/1970 | Maricelli | 324/323 |
| 3,721,960 | 3/1973 | Tinch et al. | 324/323 |

*Primary Examiner*—Jerry Smith
*Attorney, Agent, or Firm*—Cooper, Dunham, Clark, Griffin & Moran

[57] ABSTRACT

An improved dipmeter plot of the attitudes of earth formation features in the vicinity of a borehole is produced by using a dipmeter which has at least four transducers urged into contact with the borehole wall, detecting which (if any) of the transducers fail to achieve satisfactory transducer-wall contact and producing the sought dipmeter plot from the transducer outputs less the signal from any transducer failing to achieve satisfactory transducer-wall contact. The occurrences of unsatisfactory transducer-wall contact are detected by seeking to find inconsistencies between the outputs of the individual transducers of the dipmeter tool, and additionally between such outputs and the diameter of the borehole at the relevant depth. The process is speeded up by checking first the transducer which is closest to the borehole top at the relevant time.

20 Claims, 55 Drawing Figures

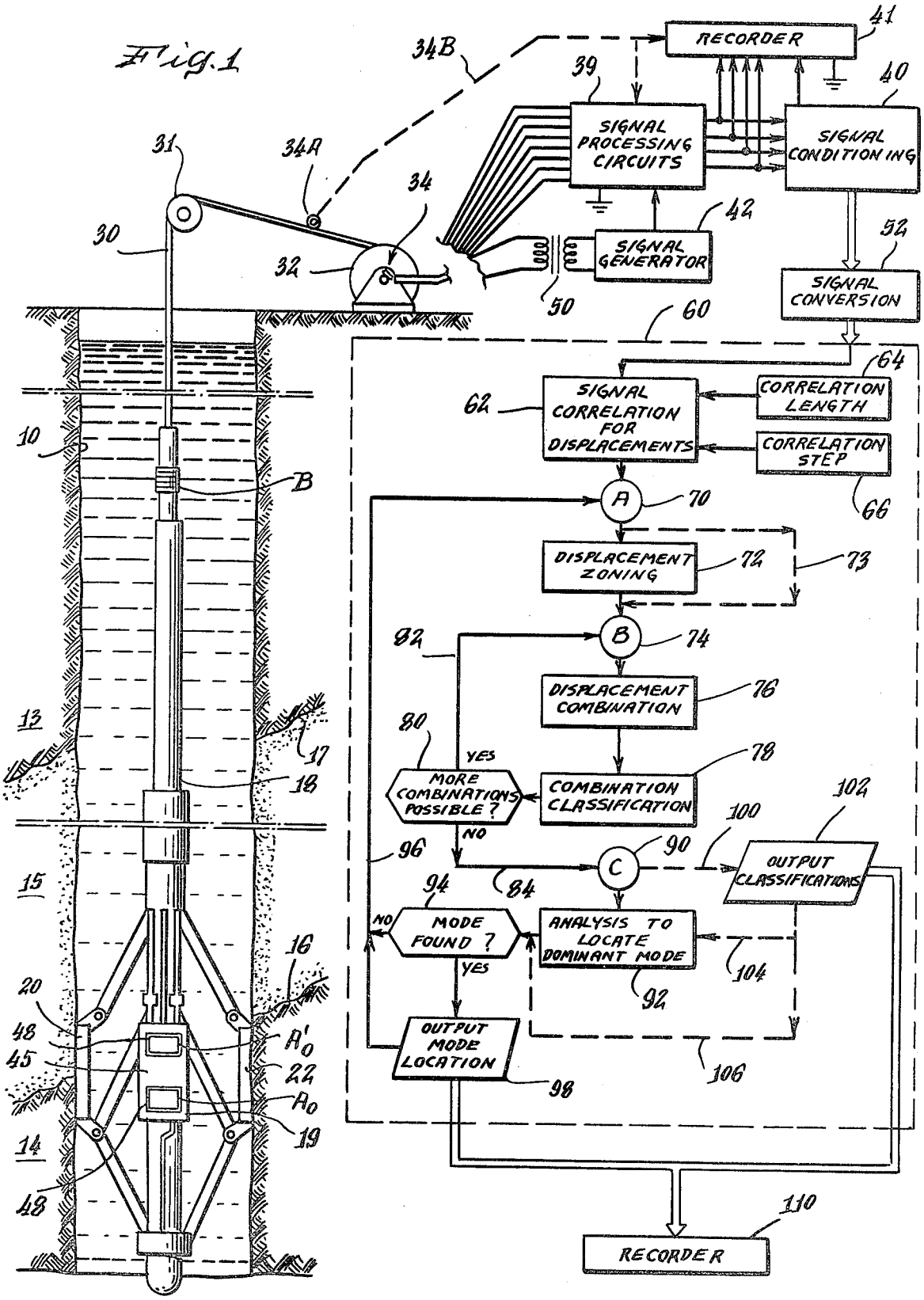
Fig. 1
RECORDER
41
34B
39
40
SIGNAL PROCESSING CIRCUITS
SIGNAL CONDITIONING
31
34A
34
30
32
42
SIGNAL GENERATOR
52
SIGNAL CONVERSION
50
60
64
SIGNAL CORRELATION FOR DISPLACEMENTS
CORRELATION LENGTH
CORRELATION STEP
62
66
10
B
A
70
DISPLACEMENT ZONING
72
73
82
B
74
DISPLACEMENT COMBINATION
76
13
80
YES
MORE COMBINATIONS POSSIBLE ?
COMBINATION CLASSIFICATION
78
17
18
102
100
NO
96
C
90
OUTPUT CLASSIFICATIONS
15
94
84
NO
MODE FOUND ?
ANALYSIS TO LOCATE DOMINANT MODE
16
YES
104
20
92
48
A'o
45
22
Ao
OUTPUT MODE LOCATION
106
19
14
98
48
110
RECORDER Fig. 4B.
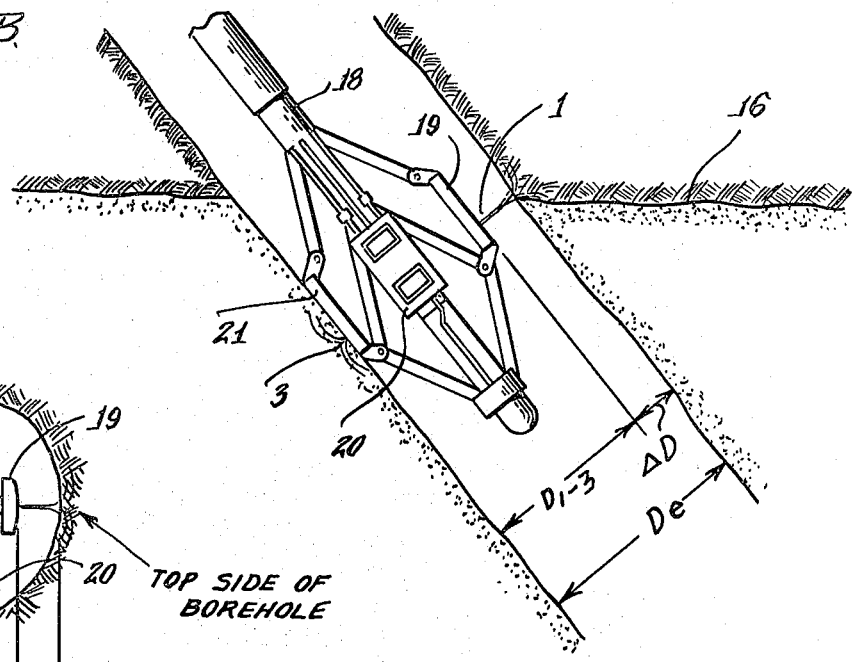
Fig. 4A.
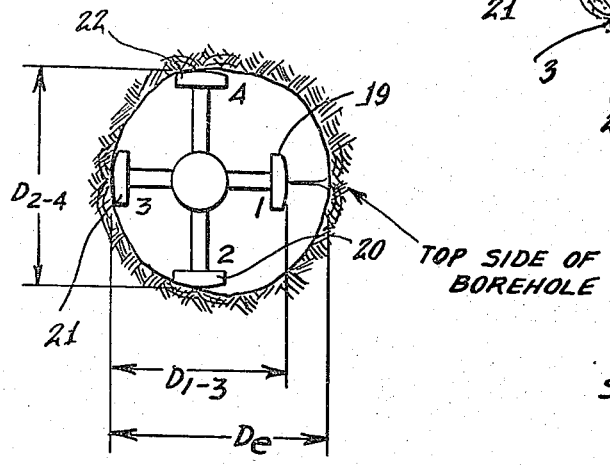
Fig. 5A.
POSSIBLE PLANES
B-C-D
A-B-D
A'-B-D
A-B-C
A'-B-C
A-C-D
A'-C-D
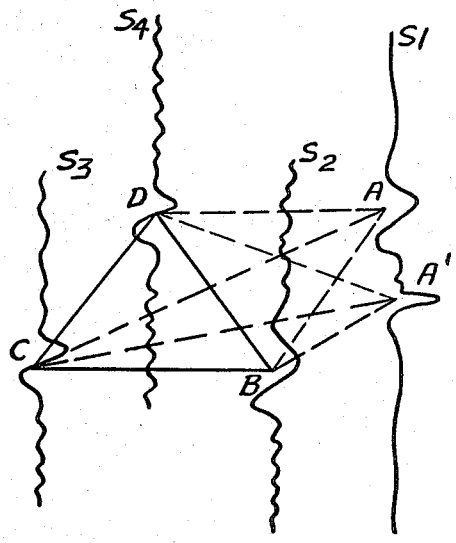
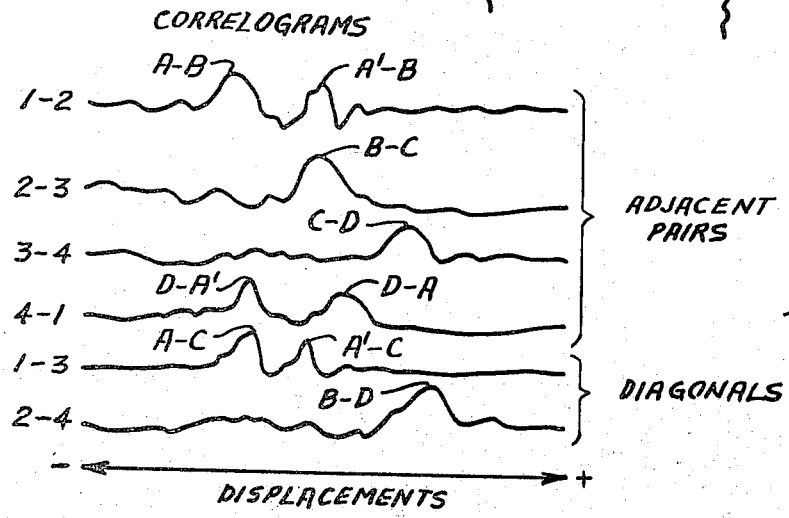
Fig. 5B.

Fig. 8A.
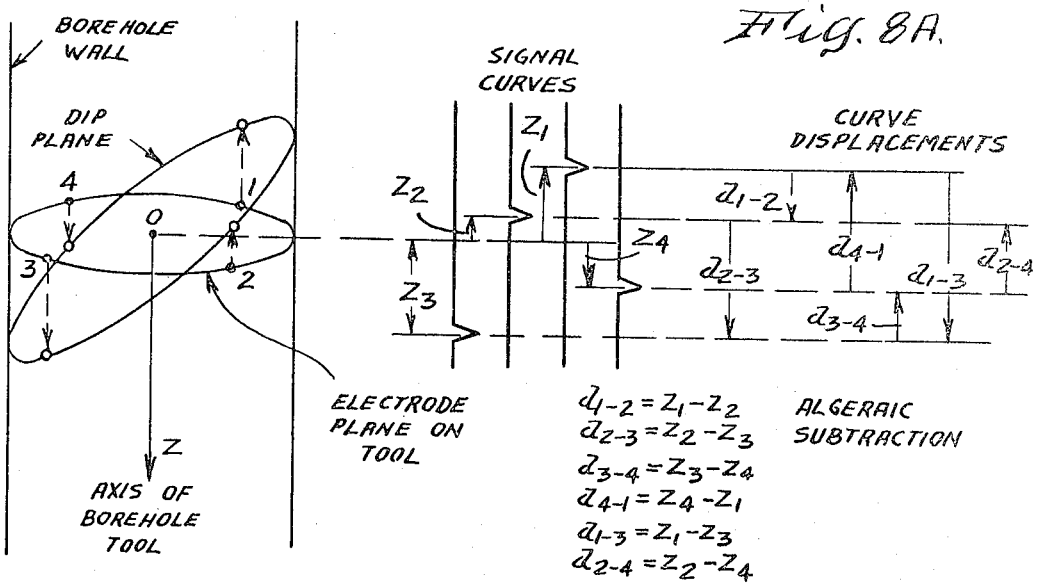
Fig. 10A.
$da = \frac{1}{2} dA$
$r = R\sqrt{2}\sin(\theta/2)$
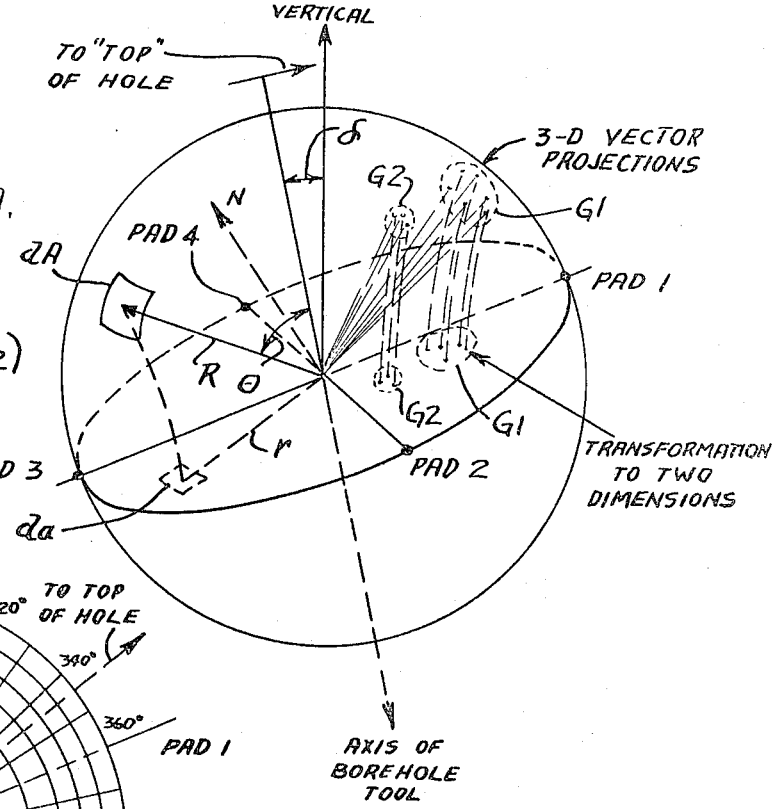
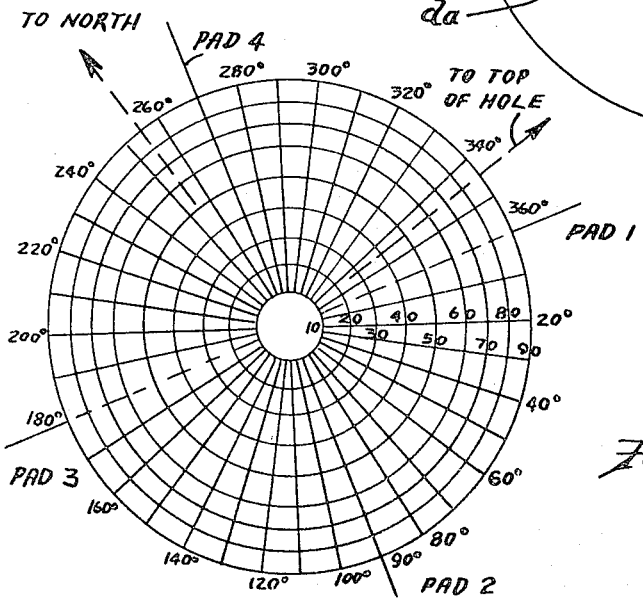
Fig. 10B.

Fig. 9A.

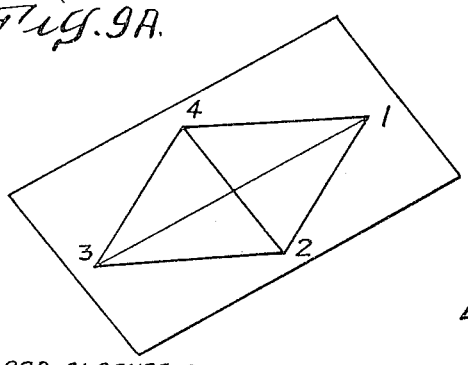

GOOD CLOSURE AND PLANARITY
ALL POINTS IN SAME PLANE
$d_{1-2}+d_{2-3}+d_{3-4}+d_{4-1} \cong 0$
$d_{1-2}+d_{3-4}=d_{2-3}+d_{4-1}$

Fig. 9B.

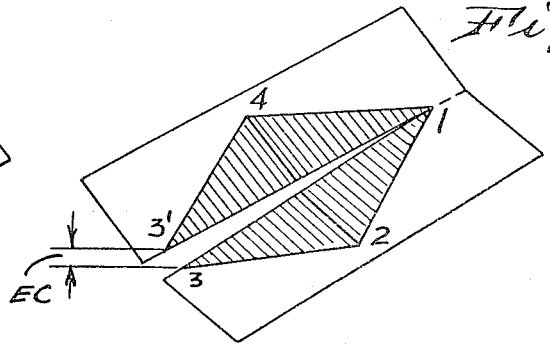

CLOSURE ERROR: PLANARITY UNDEFINED
ONE OR MORE DISPLACEMENTS IN ERROR
$d_{1-2}+d_{2-3}+d_{3-4}+d_{4-1} = EC \neq 0$

Fig. 9C.

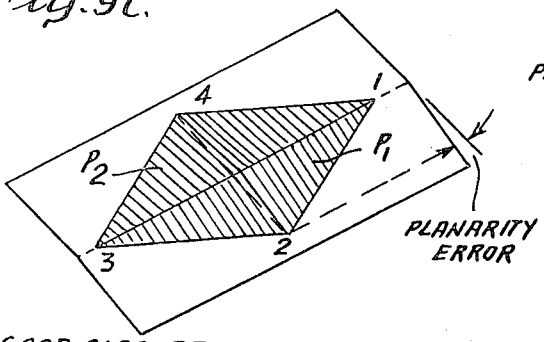

GOOD CLOSURE BUT NON-PLANAR
SEVERAL PLANES POSSIBLE
$d_{1-2}+d_{2-3}+d_{3-4}+d_{4-1} \cong 0$
$d_{1-2}+d_{3-4} \neq d_{2-3}+d_{4-1}$
$(d_{1-2}, d_{2-3}) \rightarrow P_1$
$(d_{2-4}, d_{4-1}) \rightarrow P_2$

Fig. 9D.

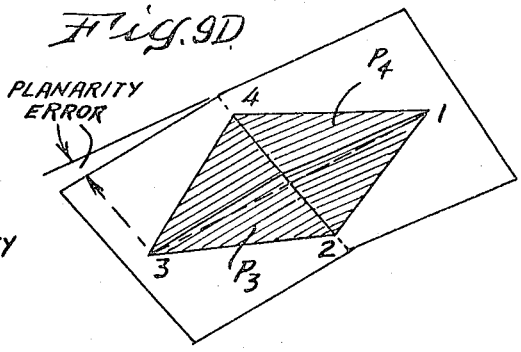

GOOD CLOSURE, BUT NON-PLANAR
SEVERAL PLANES POSSIBLE
$d_{1-2}+d_{2-3}+d_{3-4}+d_{4-1} \cong 0$
$d_{1-2}+d_{3-4} \neq d_{2-3}+d_{4-1}$
$(d_{2-3}, d_{2-4}) \rightarrow P_3$
$(d_{4-1}, d_{1-2}) \rightarrow P_4$

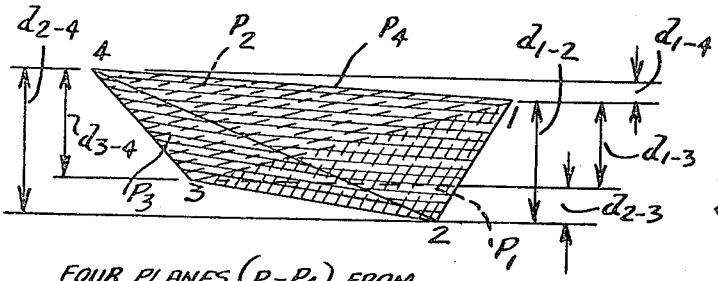

FOUR PLANES ($P_1$-$P_4$) FROM
SIX DISPLACEMENTS:
$d_{1-2}, d_{2-3}, d_{3-4}, d_{4-1},$
$d_{1-3}, d_{2-4}$

Fig. 9E.

Fig. 9F.

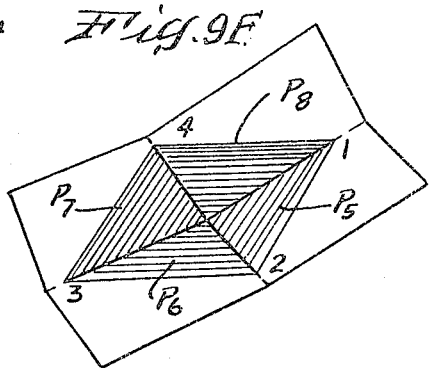

GOOD CLOSURE EXCEPT FOR DIAGONALS
EIGHT MORE POSSIBLE PLANES
$(d_{1-2}, d_{1-3}) \rightarrow P_5$ $(d_{1-2}, d_{2-4}) \rightarrow P_5'$
$(d_{2-3}, d_{1-3}) \rightarrow P_6$ $(d_{2-3}, d_{2-4}) \rightarrow P_6'$
$(d_{1-4}, d_{2-4}) \rightarrow P_7$ $(d_{3-4}, d_{1-3}) \rightarrow P_7'$
$(d_{4-1}, d_{2-4}) \rightarrow P_8$ $(d_{4-1}, d_{1-3}) \rightarrow P_8'$

WT = 3
I = 25. J = 39

WT = 4
I = 25. J = 38

SIX SIGNAL DISPLACEMENTS

| SEQUENCE | $d_{1-2}$ | $d_{2-3}$ | $d_{3-4}$ | $d_{4-1}$ | $d_{1-3}$ | $d_{2-4}$ |
|---|---|---|---|---|---|---|
| 14 | 10.61 | -8.72 | 2.85 | 10.10 | 13.41 | -33.61 |
| 13 | -13.72 | 20.92 | 2.90 | 9.58 | -8.21 | -10.95 |
| 12 | -3.36 | -5.22 | 2.99 | 9.95 | -8.53 | -11.37 |
| 11 | -3.38 | -5.34 | 3.07 | 10.36 | -8.70 | -12.00 |

ZONE A SIGNAL 2 COMMON — ZONE B SIGNAL 4 COMMON — ZONE C DIAGONALS COMMON $$TAN(\theta') = \sqrt{[TAN(\theta_{1_3}V)]^2 + [TAN(\theta_{2_4}V)]^2} \quad (8)$$

$$TAN(\phi') = \left[\frac{TAN(\theta_{2_4}V)}{TAN(\theta_{1_3}V)}\right] \quad (9)$$

$$TAN(\theta_{1_3}V) = d_{1-3}/D_{1-3} = A \quad (4)$$

$$TAN(\theta_{2_4}V) = d_{2-4}/D_{2-4} = B \quad (5)$$

Fig. 14.

ZONE CODES:
-1 = ZONE NOT DEFINED
1 = GAP ZONE
2 = STABLE ZONE
3 = STABLE ZONE CONTINUING

| SEQUENCE | DISPLACEMENTS 1-2 | 2-3 | 3-4 | 4-1 | SEQ. CNT. (SC) 1-2 | 2-3 | 3-4 | 4-1 | MIN. ADJ. CNT (MAC) 1-2-3 | 2-3-4 | 3-4-1 | 4-1-2 | MC-ALL | MCP | CC | ZC | ZONE CODE |
|---|---|---|---|---|---|---|---|---|---|---|---|---|---|---|---|---|---|
| 22 | -0.45 | -6.46 | -0.68 | -7.26 | 1 | 1 | 1 | 0 | 1 | 1 | 0 | 0 | 1 | > 0 | 4/2 | 2 | 1 |
| 21 | -0.89 | -8.00 | -0.39 | | 0 | 0 | 0 | 0 | 0 | 0 | 0 | 0 | 0 | = 0 | 3 | | |
| 20 | -10.3 | 28.8 | | | 0 | 0 | 0 | 0 | 0 | 0 | 0 | 0 | 0 | = 0 | 2 | | |
| 19 | -2.68 | -7.24 | 2.98 | | 4/0 | 1 | 1/0 | 0 | 1/0 | 1/0 | 0 | 0 | 1/0 | > 3 | 5/1 | 4 | 2 |
| 18 | -2.71 | -6.76 | 3.03 | 6.22 | 3 | 0 | 0 | 3 | 0 | 0 | 0 | 3 | 3 | > 2 | 4 | | |
| 17 | -2.62 | | | 6.12 | 2 | 0 | 0 | 2 | 0 | 0 | 0 | 2 | 2 | > 1 | 3 | | |
| 16 | -3.07 | -4.66 | 3.36 | 6.27 | 1 | 1 | 0 | 1 | 1 | 0 | 0 | 1 | 1 | > 0 | 2/2 | 0 | |
| 15 | -3.93 | -5.07 | 5.67 | 7.18 | 0 | 1/0 | 2/0 | 0 | 0 | 1/0 | 0 | 0 | 1/0 | = 1 | 3/1 | 2 | 2 |
| 14 | -12.5 | -4.88 | 5.79 | 10.1 | 0 | 0 | 1 | 1 | 0 | 0 | 1 | 0 | 1 | > 0 | 2/2 | 0 | |
| 13 | -9.18 | -6.01 | 5.02 | 9.28 | 0 | 1/0 | 1/0 | 0 | 0 | 1/0 | 0 | 0 | 1/0 | = 1 | 3/1 | 2 | 2 |
| 12 | -8.71 | -7.51 | 5.07 | 13.51 | 2 | 0 | 0 | 1 | 0 | 0 | 0 | 1 | 1 | > 0 | 3/2 | 1 | 1 |
| 11 | -8.52 | 23.2 | 4.52 | 13.5 | 1 | 0 | 0 | 0 | 0 | 0 | 0 | 0 | 0 | = 0 | 2 | | |
| 10 | -8.13 | -5.48 | 21.21 | 7.64 | 0 | 2 | 0 | 0 | 0 | 0 | 0 | 0 | 0 | < 1 | 3/1 | 2 | 2 |
| 09 | 0.56 | -5.68 | 4.42 | 6.52 | 0 | 1 | 1 | 0 | 0 | 1 | 0 | 0 | 1 | > 0 | 2 | 0 | |
| 08 | -4.17 | -5.46 | 3.31 | 5.93 | 0 | 0 | 0 | 0 | 0 | 0 | 0 | 0 | 0 | > -1 | 2 | | |
| INITIAL VALUE = | | | | | 0 | 0 | 0 | 0 | | | | | 0 | -1 | 1 | | -1 |

NOTATION
ORIGINAL VALUE → ▨ ← RESET VALUE

Fig. 15B
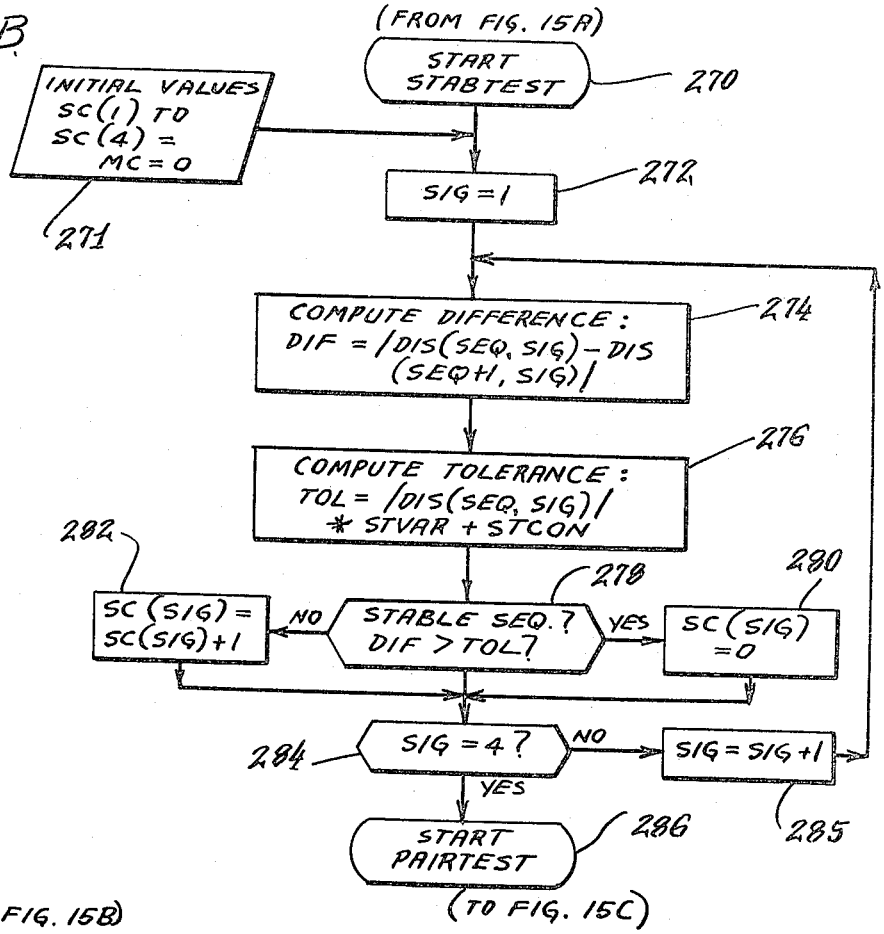
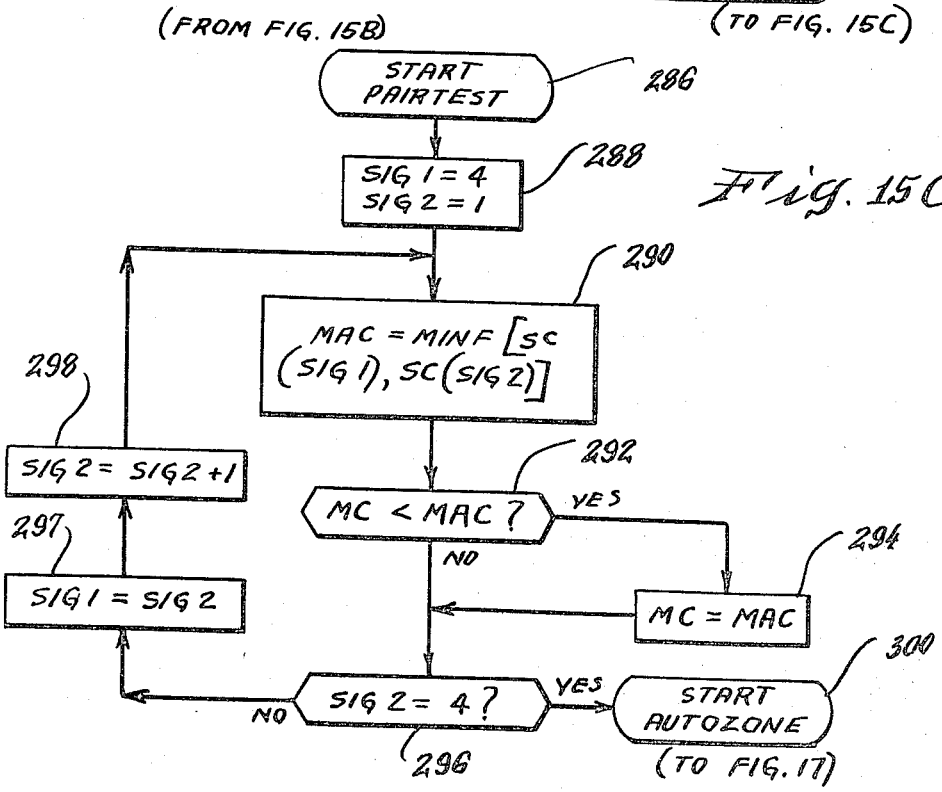
Fig. 15C.

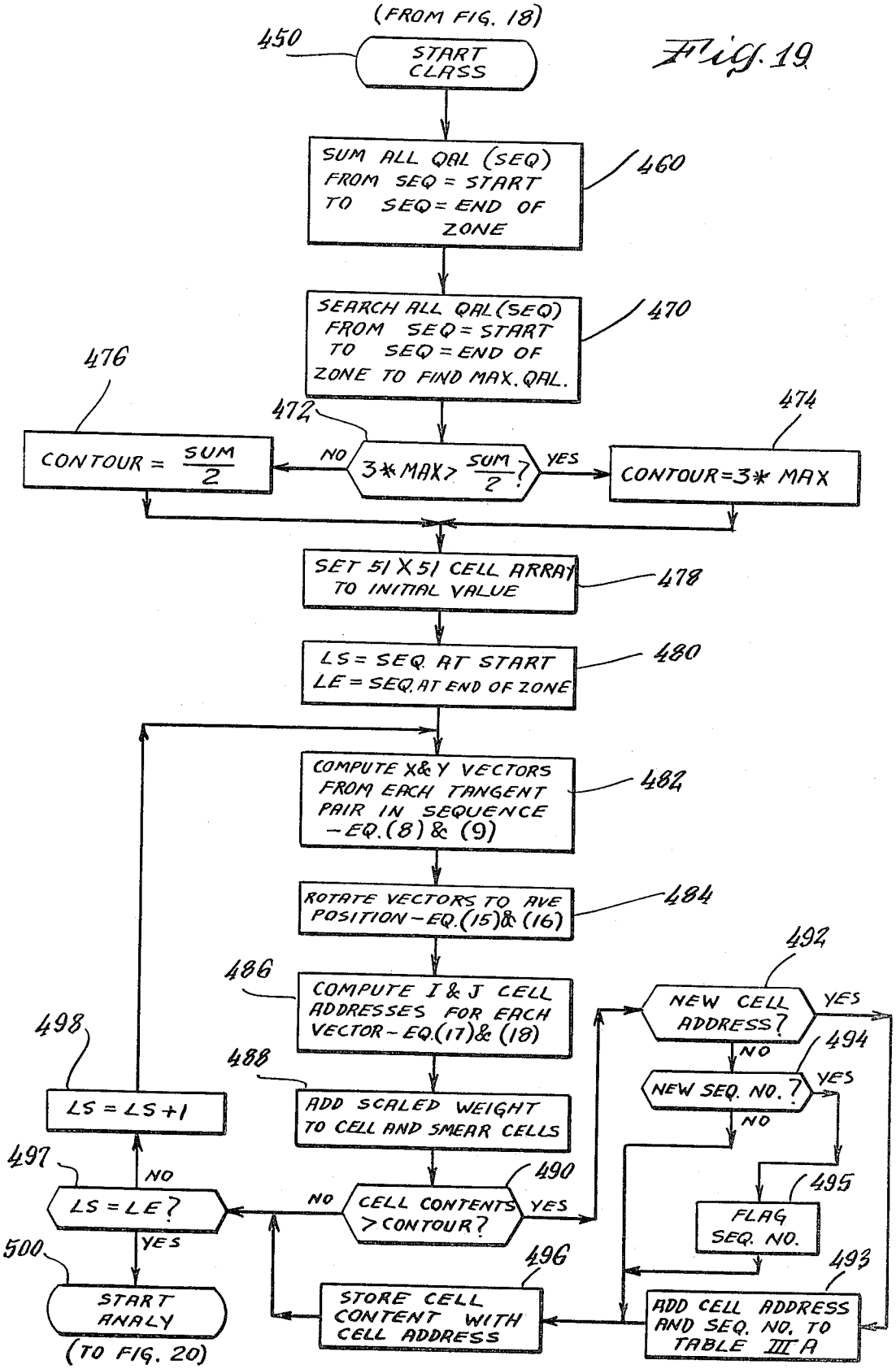
(FROM FIG. 18)
450
START CLASS
Fig. 19
SUM ALL QAL (SEQ) FROM SEQ = START TO SEQ = END OF ZONE
460
SEARCH ALL QAL(SEQ) FROM SEQ = START TO SEQ = END OF ZONE TO FIND MAX. QAL.
470
476
472
474
CONTOUR = SUM/2
NO
3*MAX > SUM/2 ?
YES
CONTOUR = 3* MAX
SET 51 X 51 CELL ARRAY TO INITIAL VALUE
478
LS = SEQ. AT START
LE = SEQ. AT END OF ZONE
480
COMPUTE X & Y VECTORS FROM EACH TANGENT PAIR IN SEQUENCE - EQ. (8) & (9)
482
ROTATE VECTORS TO AVE POSITION - EQ. (15) & (16)
484
486
COMPUTE I & J CELL ADDRESSES FOR EACH VECTOR - EQ. (17) & (18)
492
NEW CELL ADDRESS?
YES
NO
494
NEW SEQ. NO.?
YES
NO
498
488
LS = LS + 1
ADD SCALED WEIGHT TO CELL AND SMEAR CELLS
497
NO
LS = LE?
NO
CELL CONTENTS > CONTOUR?
490
YES
495
FLAG SEQ. NO.
500
YES
START ANALY
(TO FIG. 20)
496
STORE CELL CONTENT WITH CELL ADDRESS
493
ADD CELL ADDRESS AND SEQ. NO. TO TABLE III A

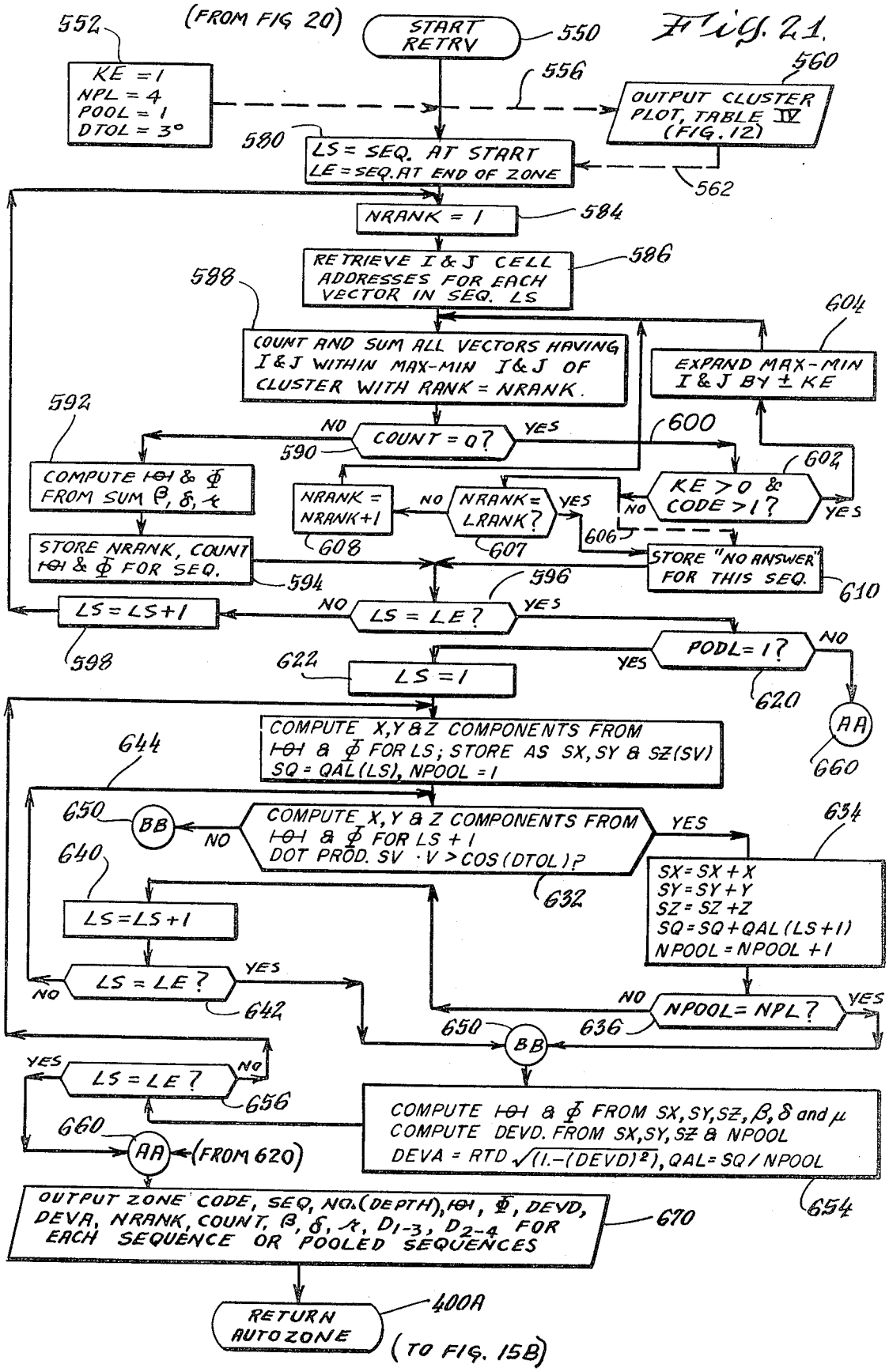
Fig. 21.
(FROM FIG 20)
START RETRV
550
552
KE = 1
NPL = 4
POOL = 1
DTOL = 3°
556
560
OUTPUT CLUSTER PLOT, TABLE IV (FIG. 12)
580
LS = SEQ. AT START
LE = SEQ. AT END OF ZONE
562
NRANK = 1
584
RETRIEVE I & J CELL ADDRESSES FOR EACH VECTOR IN SEQ. LS
586
588
COUNT AND SUM ALL VECTORS HAVING I & J WITHIN MAX-MIN I & J OF CLUSTER WITH RANK = NRANK.
604
EXPAND MAX-MIN I & J BY ± KE
592
NO
COUNT = 0?
YES
590
600
COMPUTE |θ| & Φ FROM SUM β, δ, κ
NRANK = NRANK+1
NO
NRANK = LRANK?
YES
NO
KE > 0 & CODE > 1?
YES
602
608
607
606
STORE NRANK, COUNT |θ| & Φ FOR SEQ.
594
STORE "NO ANSWER" FOR THIS SEQ.
610
596
LS = LS+1
NO
LS = LE?
YES
598
PODL = 1?
NO
YES
622
LS = 1
620
AA
660
COMPUTE X, Y & Z COMPONENTS FROM |θ| & Φ FOR LS; STORE AS SX, SY & SZ(SV)
SQ = QAL(LS), NPOOL = 1
644
650
BB
NO
COMPUTE X, Y & Z COMPONENTS FROM |θ| & Φ FOR LS + 1
DOT PROD. SV · V > COS(DTOL)?
YES
632
654
640
LS = LS+1
SX = SX + X
SY = SY + Y
SZ = SZ + Z
SQ = SQ + QAL(LS+1)
NPOOL = NPOOL + 1
YES
LS = LE?
NO
642
NO
NPOOL = NPL?
YES
650
BB
636
YES
LS = LE?
NO
656
660
AA
(FROM 620)
COMPUTE |θ| & Φ FROM SX, SY, SZ, β, δ and μ
COMPUTE DEVD. FROM SX, SY, SZ & NPOOL
DEVA = RTD √(1.−(DEVD)²), QAL = SQ / NPOOL
654
OUTPUT ZONE CODE, SEQ. NO. (DEPTH), |θ|, Φ, DEVD, DEVA, NRANK, COUNT, β, δ, κ, D1-3, D2-4 FOR EACH SEQUENCE OR POOLED SEQUENCES
670
RETURN AUTOZONE
400A
(TO FIG. 15B)

Fig. 23.

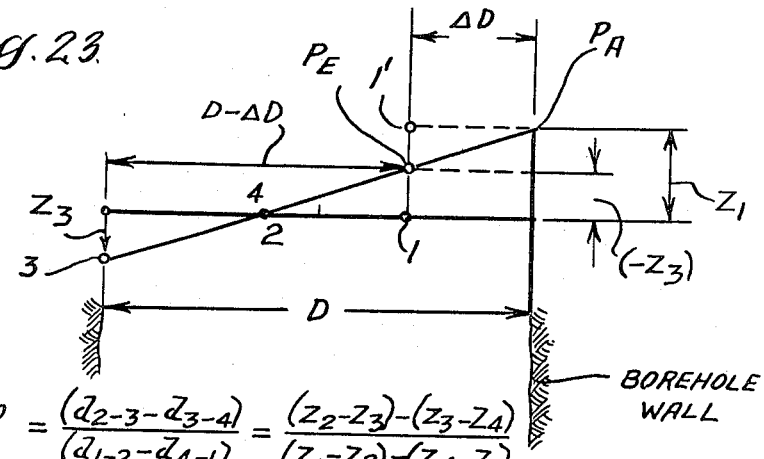

DISPLACEMENT RATIO FOR PAD #1 $= \frac{(d_{2-3}-d_{3-4})}{(d_{1-2}-d_{4-1})} = \frac{(Z_2-Z_3)-(Z_3-Z_4)}{(Z_1-Z_2)-(Z_4-Z_1)}$ $= \frac{-2Z_3+Z_2+Z_4}{+2Z_1-Z_2-Z_4}$ (ASSUMING $Z_2 \simeq -Z_4$) $= \frac{-2Z_3}{2Z_1} = \frac{-Z_3}{Z_1}$ $|Z_1| > |Z_3|$ IF PAD #1 IS FLOATING, OR $\frac{-Z_3}{Z_1} < 1$.

$(-Z_3) \simeq Z_1$ IF PAD #1 IS NOT.

Fig. 24A.

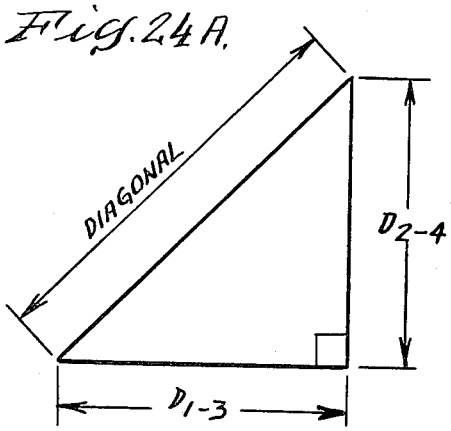

FOR SQUARES (ROUND HOLES)
DIAMETERS $D_{1-3} = D_{2-4}$

DIAGONAL $= \sqrt{(D_{1-3})^2 + (D_{2-4})^2}$ $= \sqrt{2(D_{1-3})^2}$ $= \sqrt{2}D_{1-3}$ OR $= \sqrt{2}D_{2-4}$ DIAMETER $= \frac{\text{DIAGONAL}}{\sqrt{2}}$

Fig. 24B.

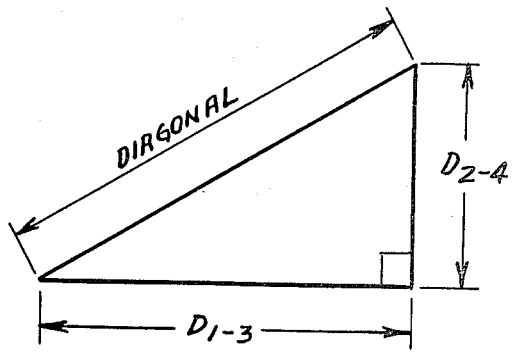

FOR RECTANGLES (ELIPTICAL HOLES)
DIAMETERS $D_{1-3} \neq D_{2-4}$
GEOMETRICAL - MEAN DIAMETER $(GMD) = \frac{\sqrt{(D_{1-3})^2 + (D_{2-4})^2}}{\sqrt{2}}$

EQ. (14)

TABLE I

| KNOWN DISPLACEMENTS | EQUIVALENT ORTHOGONAL DISPLACEMENTS | | CASE |
|---|---|---|---|
| | $d_1 \underline{\vee} 3$ | $d_2 \underline{\vee} 4$ | |
| $d_{4-1}, d_{1-2}$ $(\bar{3})$ | $-d_{4-1}+d_{1-2}$ | $-d_{4-1}-d_{1-2}$ | 1 |
| $d_{1-2}, d_{2-3}$ $(\bar{4})$ | $d_{1-2}+d_{2-3}$ | $-d_{1-2}+d_{2-3}$ | 2 |
| $d_{2-3}, d_{3-4}$ $(\bar{1})$ | $d_{2-3}-d_{3-4}$ | $d_{2-3}+d_{3-4}$ | 3 |
| $d_{3-4}, d_{4-1}$ $(\bar{2})$ | $-d_{3-4}-d_{4-1}$ | $d_{3-4}-d_{4-1}$ | 4 |
| $d_{1-2}, d_{1-3}$ $(\bar{4})$ | $d_{1-3}$ | $-2d_{1-2}+d_{1-3}$ | 5 |
| $d_{2-3}, d_{1-3}$ $(\bar{4})$ | $d_{1-3}$ | $2d_{2-3}-d_{1-3}$ | 6 |
| $d_{3-4}, d_{1-3}$ $(\bar{2})$ | $d_{1-3}$ | $2d_{3-4}+d_{1-3}$ | 7 |
| $d_{4-1}, d_{1-3}$ $(\bar{2})$ | $d_{1-3}$ | $-2d_{4-1}-d_{1-3}$ | 8 |
| $d_{1-2}, d_{2-4}$ $(\bar{3})$ | $2d_{1-2}+d_{2-4}$ | $d_{2-4}$ | 9 |
| $d_{2-3}, d_{2-4}$ $(\bar{1})$ | $2d_{2-3}-d_{2-4}$ | $d_{2-4}$ | 10 |
| $d_{3-4}, d_{2-4}$ $(\bar{1})$ | $-2d_{3-4}+d_{2-4}$ | $d_{2-4}$ | 11 |
| $d_{4-1}, d_{2-4}$ $(\bar{3})$ | $-2d_{4-1}-d_{2-4}$ | $d_{2-4}$ | 12 |
| $d_{1-3}, d_{2-4}$ | $d_{1-3}$ | $d_{2-4}$ | 13 |

VIRTUAL TANGENT PAIR $= d_1 \underline{\vee} 3 / D_{1-3}$ & $d_2 \underline{\vee} 4 / D_{2-4}$ FOR EACH CASE NOTE : SOME DIPMETER RESULTS LIST A DIAGONAL DISPLACEMENT AS "CD" DEPENDING UPON WHICH PAD IS NULLIFIED. THE DIAGONAL DISPLACEMENT "CD" CORRESPONDS AS FOLLOWS:

| NULLIFIED PAD (NP) | CD |
|---|---|
| 1 | $-d_{2-4}$ |
| 2 | $+d_{1-3}$ |
| 3 | $+d_{2-4}$ |
| 4 | $-d_{1-3}$ |

BASIS : $d_{a-b}+d_{b-c}+d_{c-a} \cong 0$ (CLOSURE)

e.g. : $NP = 4 : d_{1-2}+d_{2-3}+d_{3-1} \cong 0$ AND $d_{3-1} = -d_{1-3}$

TABLE II

| TOP PAD | DISPLACEMENT RATIO – DR |
|---|---|
| 1 | $(d_{2-3}-d_{3-4})/(d_{1-2}-d_{4-1})$ |
| 2 | $(d_{3-4}-d_{4-1})/(d_{2-3}-d_{1-2})$ |
| 3 | $(d_{4-1}-d_{1-2})/(d_{3-4}-d_{2-3})$ |
| 4 | $(d_{1-2}-d_{2-3})/(d_{4-1}-d_{3-4})$ |

TABLE III A

| | CELL ADDRESS | | CELL CONTENTS | SEQ NO. | CELL LINK |
|---|---|---|---|---|---|
| | I | J | | | |
| 1 | 13 | 19 | 8 | 11 | 1 |
| 2 | 12 | 19 | 8 | 0 | 1 |
| 3 | 15 | 24 | 18 | 0 | 3 |
| 4 | 15 | 23 | 10 | 0 | 3 |
| 5 | 17 | 14 | 9 | 13 | 5 |
| 6 | 16 | 23 | 10 | 0 | 3 |

TABLE III B

| CELL ADDRESS | | CELL CONTENTS | SEQ NO. | CELL LINK |
|---|---|---|---|---|
| I | J | | | |
| 13 | 19 | 8 | 11 | 1 |
| 12 | 19 | 8 | 0 | 1 |
| 15 | 24 | 13 | 0 | 3 |
| 15 | 23 | 10 | 0 | 3 |
| 16 | 23 | 10 | 0 | 3 |
| 17 | 14 | 9 | 13 | 5 |

TABLE IV

| CELL ADDRESS | | | | CELL LINK | CLUSTER SUM | CLUSTER RANK | SEQ. NO. |
|---|---|---|---|---|---|---|---|
| I | | J | | | | | |
| L | R | T | B | | | | |
| 11 | 13 | 18 | 19 | 1 | 24 | II | 0 |
| 14 | 16 | 22 | 24 | 3 | 65 | I | 0 |
| 16 | 17 | 13 | 14 | 5 | — | III | 13 |

DIPMETER DISPLACEMENT QUALIFYING TECHNIQUE

This is a continuation, of application Ser. No. 537,310 filed Dec. 30, 1974 and now abandoned.

BACKGROUND OF THE INVENTION

This invention relates generally to techniques used in geophysical well logging, and more particularly to new techniques for automatically processing dipmeter signals or displacement measurements obtained between these signals to produce more accurate dip and azimuth representations of subsurface formations.

A common method of measuring the dip angle and direction or azimuth of subsurface formations employs a dipmeter tool passed through a borehole drilled into the subsurface formations. This tool may apply any of numerous means to obtain geophysical signals representative of variations of a particular formation characteristic, such as its resistivity. One such tool is described in the paper: "The High Resolution Dipmeter Tool", by L. A. Allaud and J. Ringot, published in the May–June 1969 issue of *The Log Analyst.*

Dip and azimuth measurements representing the inclination of a formation characteristic or feature may be determined from dip-meter signals containing information representing the intersection of such a feature at three or more radially spaced points on the borehole surface. The displacement between two points intersecting a common feature may be determined, under favorable circumstances, by correlating pairs of the dipmeter signals, each having a similar response to the common feature. Two displacements between three different points determine the position of a plane. The position of the plane is conveniently expressed by its dip $\theta$, an angle measured from a reference (usually horizontal) plane and its azimuth $\phi$, an angle measured from a reference direction (usually true North). Typically, the dipmeter signals are recorded on computer compatible magnetic tape at the well site for later processing. The recorded signals are processed using any of several techniques. Manual, semi-automatic and fully automatic processing may be used with the automatic processing being performed with either analog or digital computers. When digital computers are used, a computer program is also required.

A computer program to perform the digital processing operations is described in a paper, "Automatic Computation of Dipmeter Logs Digitally Recorded on Magnetic Tape" by J. H. Moran, et al and published in the July, 1962 issue of the *Journal of Petroleum Technology.* An additional computer program is described in the paper, "Computer Methods of Diplog Correlation" by L. G. Schoonover et al, pages 31–38, published in the February 1973 issue of *Society of Petroleum Engineers Journal.* Further, programs to process digitally-taped dipmeter data may be obtained from digital computer manufacturers, such as IBM.

Results from digital processing are normally presented in tabular listings as dip and azimuth measurements versus borehole depth. When desired, the individual displacements found between the correlated curve pairs which led to the dip and azimuth values may be also presented. Further, most such programs will provide the ability to vary both the length of the correlation interval and the step used to move this interval between each correlation sequence. For the next sequence, the same correlation length is used, but the actual interval correlated is moved by one correlation step length.

At each step or depth level, one sequence of displacements between various pairs of signal combinations may be obtained. A typical sequence includes at least two displacements but may include a round of up to six displacements in each sequence when four separate signals are employed, for example. When a round of more than two displacements in one sequence is obtained, the displacements may be combined into many more possibly different combinations, each combination corresponding to perhaps a different dip and azimuth measurement. Since only two related displacements are required, it is common practice to utilize only what appears to be the two best qualified displacements. All others are discarded without further consideration, thereby producing only one result per sequence. Further, little is retained as to the position of the sources or dipmeter pads corresponding to the utilized displacements.

When large numbers of measurements result, as from recent high resolution dipmeter techniques, tabular listings are usually augmented by graphic presentations of dip and azimuth representations. The graphic displays vary with the interpretation objective, depending upon whether the purpose is for stratigraphic or structural studies. Accordingly, relationships between the corresponding dip and azimuth measurements and their continuity with depth are considered in different manners.

For stratigraphic purposes, trends of adjacent dip measurements with depth are usually used to classify the measurements. For example, measurements representing a trend of rapidly increasing dip with depth will be considered separately from measurements representing a trend of rapidly decreasing dip with depth.

In the stratigraphic analysis, it is important that the azimuth of these dips must remain substantially constant and thereby represent the general direction of sediment transport or perhaps the probable direction of down dip thickening. Also, dipmeter results are combined in a given analysis from intervals corresponding to a given depositional or stratigraphic unit.

Graphic displays used for stratigraphic analysis often ignore the actual depths once the above dip versus depth trend for a given azimuth range qualifies a group of measurements. Further, since in many cases the actual dip angle is not important and only the dip azimuth is significant, the dip angle may be completely ignored in the graphic display. Such displays are designed to statistically determine the azimuth corresponding to a primary and perhaps a secondary direction of transport or deposition.

Graphic displays used in stratigraphic analysis are typically the azimuth frequency plot (no dip or depth representation) and the Schmidt net and the Stereonet (azimuth versus dip but still no depth representation). These nets and several variations thereof have known statistical characteristics in that they may enhance either low or high dip measurement point groupings. Note that in their use, the dip and azimuth value for each measurement is combined and represented by a point in these nets. A description of some of these displays and their application is given in the paper "Stratigraphic Applications of Dipmeter Data in Mid-Continent" by R. L. Campbell, Jr., published September 1968 in the *American Association of Petroleum Geologists Bulletin.*

Stratigraphic and structural analyses distinguish themselves in the type of information needed. In stratigraphic analysis, the dipmeter signals hopefully represent bedding planes within the boundaries of a given geological unit. These bedding planes have little, if any, regional extent. In structural analysis, a deliberate attempt may be made to mask out such sedimentary features in favor of enhancing the boundaries of the individual strata.

Short lengths (1 to 2 or 3 feet) of dipmeter signals are correlated to obtain stratigraphic information while long lengths (10 to 20 or 30 feet) of signals are often correlated to obtain structural information. While use of long correlation lengths to obtain structural dip has been standard practice for some time, there are certain disadvantages associated with this practice. One is that the use of long correlation lengths masks dip patterns needed for stratigraphic analysis, thus additional computations must be made using a short length to obtain stratigraphic information. Another is that most long correlation length techniques may be influenced by frequently occurring stratigraphic features having a common dip and direction, even though each such feature is less pronounced than the structural feature. Thus, the use of long correlation lengths does not assure obtaining accurate structural dip information. Yet another disadvantage is that current correlation techniques tend to ignore possibly objectionable effects of rotation of the dip-meter tool within the long correlation interval.

The preferred approach is to obtain the detailed information available only from short correlation intervals and then apply previously mentioned trend analysis to separate the stratigraphic and structural dips. However, as the correlation interval is shortened, the probability of obtaining a completely erroneous displacement increases substantially. The wrong peak on the correlation function produced in the correlation process may be used to determine the displacement. Such invalid displacements may be combined with valid displacements and produce an erroneous dip which add scatter and confuse valid trends or when systematically erroneous, may even appear as false trends.

As a compromise, longer correlation intervals than are actually desired are employed to artificially reduce this scatter to an acceptable level so that any valid trend which may be present might be found.

It is therefore an object of this invention to provide a technique to reduce the scatter in dip and azimuth measurements determined from short correlation intervals.

One technique which is employed to reduce scatter and find dip and azimuth trends is to average long intervals of dip measurements obtained from much shorter intervals. Unfortunately, the valid trends present only as short intervals may be masked completely by such an averaging process. Further, the resolution and position of the correct peak obtained by correlating short intervals tends to vary considerably, consequently, the corresponding displacements lack accuracy. Certain combinations of such displacements may compound the variation and introduce unacceptable inaccuracies in the resulting dip and azimuth measurements.

It is therefore an additional object of the present invention to provide a technique to improve the accuracy and reduce the scatter of dip and azimuth measurements without necessitating long interval averaging.

Some of the averaging techniques include a preliminary process of sorting or discarding apparently stray dips before averaging to prevent their contributing to the average. This process adds both time delays and expense to a process which already produces too few dips for many purposes. Further, some of the apparent strays may actually be part of a valid trend which was unfortunately just sampled infrequently. Both the discarding and averaging processes suppress such valid dips.

It is therefore a further object of the present invention to provide an automatic technique to improve the accuracy of dip and azimuth determinations without reducing the number of valid dips or discarding dips because they do not comply with some long interval trend.

When such averaging techniques are employed, the intervals to be averaged are often chosen arbitrarily such as every 100 feet or the like. Yet such zoning or sample grouping is an important factor in most statistical analysis. In some techniques, independent geological information is examined (usually manually) to select specific zones to be averaged. This latter process requires considerable time as well as accurate coordination of the depths of the geological information and the dipmeter information. This depth coordination may be a problem in deviating holes where the dipmeter information might not correspond to true depths. It would therefore be advantageous to have the determination of zones be made from the dipmeter data itself.

It is therefore a further object of the present invention to provide a technique for automatically zoning dipmeter information by analyzing the dipmeter information itself.

As previously discussed, these are prior art techniques for statistically analyzing either the dip or azimuth information for long interval trends. These methods usually employ polar chart representations to classify the dip and/or azimuth measurements. In these plots, the dip varies with distance from either the center or the edge of the plots and the azimuth varies with the radial distribution from the center of the plot.

However, when one considers the type of errors likely to take place in the correlation processes, particularly in deviated holes, it is desirable that any analysis not separate the dip from the azimuth values for the purposes of the analysis. The analysis should be able to detect any interrelationship between the dip and azimuth for the individual measurements. More particularly, the analysis should respect the fact that erroneous displacements can be concealed when expressed only as the resulting dip and azimuth measurements.

It is therefore a further object of the present invention to provide a technique for analyzing displacements and combinations of displacements rather than computing and analyzing the resulting dip or azimuth measurements.

Prior art methods do attempt to select only the best displacements or combinations thereof by assigning a quality rating according to the correlation process which determined the displacement. The best rated displacements are selected while discarding poor quality displacements. Yet the best displacements may be distorted or exaggerated due to failure of the signal source to maintain its proper position in the borehole, while poorer rated displacements may be obtained from sources in a much better position to produce more accurate displacements.

Therefore, it is a particular object of the present invention to consider the relative position of the signal sources in selecting the most valid displacements.

In accordance with these and other objects of the present invention, apparatus and methods are provided for automatically determining with a machine the most valid combination of displacements from a plurality of displacements and combinations thereof. These displacements may be obtained between pairs of geophysical signals derived from separate signal sources located on a dipmeter apparatus passed through a borehole penetrating subsurface earth formations. Displacements between pairs of geophysical signals may be produced by comparing the similarity of signal features for various displacements on said signals. When it is determined that these displacements are substantially devoid of closure error and thereby correspond to the same formation feature, the signal source most likely not to be in the proper position in the borehole is located and those displacements common to said source are nullified from determining the position of the formation features reflected in the signal features of said geophysical signals.

It has been discovered that for many types of dipmeter apparatus, the signal source or pad located nearest the top side of the borehole when the borehole is deviated substantially from the vertical, tends to lose its proper position in respect to the borehole wall. Further, it has been discovered that the type of focussing normally associated with these dipmeters electrically extends the effect of this pad, overcoming to a large extent the lack of contact with the borehole wall, and in effect, repositioning the pad on the borehole wall. However, the corresponding diameter measurement does not reflect the effective position and thereby produces displacements which are distorted or exaggerated. When no considerations for the above are made, the dips computed from a displacement combination which includes displacements between signals obtained from such floating pads are also exaggerated. By locating the signal source most likely not to be in the proper position and disqualifying or nullifying those displacements associated with this source, particularly when planarity errors are known to exist only those displacements remaining may be selected as the most valid displacements.

In one form of the invention, a closure error is computed and if a substantial closure error is found, it is assumed that one or more displacements correspond to different formation features and the degree of distortion or exaggeration from a planar formation feature cannot be determined. However, if little closure error is found it is assumed that all the displacements used in the closure computation correspond to substantially the same formation features; therefore, planarity error, distortion, or exaggeration may be evaluated.

In one aspect of the invention, the actual position of the formation feature is compared with the expected position of the formation feature on a signal derived from a given source. These positions are determined from the given relationships combining related displacements. The displacements corresponding to the largest difference between the expected and actual positions are considered to be the most exaggerated or distorted and therefore disqualified as valid displacements.

In another aspect of the invention, the source most likely not to be in the proper position is located. The displacement relationships specific to that source may then be used to determine the degree of distortion or exaggeration. If this degree exceeds a given range it implies that the most likely source not to be in the proper position was in fact out of position. The displacements associated with a signal obtained from this source may on one hand be disqualified from further consideration as valid displacements or, on the other hand, corrected to eliminate the distortion. When the above technique is applied in highly deviated holes to determine those displacements which are valid and may therefore be combined as possible corresponding displacements, and these possibly corresponding displacements are used in a further technique, a substantial improvement in dips determined from the combination of techniques is obtained.

For a better understanding of the present invention, together with other and further objects thereof, reference is had to the following description taken in connection with the accompanying drawings, the scope of the invention being pointed out in the appended claims.

BRIEF DESCRIPTION OF THE FIGURES

FIG. 1 illustrates a method and apparatus for producing dipmeter signals, obtaining displacements between pairs of these signals and processing these displacements in accordance with one form of the invention.

FIG. 4A illustrates in a view looking down the borehole one position a borehole tool may take in a deviated borehole.

FIG. 4B illustrates the side view corresponding to FIG. 4A and shows how the measured diameter $D_{1\text{-}3}$ may not correspond to the effective diameter De.

FIG. 5A illustrates possibly corresponding displacements between two similar characteristics, A and A', on one signal and similar characteristics, B through D, on various other signals.

FIG. 5B shows correlograms related to the possibly corresponding displacements illustrated in FIG. 5A.

FIGS. 6A through 6G illustrate, in simplified form, six correlograms and the corresponding displacements usually selected in correlating various pairs of the four curves illustrated in FIG. 6A.

FIG. 8A illustrates in simplified form how displacement distances Z determined between an electrode plane on the borehole tool and features on curves or signals derived at the electrodes may be treated algebraically to determine displacements.

FIG. 9A illustrates the displacement relationships corresponding to the ideal case of good closure and planarity.

FIG. 9B illustrates the case corresponding to poor closure between four adjacent displacements.

FIGS. 9C and 9D illustrates the case where good closure but a lack of planarity may result in several possible combinations of displacements and corresponding planes.

FIG. 9E illustrates the relationship between four possible combinations of displacements and their corresponding planes.

FIG. 9F illustrates some additional planes which may result when diagonal displacements are combined as possibly corresponding displacements.

FIG. 10A illustrates how three-dimensional projections of vectors relative to the four pads of the borehole tool may be transformed into two dimensions such that the density of vectors in a given area in the three-dimensional projection is not changed in the two-dimensional transformation.

FIG. 10B illustrates one method of dividing the two-dimensional transformation shown in FIG. 10A into a classification system oriented relative to the position of the pads on the borehole tool, the position of magnetic North and the top side of the borehole.

FIG. 14 illustrates in numerical form sequences of displacements containing zones of stable sequences and adjacent stable sequences which have been determined from displacements obtained by correlating pairs of signals derived from adjacent sources.

FIG. 15B illustrates detailed steps in the procedure to determine substantially stable sequences of displacements.

FIG. 15C illustrates a procedure to determine pairs of adjacent stable sequences.

FIG. 19 illustrates the detailed steps in a procedure to classify combinations of displacements produced in the process illustrated in FIG. 18.

FIG. 21 illustrates the detailed steps of a procedure to determine the relative position of features in each signal interval corresponding to the dominant class determined as illustrated in FIG. 20.

FIG. 23 illustrates certain relationships useful in determing when a source of a signal is displaced from the borehole wall.

FIGS. 24A and 24B illustrate the determination of a meaningful diameter in non-circular holes.

TABLE I illustrates certain relationships between known displacements and equivalent orthogonal displacements.

TABLE II illustrates displacement ratios corresponding to various signal sources or pads.

Figure 20:
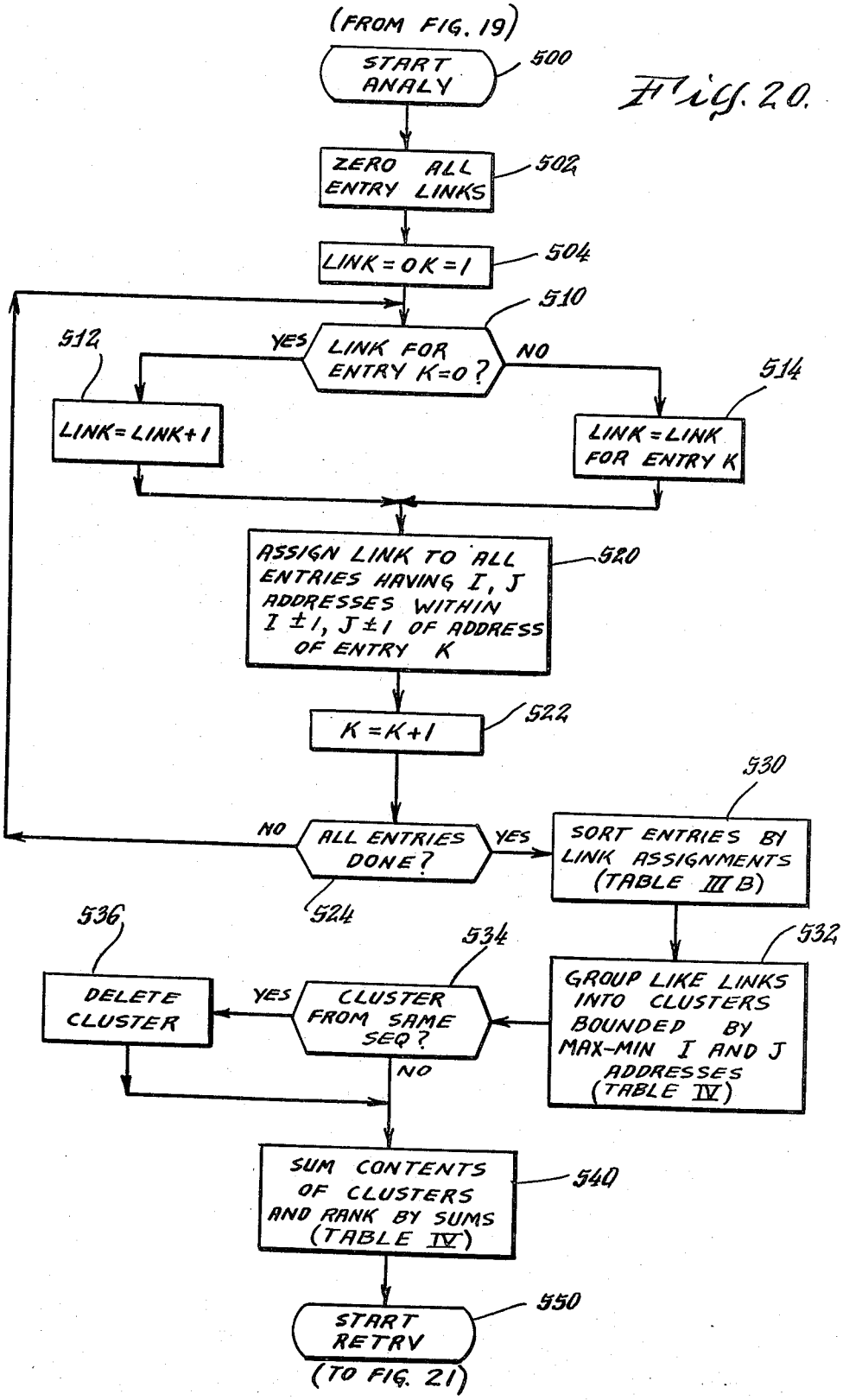
FIG. 20 illustrates the detailed steps of a procedure to analyze classified combinations of displacements to determine the positions of various classes and the relative position of the dominant class.

TABLE IIIA shows by example tabulations of stored cell addresses, cell contents and other entries which may be produced by the process illustrated in FIGS. 19 and 20.

TABLE IIIB shows by example the results of the processing illustrated in FIG. 20 when applied to the example of TABLE IIIA.

TABLE IV shows by example the cell addresses corresponding to the position of clusters of cells or classes of varying rank.

Referring now to FIG. 1, there is illustrated a method of acquiring and processing signals obtained from a borehole investigating device commonly known as a dipmeter. This device is described in one form in U.S. Pat. No. 3,521,154 issued July 21, 1970 to J. J. Maricelli. The purpose of the dipmeter device is to obtain signals from three or more radially spaced sources usually in the form of pads which contact the borehole wall. Signals obtained from such sources reflect formation features at their intersection with the borehole wall and are useful in determining the orientation of the formations penetrated by the borehole.

Typical earth formations are represented by the shale formations 13 and 14 shown in FIG. 1, and intervening sand formation 15. Typical formation features are boundaries 16 and 17 shown between these formations.

As shown in FIG. 1, the borehole apparatus 18 is lowered on cable 30 into a borehole 10 for investigating the earth's formations. The downhole investigating device 18 is adapted for movement through the borehole 10 and as illustrated, includes four pads designated 19, 20, 21 and 22 (the front pad 19 obscures the view of back pad member 21 which is not shown).

The pad members 19 through 22 are adapted to derive measurements at the wall of the borehole. Each pad includes a survey electrode shown as Ao. One of the pads, herein designated as pad 19, may contain an additional survey electrode Ao' useful in determining the speed of the tool. Each survey electrode is surrounded by an insulating material 48. The insulating material and thus all the survey electrodes are surrounded by a main metal portion 45 of the pad. The metal portion 45 of each pad, along with certain other parts of the apparatus, comprise a focussing system for confining the survey current emitted from each of the different survey electrodes into the desired focussed pattern. Survey signals representative of changes in the formation opposite each pad are obtained from circuits comprising Ao electrodes, focussing elements, and a current return electrode B shown in FIG. 1.

The upper end of the borehole tool 18 as shown in FIG. 1 is connected by means of an armored multiconductor cable 30 to a suitable apparatus at the surface for raising and lowering the downhole investigating device through the borehole 10. Mechanical and electrical control of the downhole device may be accomplished with the multiconductor cable which passes from the downhole tool 18 through the borehole to a sheave wheel 31 at the surface and then to a suitable drum and winch mechanism 32.

Electrical connections between various conductors of the multiconductor cable, which are connected downhole to the previously described electrodes, and various electrical circuits at the surface of the earth are accomplished by means of a suitable multi-element slip-ring and brush contact assembly 34. In this manner, the signals which originate from the downhole investigating device are supplied to the signal processing circuits 39 which in turn supply the signals to a signal conditioner 40 and recorder 41. A suitable signal generator 42 supplies current to the downhole tool via transformer 50 and to signal processing circuits located at the surface. More details of such circuits are described in the aforementioned Maricelli patent.

Signals obtained from the downhole device may be recorded graphically by a film recorder 41. One such recorder is described in U.S. Pat. No. 3,453,530 issued to G. E. Attali on July 1, 1969. In addition, the signals may be processed to obtain discrete samples and recorded on digital tape. A suitable digital tape recorder is described in U.S. Pat. No. 3,648,278 issued to G. K. Miller, et al on Mar. 7, 1972.

The signals may be sampled by driving sampling devices, such as those described in the above-mentioned digital tape recorder, by the cable motion as measured at the surface. For example, the cable length measuring wheel shown as 34A in FIG. 1 may be used in controlling the signal processing, sampling and recording subcycles as indicated by signal line 34B. Therefore, each sample of a measured signal corresponds to one increment in depth and displacements determined between such sample signals are indicative of depth displacements.

The dipmeter signals or samples thereof may also be transmitted directly to a computer. The computer may be located at the well site or the signals may be transmitted via a transmission system to a remote computer location. One transmission system which may be used is described in U.S. Pat. No. 3,599,156 issued to G. K. Miller, et al on Aug. 10, 1971.

The recorded or transmitted signals may be processed as digital measurements by general purpose digital computing apparatus properly programmed in a manner to perform the processes described herein or by special purpose computing apparatus composed of modules arranged to accomplish the described steps to accomplish the same process.

Alternatively, as shown in FIG. 1, the signals may be processed directly at the well site, using conventional digital computing apparatus 60 when properly programmed and interfaced to the signal conversion means 52. One such computing apparatus is the Model PDP-11/45 obtainable from the Digital Equipment Corporation Suppliers of such equipment may also supply signal conditioning circuits 40 and signal conversion means 52 suitable for conditioning and converting analog signals to digital samples for subsequent digital storage and processing. Further, such computing apparatus ordinarily includes a memory for storing data and information such as parameters, coefficients and controls used and generated by the processing steps.

A brief description of one process which may be performed at the well site by such a computer 60 when properly programmed is illustrated by Blocks 62 through 102 of FIG. 1. Other processes will be described in detail in relation to additional FIGS. 15A through 21.

Blocks 62 through 102 of FIG. 1 illustrate the steps of correlating the dipmeter signals in pairs to obtain sequences of displacements between similar features on the signals, determining a zone of displacement sequences which is suitable for subsequent combination and analysis, combining and classifying all the possible corresponding displacements in this zone and perhaps, as indicated in Block 102, outputting these classifications at this time. However, these classifications may be automatically analyzed to locate the dominant mode for these classifications and, if found, the location of this mode may also be output as indicated by Block 98. This location is indicative of the dip and azimuth of the formation features in the zone. Processing may then continue with more correlations if needed and the determination of more displacement zones to be processed.

When performed at the well site, it may be desirable to record and/or display the results of such processing on recorder 110 connected to the programmed digital computer 60. Recorder 110 may be a digital tape recorder or have display capabilities such as a printer, plotter or CRT recorder. The nature and use of these devices is well known and will not be described herein.

Referring again to FIG. 1, a more detailed description will now be provided for the process shown there in the form of the steps of a process flow diagram, and which may be performed with the aid of the digital computer 60 programmed in accordance with this invention.

After signal conversion 52 and storage in the memory of the computer 60, signals may be read from memory and correlated by pairs to determine possible displacements between corresponding features on the signals as indicated in Block 62. The correlation process is well known, but in review, includes successively comparing identical length intervals equal to the correlation length 64 of two signals. At each comparison, the interval on one of the signals is displaced by a given displacement from the corresponding interval on the other signal. Successive comparisons and displacements produce a series of correlation values known as a correlogram.

These values are compared to determine the displacement indicating the position at which similar features present on both signals correspond.

The above-described process is again repeated for a different interval of both signals using the same correlation length. This interval is located one correlation step 66 from the previously correlated interval. Another correlogram and displacement is obtained for this interval and similarly for a sequence of intervals spaced apart by one correlation step 66. In like manner, the same signal is correlated with other signals and the other signals correlated by pairs within themselves to produce additional displacements for the same interval. Thus one interval or sequence produces many displacements between the various signal pair combinations. For example, in the four pad dipmeter shown in FIG. 1, six displacements per sequence may be obtained.

In the prior art techniques of correlation, the relationship between the correlation step and the correlation length is such that the correlation step 66 may be equal to the correlation length 64. Then each correlation sequence considers a new correlation interval on each pair of signals with the result that the displacements determined for each sequence of correlated intervals are essentially independent of each other.

Most prior art correlation techniques include the ability to change both the correlation length 64 and correlation step 66. In performing the present invention, it is preferred that the correlation step may be made to be equal to less than one-half of the correlation length. In this way, sequential correlation intervals may be made to substantially overlap each other. In accordance with this invention, it is expected that the displacements determined from sequences of such substantially overlapping correlation intervals will be somewhat consistent when a dominant feature is present on both signals throughout the overlapping interval. Thus, as illustrated in FIG. 1 and preferred in the present technique, the correlation step 66 should be substantially less than the correlation length 64 such that the correlation process employs substantially overlapping correlation intervals. For each sequence, the same basic signal interval is used to correlate with other signals derived from sources around and across the borehole. Thus one sequence produces a round of many correlations, correlograms and displacements.

Point A indicated at 70 in FIG. 1 corresponds to the beginning of an optimal procedure to determine a zone of displacements suitable for the analysis which follows beginning at Point B, designated as 74 in FIG. 1. However, as indicated by the dashed Branch 73, this procedure may be bypassed and a specified number of sequences, ten, for example, used to define a zone. In such a case, this manner is related somewhat to the amount of overlap in successive sequences. For example, since at least a 50% overlap is preferred, at least two sequences are required to define a zone. Similarly, when a 75% overlap is used, four sequences could define a zone.

A common problem in statistical techniques is to determine a significant sample group so that the results of the statistical analysis may be meaningful. In the previously described statistical techniques, the selection of the zones to be averaged or plotted in the prior art analysis may be arbitrarily determined as, for example, any given one hundred feet of dipmeter results. Or, for another example, the zones selected may be limited to depths corresponding to the boundaries of a known geological formation. As an additional example, dip and azimuth values may be compared to detect specified dip and/or azimuth related trends as previously discussed, with the limits of the trend establishing the zone.

As indicated in Block 72 of FIG. 1, the zoning determination of the present technique is based upon comparison of displacements rather than dip and azimuth values. Briefly, the sequence of displacements determined between a given pair of signals are examined to determine stable sequences of displacements. Then, related pairs of displacement sequences are examined to see if stable sequences are present for corresponding displacements. The limits of such stable sequences of corresponding displacements determine the limits of a stable zone. The limits of the stable zone are then used to group the displacements into zones for subsequent analysis. A more detailed description is provided in regard to FIGS. 15A through 18.

Then, beginning at Point B of FIG. 1, and as indicated at block 76, possible corresponding displacements from each zone are combined and the resulting combinations classified in a classification system which is oriented relative to the position of the sources of the corresponding signals, i.e. the pads located on the dipmeter tool. Details of these procedures are provided in regard to the description of FIGS. 19 and 20. As indicated by the test in Block 80 of FIG. 1, this process continues as the test indicated in Block 80 will never answer YES until all possible combinations of displacements have been combined and classified. At this time, the test indicated in Block 80 answers NO, and the process continues at point C to begin the analysis of the classified combinations.

Figure 12:
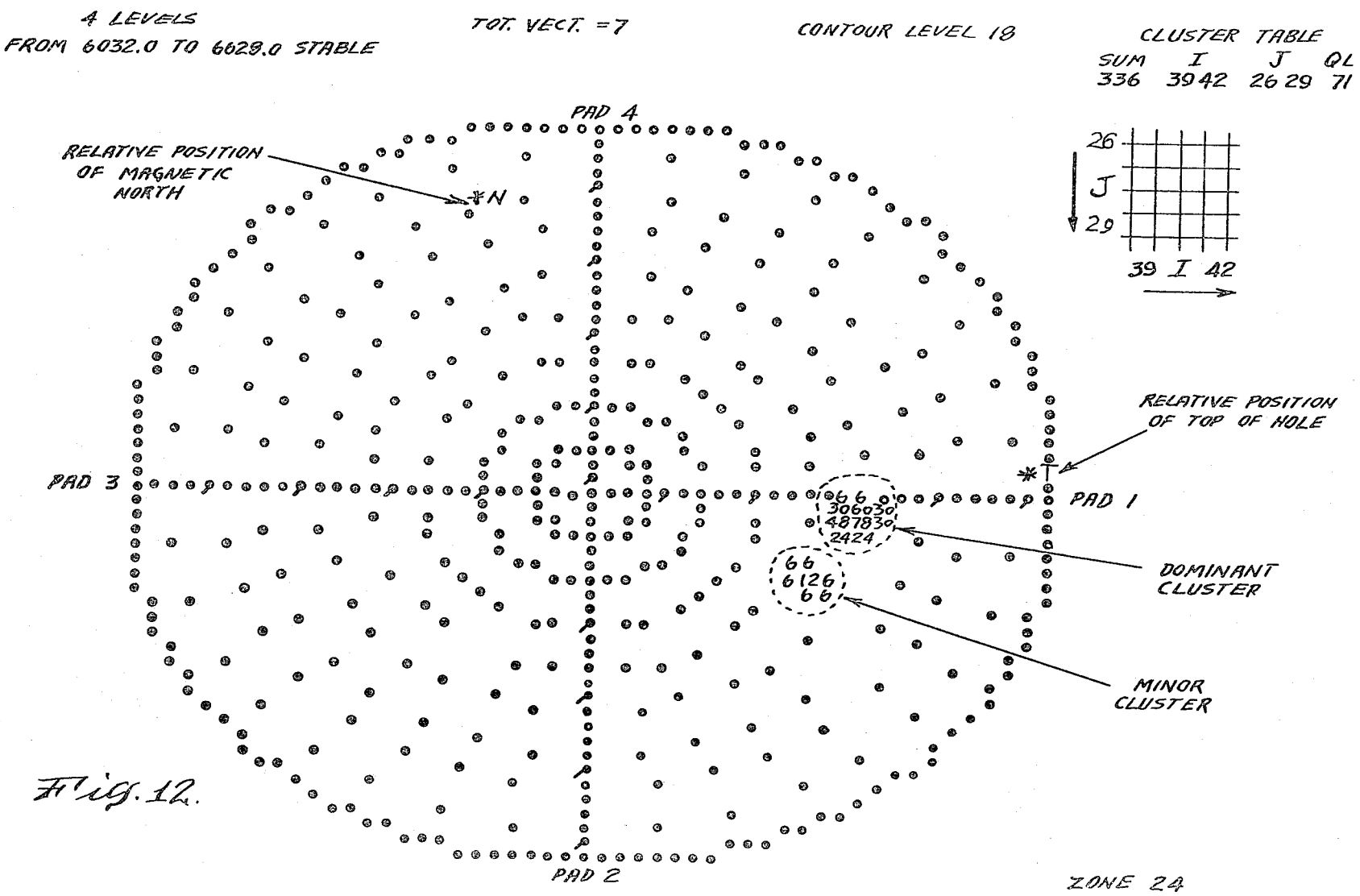
FIG. 12 illustrates a two-dimensional graphic display corresponding to the two-dimensional transform which may be produced as one feature of the invention.

As an optical feature, as indicated by the dashed Branch 100 of FIG. 1 and output Block 102, the classified combinations of displacements which resulted from the previous processes may be output at this time and recorded on recorder 110. FIG. 12, which will be described in more detail later, is illustrative of such output. It will be appreciated by those skilled in the art that any graphic output similar to that illustrated by FIG. 12 is of value in determining the relative position of the formation features represented by the displacements. It will be further appreciated that the positions represented by the various subdivisions of the classification system may be calibrated in terms of the apparent dip and azimuth values relative to the orientation of the tool as illustrated in FIG. 10B and as such may be converted into approximations of the actual formation dip and azimuth. Therefore such output, whether it be in the form as illustrated in FIG. 12, in tabular form, or other forms to be described, or the like, the results of the classified combinations is considered to be a significant feature of the present invention.

It is a further feature of the present invention to automatically analyze classified displacements combinations. Such analysis determines the position of the dominant mode for the distribution of the classified displacement combinations and, if desired, accurately determines the dip and azimuth values for each sequence corresponding to each class or distribution mode. Still further, when successive sequences indicate dips varying by a few degrees, the corresponding combinations may be pooled to provide compensation for small inaccuracies causing the variation, thereby providing more accurate dip and azimuth values.

Briefly, the analysis process indicated in Block 92 of FIG. 1 comprises comparing the number and/or quality of displacements combinations corresponding to each division of the classification system to locate the highest concentration or density of combined displacements. Where several concentrations or clusters of combinations occur, they are ranked to determine the dominant one. Once such a dominant cluster is located displacement combinations from each sequence which contributed to the dominant cluster may be retrieved and utilized in the computation of dip and azimuth values corresponding to that sequence. For sequences having no displacement combinations which contributed to any of the clusters, or where no distribution modes or clusters are found within the zone, no reliable displacement combinations are considered to exist so no dip or azimuth computation is attempted. The analysis process will be described later in greater detail in regard to FIGS. 19, 20 and 21.

Referring again to FIG. 1, optional Branch 106 corresponds to the case where only the output of the classifications as illustrated in Block 102 is desired and the analysis step illustrated in Block 92 is bypassed. As illustrated in FIG. 1, the process would continue in this case as it would if the analysis indicated in Block 92 has been performed. Of course, in this case where no analysis was made, no mode will be found and the test indicated in Block 94 will answer NO, so that the process continues as indicated by Branch 96, returning to Point A to begin again the zoning process previously described.

Normally, the analysis of the classified combinations of displacements to locate the dominant mode as indicated in Block 92 of FIG. 1 is performed. However, as will be explained later in detail, it is possible that no mode or cluster will be located, in which case the test indicated in Block 94 will answer NO and the process will continue via Branch 96 as previously described in the case of the option where no analysis was performed at all. However, in the cases where the analysis is performed and is successful in locating a dominant mode, the test indicated in Block 94 answers YES and output of the mode location takes place as indicated in Block 98. This output may be in many forms, the simplest of which would correspond to the utilization of the recorder 110 to list the location of the dominant mode. As will be appreciated by those familiar with this art, and as illustrated in regard to FIG. 12, a knowledge of the mere location of the dominant mode is of significant value. As previously discussed in regard to the output of the classified combinations—as indicated in Block 102—such a location may be converted by well-known techniques into accurate dip and azimuth values.

Figure 22:
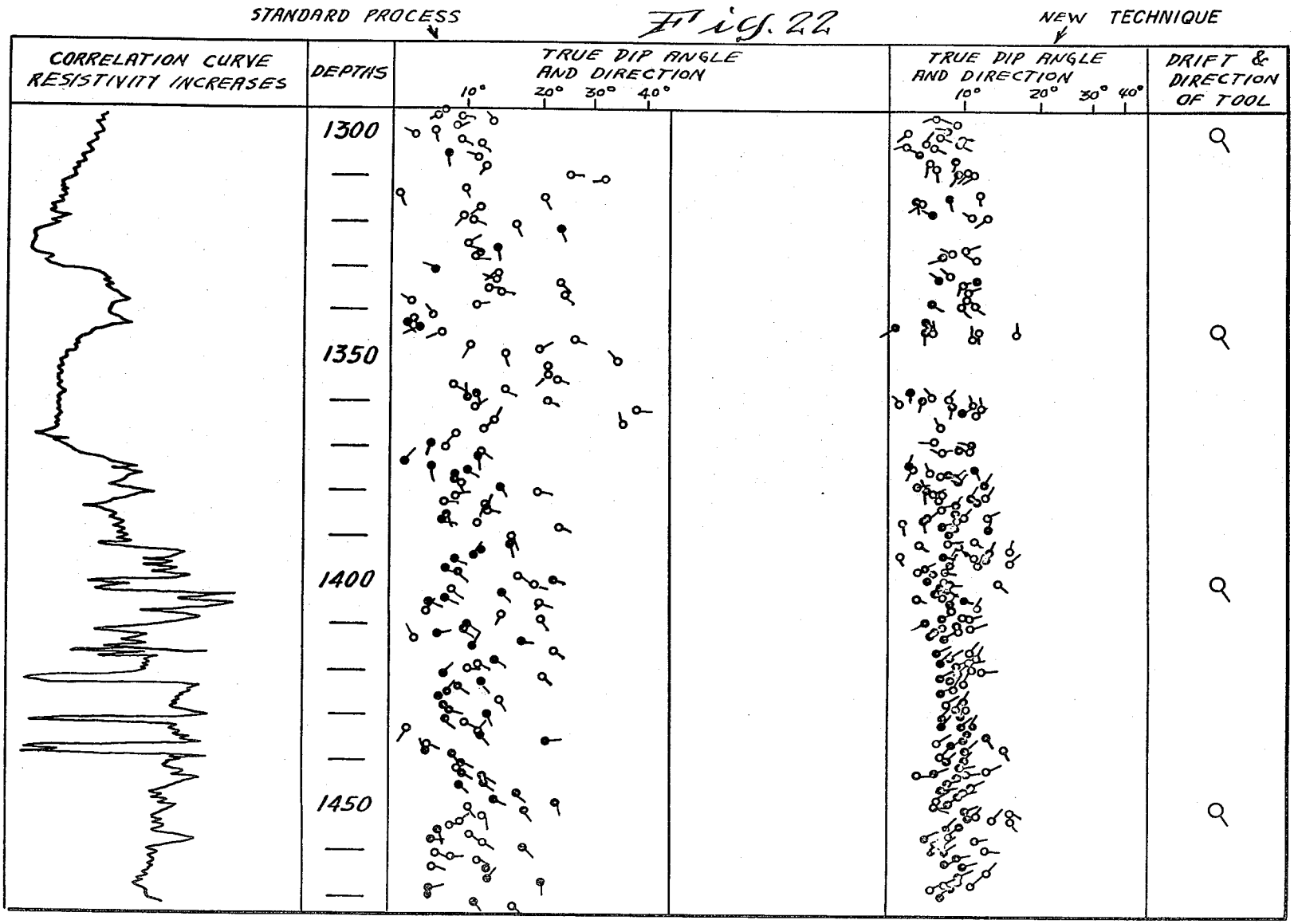
FIG. 22 illustrates the improvement obtained in the determination of formation dip and azimuth measurements when techniques of the described invention are applied.

In more sophisticated form, a location of the dominant mode may be converted in conjunction with its output using the above mentioned techniques to a corresponding dip and azimuth value. In a still more sophisticated technique described later in detail in regard to FIG. 21, displacement combinations which contributed to the dominant mode or clusters or perhaps to lesser modes and therefore have a corresponding location, are retrieved and utilized in well-known techniques to produce dip and azimuth values for each sequence. These values may be output in conventional form such as illustrated in FIG. 22. Since these values benefit from the classification analysis process, improvement in accuracy for these values is significant over the prior art techniques, as illustrated in the comparison provided in FIG. 22. Further, since displacement combinations not corresponding to the dominant mode are not used to produce dip and azimuth values, the number of extraneous dips is reduced, adding to the significance of those which are produced. Still further, since stray displacements are not averaged in with good displacements, the accuracy of the dips produced is improved.

In the case of the type of output illustrated in FIG. 22, the recorder 110 shown in FIG. 1 could be of the conventional X-Y type. However, the recorder 110 may easily serve as an intermediate storage facility in such a process, as for example, as a digital tape recorder of the type previously mentioned. The well-known graphic conversion steps are performed in subsequent processing at a later time. Or, in the case where transmission facilities to remote locations are employed, the required processing and recording of the usual output may be done at a different time and location.

Thus, in review, FIG. 1 illustrates the measurement of geophysical signals at sources, here corresponding to dipmeter pads spaced at different radial positions around the borehole. These measurements are acquired and correlated to produce displacements representative of the position of formation features reflected in the correlation interval. These displacements may be used to determine zones of stable or unstable displacements. More particularly, sequences of displacements are divided into groups of displacement for later analysis. This division may be at points where changes in stability of the displacements is indicated, thereby forming sample groups of displacements corresponding to stable and unstable zones.

Where prior art techniques combine the two best corresponding displacements in each sequence, discarding the extras, the present invention combines all possibly corresponding displacements produced from the round of correlations from each sequence. Corresponding displacements from individual sequences within these zones are combined and classified in the classification system, which in the illustrated case, is oriented to the pads of the dipmeter tool. The analysis of the classified combinations of displacements locates the position of the dominant cluster of combinations and this location also may be used to determine the relative position of the signal features corresponding to the displacements. When the technique is applied to dipmeter signals such a position may be converted to the dip and azimuth of formation characteristics at their intersection with the borehole wall.

Figure 2:
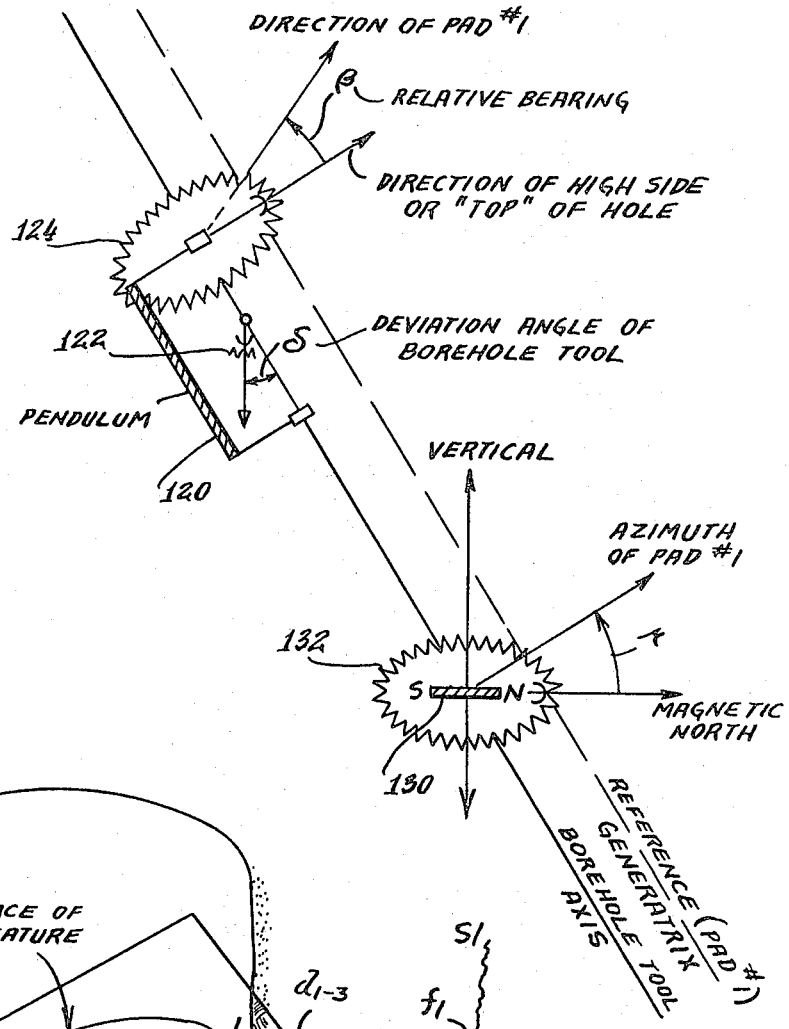
FIG. 2 illustrates how certain references relative to the borehole tool are measured.

Referring now to FIG. 2, a brief description will be given of how certain reference information characterizing the position of the borehole tool and therefore the sources of the signals is measured. Incorporated within the apparatus 18 shown in FIG. 1 is an inclinometer system, schematically illustrated in FIG. 2. The inclinometer system is referenced to one of the signal sources, usually the pad designated as No. 1. The inclinometer system is composed of two related measured systems. One system contains a pendulum 120 suspended in relation to the center line or axis of the borehole tool such that it establishes a vertical plane in which to measure the deviation angle $\delta$ of the borehole tool. This may be done as illustrated in FIG. 2, for example, by measuring with a second pendulum and a potentiometer 122, the angular deviation of the tool axis from this vertical pendulum. This deviation is sometimes known as the drift angle. The first pendulum 120 is also related in a rotational sense to the position of the reference pad. An additional potentiometer shown as 124 in FIG. 2 may be used to measure the rotational angle $\beta$ between the reference pad and pendulum 120 position. This angle $\beta$ is usually measured from the high side or the top of the hole and is known as the relative bearing. It is conventional to measure this angle such that it has a positive sign when measured clockwise from the high side of the hole to pad No. 1.

An additional system incorporates a magnetic compass 130 and another potentiometer 132 such that the potentiometer measurement reflects the angle by which the referenced pad differs from magnetic North as measured by the compass 130. As shown in FIG. 2, this angle $\mu$ corresponds to the azimuth of the number 1 pad. Thus, it may be seen how the position of a reference point on the tool, here shown as pad No. 1, may be related both to magnetic North, as expressed by its azimuth, and to the top of the hole, as expressed by its relative bearing and deviation angle.

It is readily apparent then that any measurement which is referenced to the position of pad No. 1 may be also referenced to the top of the hole or to magnetic North which of course may be converted to geographic North. Still further, it will be apparent how the position of the top of the hole and magnetic North may be referenced to pad No. 1. It is well known how to use these reference measurements. Further details may be obtained, for example, in the aforementioned Moran, et al paper, particularly in the appendix thereof.

Figure 3:
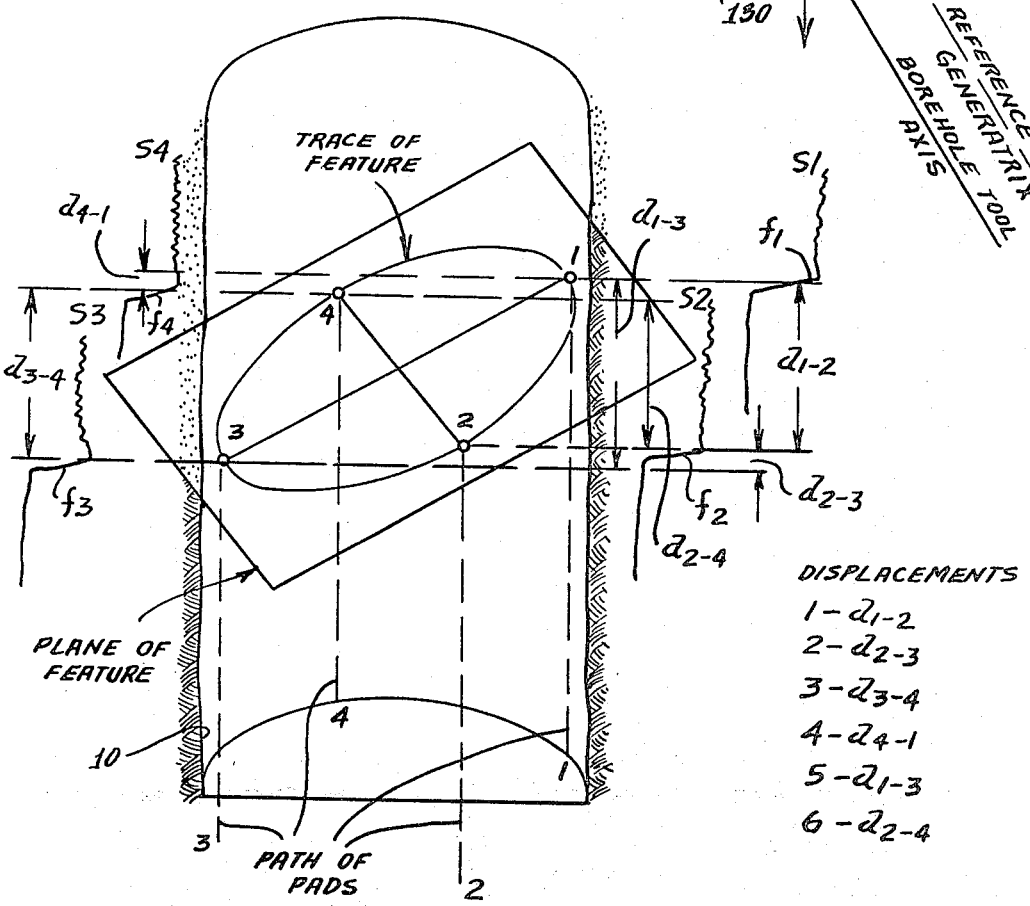
FIG. 3 shows how displacements obtained between similar characteristics on pairs of geophysical signals derived at spaced positions in a borehole are related to the plane of a formation feature intersecting the borehole.

Referring now to FIG. 3, there are illustrated the four pads of the dipmeter tool shown in FIG. 1, designated here as 1, 2, 3 and 4. As the dipmeter tool 18 moves up the borehole 10, the four pads each trace a path on the borehole wall as indicated in FIG. 3 by the dashed vertical lines. These paths will intersect the plane of a formation feature at the borehole wall at the four points indicated by small circles 1 through 4. Further, the nature of the pad suspension system for the dipmeter assures that these paths trace opposite sides of the borehole for each diagonally opposing pair of pads, for example, pad pairs 1 and 3, or 2 and 4.

The signal response for each of the four pads is shown in FIG. 3 as S1 through S4. The change in the character of the signals corresponding to the feature which intersects the borehole is shown as signal features $f_1$ through $f_4$. When the plane of the feature is inclined relative to the borehole as shown in FIG. 3, there will be a displacement between the corresonding features on each signal. As shown, one pad will respond to the feature first as the tool is withdrawn from the borehole, with the opposite pad responding last. In FIG. 3, these pads correspond to Pads 3 and 1, respectively.

The correlation process which, of course, compares the similarity of two signals, may then be used to determine the displacement between the points of intersection of the feature with the paths of the pads along the borehole wall. For example, the correlation of S1 and S2 determines the displacement between Points $f_1$ and $f_2$. As illustrated in FIG. 3, Pad 2 intersected the feature plane at a deeper depth than Pad 1. Thus, the depth of the $f_1$ on S1 is less than the depth of $f_2$ on S2. By convention, the displacement between S1 and S2 is therefore considered to be negative. This is consistent with the notation that the displacement between two signal features equals the depth of the feature on the signal from the first pad minus the depth of the feature on the signal from the second pad. As shown in FIG. 3, the displacement between intersection point for the feature at $f_1$ on S1 and $f_2$ on S2 is designated $d_{1\text{-}2}$ and as shown, is negative, since $f_1$ is above $f_2$. More details as to conventions will be given in regard to FIG. 8A.

Three additional displacements similar to that obtained between the adjacent Pads 1 and 2 may be obtained by correlating S2 with S3, S3 with S4 and S4 with S1. Thus, the four adjacent displacements are designated accordingly, as $d_{1\text{-}2}$, $d_{2\text{-}3}$, $d_{3\text{-}4}$, and $d_{4\text{-}1}$. Two additional displacements may be obtained to complete a full round of displacements for this level or sequence by correlating the signals obtained from diagonally opposing pads. In the case of the four-pad tool illustrated in FIG. 3, these diagonals correspond to $d_{1\text{-}3}$ and $d_{2\text{-}4}$. Thus, for the illustrated four-pad tool, there are six possible displacements which may be obtained by correlating the four signals. There are, of course, other dipmeter tools which may have different numbers of pads, for example, the three-pad tool from which, because of the 120° angular relationship between the pads, no diagonal displacements may be obtained.

It is well known that the position of any three points provide the definition a plane, which in the dipmeter art is expressed as the depth, dip and azimuth of the plane. Of course, in addition to the above described displacements between signal features, the radial distance between the measure points on pads corresponding to these signals, is also needed to define the required three points. In the four pad tool, these radial distances are obtained from the two diameters measured between opposing pads. Thus, any two related displacements and corresponding diameters define the three points and may be used to produce a dip and azimuth value. Even in the three-pad configuration, where they are only three possible displacement determinations, an extra displacement is apparent, and in fact, three different combinations of displacements pairs are possible, providing the redundancy of three different azimuth and dip determinations.

In the illustrated four-arm dipmeter too, where six displacement determinations are possible along with two separate diameter measurements; i.e., along the diagonals 1-3 and 2-4, a multiplicity of combinations exist and, as will be explained later, provide the possibility of up to thirteen different dip and azimuth values. Ideally, all of the above multiplicity of possibilities would yield the same dip and azimuth value. Unfortunately, limitations inherent to the correlation process and to the measurement environment in the borehole provide ample opportunity for one or more of the combinations to be in error. FIGS. 4A and 4B illustrate one type of measurement problem which may occur in deviated boreholes such as commonly occur in offshore drilling.

Referring now to FIG. 4A, there is shown an illustration of the four-pad tool in one possible orientation the tool may take when the borehole is substantially deviated from vertical as illustrated in the corresponding FIG. 4B. In such a situation, the substantial weight of the dipmeter tool tends to collapse the mechanical assembly of the weight supporting diagonal pair of pads. In the illustrated case, these pads are shown as topside Pad 1 and downside Pad 3. In effect, the pad on the downward side of the hole tends to carry a substantial portion of the weight of the tool. This abnormal load may act on the caliper linkage supporting the opposing topside and downside pads to collapse this linkage independent of the linkage of the other pads. The result of such a collapse, even though only slight, is that the pad on the top side of the borehole loses its contact with the borehole wall.

Recall now that the two opposing pad pairs have two corresponding diameter measurements $D_{1-3}$ and $D_{2-4}$ as shown in FIG. 4A. In many cases, the tool collapse condition is indicated by one of these diameters being somewhat less than the other diameter, for example, as shown in FIG. 4A, $D_{1-3}$ is less than $D_{2-4}$. Unfortunately this relationship is not conclusive as indicating the collapsed condition. Further, as boreholes are frequently elliptical, the different measurements may correspond to accurate "diameter" measurements in such cases and in fact all pads are in contact with the wall. Further, as shown in FIG. 4A, neither of the diameter measurements may correspond to the actual diameter $D_e$ even in a circular hole in the substantially deviated hole case.

As shown in FIG. 4B, the pad on the top side of the hole may "float" at a substantial spacing from the borehole wall. Here this spacing is designated as $\Delta D$ and corresponds approximately to the difference between the measured diameter $D_{1-3}$ and the effective diameter of the borehole $D_e$.

Recall now that the electrode arrangement on the dipmeter tool is designed to focus the current emitted from the Ao electrode. Since the resulting current path is substantially normal to the pad face, it will be appreciated then that such focussing may overcome the effect of loss of contact of the floating pad with the borehole wall, as far as at least some of the response to the formation features is concerned. In fact, in well-focussed tools, the ability to overcome substantial pad-to-wall separation is well known and some skilled in the dipmeter art often add a small given distance to the caliper measurement in the belief that the pad responds as if it was located a small distance within the formation. Unfortunately, there is no way to directly measure the effective distance between opposing pads, such as diameter $D_e$.

Further, in the prior dipmeter art, no appreciation is given for the fact that the effective diameter for the floating pad response is not directly related to the diameter corresponding to the caliper measurement. Since the focussed response in effect extends the floating pad to the intersection point of the formation feature with the borehole wall, the correct diameter, in this case, may equal the borehole diameter illustrated as $D_e$ in FIG. 4B.

A serious dip computation error occurs if the pad separation $\Delta D$ is not recognized and considered appropriately. Further, all displacements determined from signals obtained from the displaced or floating pad are effected. As is apparent from FIG. 3, three out of the six displacements normally available from a four-pad tool are so effected. Since the diameter associated with the collapsed caliper and floating pad is also involved in the dip computations as will be explained later, it is possible that three-fourths of the resulting dips may be affected.

For a given feature inclined relative to the borehole the larger the borehole diameter, the greater will be the corresponding displacements. Thus, if a measured diameter which is too small compared to the effective diameter is used, resulting dip will be too high. It will now be appreciated from the foregoing explanation, that the displacements associated with a signal obtained from a floating pad will appear to be exaggerated when compared with the displacements obtained from other pairs of signals. While such exaggerated displacements are indicative of the floating pad situation, they are not unique to this situation.

Referring now to FIG. 5A, there are shown the four signals which may be obtained from the four-pad tool. The signals designated S2, S3 and S4 are very similar and each contain a common feature labeled B, C and D on each of the signals respectively. The signal designted as S1 contains not only this feature, here designted as A, but an additional feature designated as A'. Thus, as illustrated, there is a question as to whether the Feature A or A' corresponds to the unique Features B through D on the other signals. As illustrated in FIG. 5A, unique Features B, C and D accurately and unambiguously define plane B-C-D. However, when Feature A is taken in combination with B and D, plane A-B-D is defined while with Feature A', a different plane, A'-B-D is defined. Still further, when the Features on S1 are taken in conjunction with B and C, two additional planes, A-B-C and A'-B-C are defined and similarly in conjunction with C and D, planes A-C-D and A'-C-D are defined.

FIG. 5B illustrates the correlograms corresponding to the correlations of various pairs of the signals illustrated in FIG. 5A. For example, Correlogram 1-2 represents a function expressing with increasing amplitude, increasing similarity between the two signals, S1 and S2. This function is evaluated as the two signals are displaced relative to one another. As indicated on the displcement axis and consistent with the previously mentioned depth relationship, the displacement would be negative if the corresponding feature on the first signal was above the feature on the second signal. Similarly, the displacement would be zero if the feature occurred at equal depths and positive if the feature occurred at a deeper depth on the first signal than on the second. Thus, for the correlogram labeled 1-2 corresponding to the correlation of S1 with S2, the correspondence of Feature A with Feature B on Signals S1 and S2 respectively is more negative than the possible correspondence with Feature A' on S1 with Feature B.

As is illustrated with the S2 to S3 correlogram, i.e. Correlogram 2-3; where little ambiguity exists that Feature B corresponds to Feature C, a single peak indicated B-C corresponds to the displacement. However, as indicated on each of the correlograms involving Signal 1, where two similar features, A and A' exist, there are two peaks which may more or less resemble each other, at least in amplitude, such that the displacements selected by detecting the maximum amplitude as the best correlogram likeness, might select either the A or A' feature as corresponding to the similar feature on the other signals.

If, as illustrated, for example, the Feature A is the feature which actually corresponds to B, C and D on the other signals, then selecting displacements corresponding to A' would represent a miscorrelation. While it may be apprent to those skilled in this art that A is more similar than A' to Features B, C and D, such mis-correlations do in fact occur and, as is readily apparent from FIG. 5A, lead to displacements which, when combined with other displacements, define a plurality of additional planes. Still further, when they do occur, comparison of the displacements would find some of the displacements were exaggerated as compared to others, and in this sense, ambiguous with the use of this diagnostic to detect the floating pad situation.

The exact nature and shape of the correlogram depends somewhat upon the correlation function selected. Therefore, the correlograms illustrated in FIG. 5B are not necessarily representative. FIGS. 6A through 6E illustrate in a simplified fashion a possibility for a miscorrelation which is considerably less dependent upon the nature of the correlation function and the shape of the resulting correlogram.

Figure 6B:
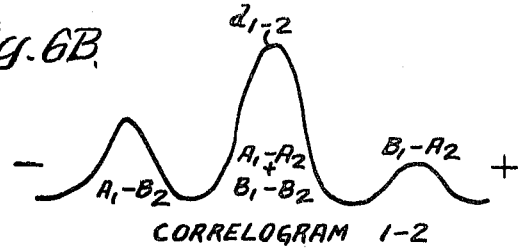
Figure 6C:
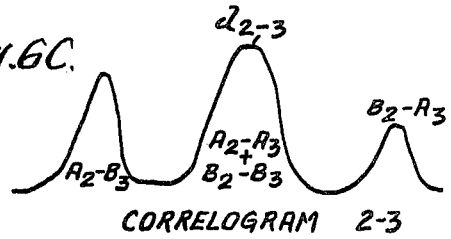
Figure 6A:
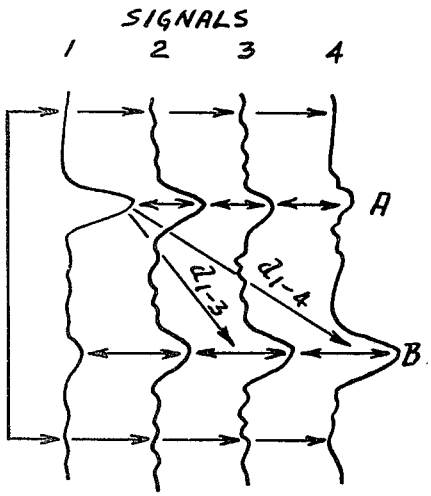
FIG. 6A illustrates additional possibly corresponding displacements between two similar characteristics present on the signal curves in the same correlation interval.

Referring now to FIG. 6A, there is shown the condition where two actual features, A and B, are present in the same correlation interval on Signals 1 through 4. However, in one sector of the hole Feature A is better defined than Feature B, and in the other sector of the hole, the reverse is true. This variation in definition may be real, as for example, the sharpness of a bed boundary varies, or it may be artifically induced by a measurement problem such as the floating pad problem previously described. For simplicity, both Features A and B are illustrated as intersecting the borehole at zero dip; i.e., no inclination relative to the borehole, so that no displacement occurs between the actual corresponding signal features.

Irrespective of the correlation function employed, and as will be appreciated when considering only two of the curves shown in FIG. 6A at a time, the presence of two similar features in the same interval has the distinct possibility of confusing the feature corresponding to A on one signal with the feature corresponding to B on another signal. This is particularly true when the actual corresponding signal feature is suppressed on one or both signals as may occur when these signals were obtained from substantially different sectors of the borehole. In the prior art practice, this may be further complicated by discarding what may be the correct correspondence but, unfortunately, also the poorest quality correlation.

When correlating the Signal 1 with the Signal 2 shown in FIG. 6A, where there is little doubt that A corresponds to A on both signals, and when reinforced by even weak agreement in regard to Feature B, the correlation function produces a distinct peak as shown in FIG. 6B as Correlogram 1-2. Consequently, the displacement $d_{1-2}$ is accurately selected and corresponds to A with A and B with B on both signals. However, as illustrated in this correlogram, there is some evidence that A on Signal 1 could correspond with B on Signal 2 and somewhat less evidence that B on Signal 1 might correspond with A on Signal 2.

When correlating Signals 2 and 3, again the combined effect of A with A and B with B, as illustrated by Correlogram 2-3 in FIG. 6C, produces the correct displacement $d_{2-3}$, but now there is a distinct possibility that A on Signal 2 could be B on Signal 3, as indicated by the somewhat narrower but relatively large peak on the lefthand (−) side of Correlogram 2-3.

Figure 6D:
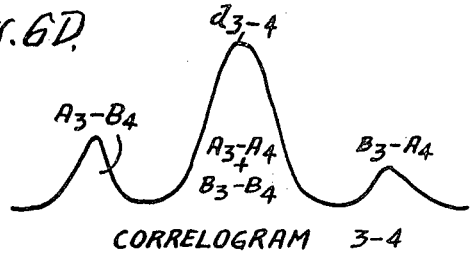

As illustrated in Correlogram 3-4 shown in FIG. 6D, the strong similarity of Feature B on both Signals S3 and S4 along with some similarity for Feature A combine to produce a distinct peak on the correlogram at the correct displacement $d_{3-4}$. Since A on one signal does not resemble B on the other signal, the peaks corresponding to this conflict are not significant. In this case, the correlation function can be said to be dominated by Feature B, with little contribution from Feature A.

Figure 6E:
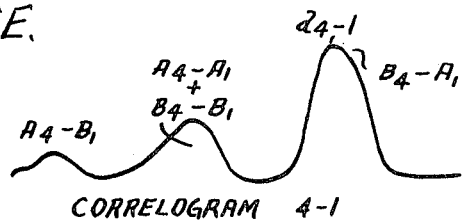

However, as illustrated in FIG. 6E, when correlating Signal 4 with Signal 1, there is the distinct possibility that Feature B on Signal 4 corresponds with Feature A on Signal 1. This is illustrated by the large peak designated as $B_4$-$A_1$ on the correlogram which results in the large positive displacement $d_{4-1}$. This erroneous displacement resulted from the suppression of Feature A on Signal 4 at the same time as Feature B was suppressed on Signal 1.

Figure 6F:
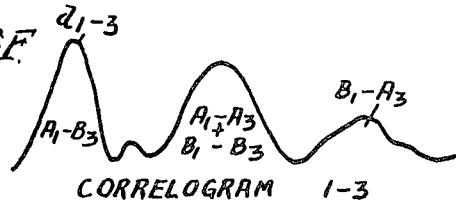
Figure 6G:
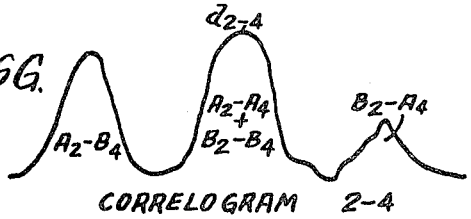

Similarly, in FIGS. 6F and 6G, where the correlations are across the borehole and the signals were derived from opposing pads, a substantial difference may exist in the actual characteristics of the signals. As illustrated in FIG. 6F, there is a strong resemblance between Feature A on Signal 1 and Feature B on Signal 3, resulting in a large negative-displacement peak on correlogram 1-3 and an incorrect displacement $d_{1-3}$ being determined. Of course, there is still a peak but of lesser amplitude corresponding to the combined effects of Features A and B on both signals which does indicate the correct displacement.

As illustrated in FIG. 6G, the correlation between Signal 2 and Signal 4 is also influenced by the strong resemblance of Feature A on Signal 2 with Feature B on Signal 4 because Feature A is suppressed on Signal 4. However, because Feature B is found on both Signals 2 and 4, the correct $d_{2-4}$ displacement is determined from the correlogram, but perhaps only marginally so.

Thus, FIGS. 6A through 6G illustrate how erroneous correlations may result for at least some of the correlations between pairs of signals obtained over the same interval, particularly where both signal intervals include two or more features. The problem is further complicated when conditions tend to change the nature of the signal features in different sectors of the borehole, such as may occur when formation bedding planes intersect the borehole at substantial angles. Here, the possibility exists that the two opposing pads measure the focussed response of the tool to a bedding plane intersecting the borehole at high inclination angles, while the other opposing pads measure the focussed response with little inclination angle, resulting in substantial dis-similarities between adjacent signal pairs. These inclination angles may actually be produced by horizontal formations (of zero dip) which are penetrated by a highly deviated hole and when coupled with the possibility of a floating pad, present a complex analytical problem.

The prior art practice of discarding all but the minimum required three related displacements is of course heavily dependent upon the ability to consistently pick the best three displacements, which usually are taken as those with the largest amplitude peaks (lowest minimums with some correlation functions).

There are other methods of qualifying these best displacements in addition to the above, as will now be described, but as will be later appreciated, none can provide the necessary assurance that these three displacements, and only these three displacements, out of the multiplicity available, correspond to the only possible dip and azimuth measurements for a given sequence.

There are several correlation functions which may be employed in the correlation process and, in general, each produces either a maximum or a minimum characteristic at the displacement position on the correlogram corresponding to the best likeness or similarity between the correlated signals. In addition, there are several methods of assigning a correlation quality factor to the correlogram characteristic which determined the displacement. In practicing the present invention, it is preferred that a quality factor be assigned to each displacement determination. This quality factor may then be used as an enhancement to the analysis procedure used in locating the dominant mode of the classified combination of displacements as will be explained later.

However, in correlation methods where a quality factor is not available, a quality factor or weight of unity may be assigned.

Figure 7A:
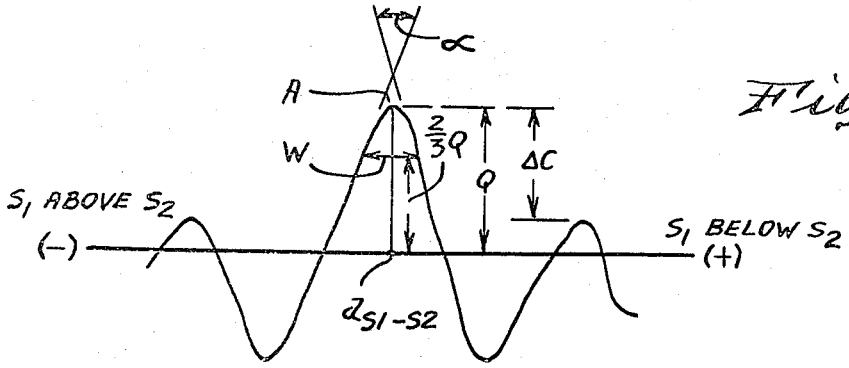
FIG. 7A illustrates the general characteristics of a correlogram in terms of correlation quality and displacement determination.

Referring now to FIG. 7A, there is shown the general charcteristics of a correlogram derived from a well-known normalized correlation technique. This technique produces a correlation coefficient of unity when identical signals are correlated, which of course represent the maximum possible quality factor which can be expected. Where no similar features are present on the signals, the correlation coefficient of zero would be expected and where the features are equal but opposite, a correlation coefficient of minus one would be expected.

It would be obvious from examining such a correlogram, as shown in FIG. 7A, that the best correlation corresponds to the maximum point A and in fact, the value of A may be used as the quality factor. The peak value of the correlogram could also be measured from some base line, such as the distance indicated as Q, and used as the quality factor. The peak value could also be measured relative to the next highest peak as indiated in FIG. 7A by $\Delta C$ and used as a quality factor. Still further, and as is common in statistical distribution studies, the width W of the correlogram peak at some fraction of its total height, for example, at two-thirds Q, could be used as a quality factor. Still further, since as previously mentioned, the shape of the correlogram peak in regard to its sharpness may be significant, the angle $\alpha$ indicated in FIG. 7A which may be defined by the slope of the two sides of the peak could be used as the quality factor. In any case, it is preferred that some representation of the correlation function be used as a quality factor which allows the distinction between good correlations and bad correlations.

As previously discussed in regard to the use of overlapping correlation intervals, it is significant to note the characteristics of correlograms obtained between successive correlations of the same two signals, particularly since the nature of the correlogram for successive correlations is implined in the stability of the displacements determined therefrom.

When a single feature or a set of features having the same displacement relationship are present on both correlated signals, a large and distinctive correlogram is produced as previously described in regard to FIG. 6B. From this correlogram feature, an accurate displacement may easily be determined. For the next sequence, the correlation process is repeated for the same two signals over a different interval which, in addition to the previous features, may contain additional signal features which may or may not correspond. If the same distinctive peak and the same displacement determination result for this sequence, the corresponding features present in both correlation intervals are dominant over the new features present in the subsequent interval. Thus, if substantially the same displacement is determined in two sequential correlations over different but overlapping intervals, it implies that at least one dominant signal characteristic is present on both signals in the interval common to both correlations. Thus, a sequence of substantially stable displacements determined between two signals in a correlation process which uses substantially overlapping correlation intervals implies that the stable displacements correspond to dominant features present on both signals, rather than to less significant features present on one or the other signal which temporarily give rise to what might even be regarded as a good quality correlation.

Figure 7B:
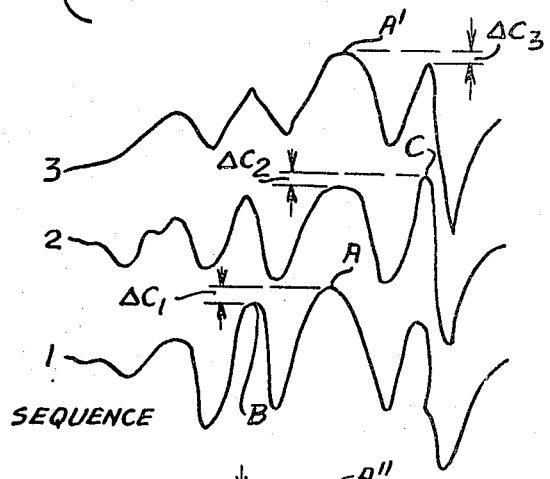
FIGS. 7B and 7C illustrate how spurious peaks in a correlogram may cause temporary changes in what otherwise might be an essentially contiguous sequence of stable displacements.

FIG. 7B illustrates one type of problem present in such sequence of displacement determinations. Shown are three correlograms obtained from adjacent overlapping correlation intervals on the same two signals which both contain at least one common feature within the interval. In Sequence 1, a large, relatively smooth peak is shown with the maximum value indicated at A which corresponds to the correct displacement. However, to the left or negative displacement side of this peak, is another peak B having a maximum value which is shown $\Delta C_1$ less than A. Thus, the correct displacement at A may be only marginally distinguished from the erroneous displacement at B.

In the next correlogram for Sequence 2 in FIG. 7B, the large smooth peak is still present at the same displacement. However, the large peak was not selected as indicative of the displacement because a relatively sharp but larger peak C was the maximum in this correlogram. Subsequently, in Sequence 3, this sharp peak is no longer the maximum, resulting in a displacement determination at A' which substantially is the same as the displacement determined in Sequence 1.

Thus, FIG. 7B illustrates a temporary departure as, for example, for one sequence, of a displacement determination from the displacement values determined from previous and following sequences. Had it not been for the clearly erroneous displacement caused by a temporary sharp, high amplitude peak in Sequence 2, an essentially continuous sequence of substantially stable displacements would have been determined. It should also be realized that without the benefit of the overlapping correlations from Sequences 1 and 3, the displacement found in Sequence 2 could not by itself be judged as erroneous.

Figure 7C:
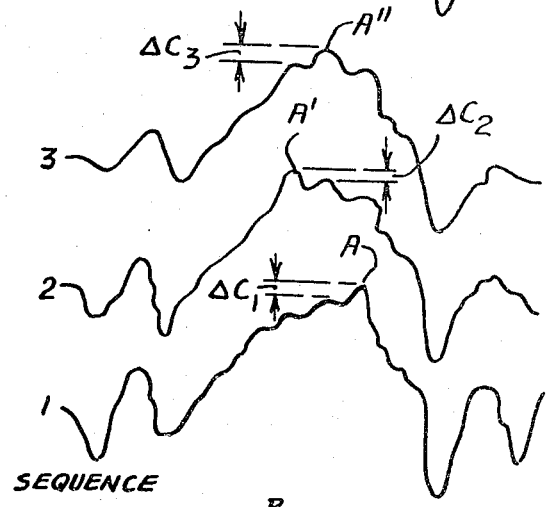

FIG. 7C illustrates yet another problem in the use of correlograms. Here, an additional sequence of three correlograms obtained between the same two signals indicates a large peak which is well above the amplitude of any other peaks in each correlogram, but because of the lack of a unique top, results in a sequence of displacements which vary somewhat but this variation is much less than the differences in displacements that would result from picking different peaks in a sequence of correlograms, such as illustrated in FIG. 7B.

FIG. 7C is typical of a correlation interval containing a number of corresponding features which vary in thickness or width. This lack of resolution is usually characterized in the correlogram by the presence of a number of secondary peaks superimposed on the general peak. In such a case, each displacement in the sequence differs only slightly from its adjacent sequence and the actual displacement probably corresponds to the average of the individual displacements determined from a sequence of such correlograms.

Another variation of the type of problem illustrated in FIG. 7C but which is not illustrated herein is where a true slow change occurs in the actual displacement relationship between a series of features. In this case, the displacement determined will be found to also vary from sequence to sequence. The variation will usually be about the same degree and the same direction between each sequence. In such a case, there is nothing inaccurate about each displacement and such a sequence of displacements would be considered as stable, each displacement affirming its neighbors in the sequence.

It should be noted that such slowly changing displacements may also be created by a dipmeter tool which is rotating as it is being moved through the borehole.

Figure 7D:
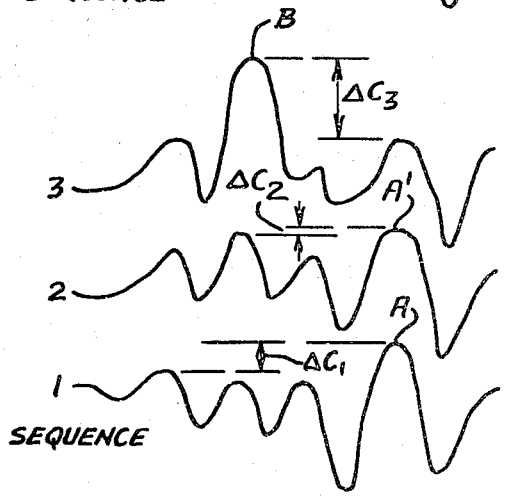
FIG. 7D illustrates how a valid change in the correlograms and displacements corresponding to a new formation dip may result in a break in the continuity of substantially stable displacements.

FIG. 7D illustrates another valid characteristic in a sequence of correlograms. In Sequence 1, a distinctive peak results in a displacement determination at A which is repeated at substantially the displacement A' in Sequence 2. Then, in Sequence 3, a new but equally distinct peak results in a displacement determination at Point B. An examination of the sequence of correlograms usually finds in such cases that the peak corresponding to A in Sequence 1 and Sequence 2 is still somewhat present in Sequence 3. Similarly, the peak corresponding to B in Sequence 3 was present in the previous sequences also but to a lesser extent. This case illustrates, for example, the transition between two geological formations which actually have different dips corresponding to displacement A and displacement B, respectively. In such cases, these displacements should be considered separately in any subsequent analysis.

From the foregoing, it will be seen that much can be learned about the nature of the correlograms themselves by utilizing the variation in displacements determined from sequences of substantially overlapping correlograms. Therefore, it is not essential in this invention to be able to examine the correlograms themselves. Thus, by examining displacements which may have been previously obtained from a separate process which did not retain any correlogram information other than the displacement and perhaps a correlation quality factor, much can be learned about the now unavilable correlograms. More particularly, a comparison of displacements determined in successive correlations between the same two signals may be used to separate displacements into groups for further analysis. When the separation of the groups is placed at the point where a substantial and permanent change in the displacements occurs, the displacement grouping has a high probability of corresponding to the actual formations themselves.

As previously mentioned, the use of a correlation process is well known for determining displacements for a given interval. However, a brief review of some conventions will be provided to aid in explaining some features of this invention.

FIG. 8A illustrates some conventions well known in the dipmeter art which will also be used here in the definition and processing of the displacements. In review, and by way of example, the case of the four-pad dipmeter is again illustrated. Recall now that the four electrodes on the dipmeter tool are maintained in a common plane normal to the axis of the borehole tool. As illustrated, this plane is shown as the electrode plane and contains electrodes 1, 2, 3 and 4 which are indicated by the solid circles in FIG. 8A. Also recall that these electrodes are maintained in a fixed relationship in this plane such that each pair of opposing electrodes, such as 1 and 3 or 2 and 4, is each equally distant from the axis of the borehole tool.

It is convenient to regard depth as being measured from this electrode plane along the axis of the borehole tool and increasing downward as indicated in FIG. 8A by the Z axis. Thus, the distance between the actual electrode in the electrode plane and the point at which the electrode crosses the intersection of a dip plane may be measured in terms of depth along this Z axis. This point of intersection with the dip plane is illustrated as an open circle in FIG. 8A. The distance from the actual electrode to this intersection point is illustrated as $z_n$ where n corresponds to the electrode number.

For example, the distance between the number 1 electrode on Pad 1 and the point where it will normally respond to the dip plane is designated as $z_1$. As illustrated in FIG. 8A, distances from the electrode plane to the point of intersection with the dip plane for each electrode are designated as $z_1$ through $z_4$. These distances are related to the displacements determined between any two electrodes by the illustrated algebraic relationships. For example, $d_{1\text{-}2}=z_1-z_2$. More particularly, the use of the electrode reference plane allows understanding of how displacements between different electrode pairs may be conveniently related in a general way.

If, for example, and as can readily be seen in FIG. 8A:

$$d_{1\text{-}2}=z_1-z_2 \qquad \text{(Eq. 1);}$$

and $$d_{2\text{-}3}=z_2-z_3 \qquad \text{(Eq. 2);}$$

then it will follow that $$d_{1\text{-}3}=z_1-z_3=(z_1-z_2)+(z_2-z_3)=d_{1\text{-}2}+d_{2\text{-}3} \qquad \text{(Eq. 3).}$$

Thus, by assuming each z distance is measured between the same two planes, displacements determined from adjacent pairs may be used to compute additional displacements, as for example, the displacement $d_{1\text{-}3}$ above. It is not necessary with the above concept that electrodes 1 and 3 need be, as illustrated, opposing electrodes. Further, the electrode plane merely serves as an intermediate reference plane in the displacement computation.

Figure 8B:
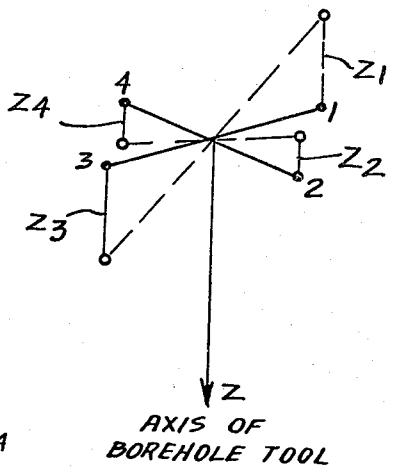
FIG. 8B illustrates in relation to diagonal pairs of electrodes the displacement distances depicted in FIG. 8A.
Figure 8C:
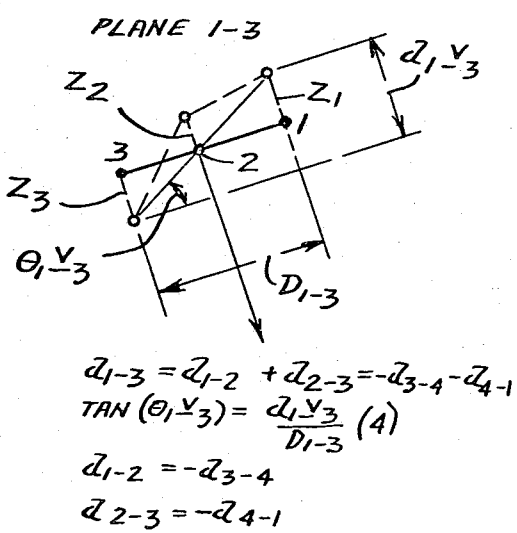
FIG. 8C illustrates how these distances or displacements appear in a plane parallel to the borehole axis and passing through diagonal electrodes 1 and 3.

The above-described concept is illustrated graphically in FIG. 8B where, as in FIG. 8A, both the electrodes and their intersection points with the dip plane are represented in relation to the Z axis. Here, the above-mentioned z distances are again indicated. Consider now the distances $z_1$ and $z_3$ as they would be viewed from a position looking along the line drawn between electrodes 2 and 4. Such a view is shown in FIG. 8C and may be considered as taken in the 1-3 electrode plane which of course also includes the Z axis. Electrodes 2 and 4 of course are superimposed in such a view, while electrodes 1 and 3 appear on a common line drawn through these superimposed electrodes and normal to the tool axis.

The distance $z_1$ appears in FIG. 8C as measured from the plane containing the actual electrodes at the point corresponding to electrode 1 and along the path of the electrode to its intersection point with the dip plane. Similarly, the distance $z_3$ appears in the corresponding relationship with electrode 3 while distance $z_2$ is superimposed on the tool axis. It is clear from this diagram that the position of intersection point for electrode 2 with the dip plane merely serves as an intermediate turning point or benchmark in determining the distance between the intersection points for electrodes 1 and 3. It is also apparent that with this distance a displacement between the intersection points for electrodes 1 and 3 may be computed from Eq. 3 described above. However, as previously mentioned, this relationship assumes a planar surface for the dip plane. Therefore, the displacement computed as above may not correspond to the displacement determined by correlating the signals from electrodes 1 and 3. Consequently, displacements which are computed from such algebraic relationships between actual displacements, are regarded as virtual displacements and denoted herein by the symbol (v), as for example, $d_{1\text{-}3}^{v}$ in FIG. 8C.

As apparent dip angle, e, appears, again assuming the planar dip requirement, between the line connecting the intersection points for the non-adjacent electrodes and a line normal to the tool axis. For the 1-3 electrode intersection line shown in FIG. 8C, this angle is designated as $e_{1\text{-}3}^{v}$ and may be computed from the virtual displacement $d_{1\text{-}3}^{v}$ when taken with the $D_{1\text{-}3}$ diameter measurement. The tangent of this apparent dip angle may be found from:

$$\tan(\theta_{1\text{-}3}^{v}) - d_{1\text{-}3}^{v}/D_{1\text{-}3} \qquad \text{(Eq. 4)}$$

The above relationships may also be derived using the distance $z_4$ which is not shown in FIG. 8C. However, because the displacement convention reverses the sign for symmetrically opposing displacements, as for example $d_{1\text{-}2} = -d_{3\text{-}4}$ and $d_{2\text{-}3} = -d_{4\text{-}1}$, the virtual displacement equation becomes $$d_{1\text{-}3}^{v} = (-d_{3\text{-}4} - d_{4\text{-}1}).$$

Figure 8D:
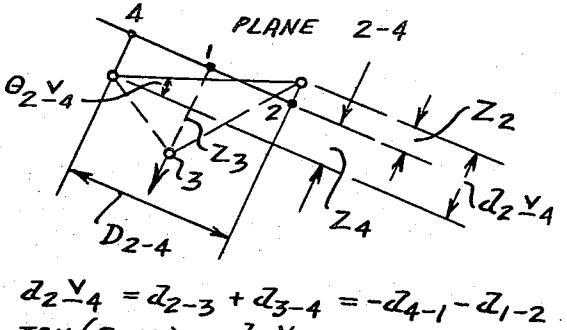
FIG. 8D illustrates, like FIG. 8C, distances or displacements but now in the plane passing through diagonal electrodes 2 and 4.

Similarly, FIG. 8D shows the same conditions in the plane common to electrodes 2 and 4. By a corresponding analogy, it can be seen that the distance $z_3$ now appears along the tool axis and also serves as an intermediate point between $z_2$ and $z_4$ which allows the combining of adjacent displacements $d_{2\text{-}3}$ and $d_{3\text{-}4}$ to form an equation corresponding to Eq. 3 above. This equation is:

$$d_{2\text{-}4}^{v} = z_2 - z_4 = (z_2 - z_3) + (z_3 - z_4) = d_{2\text{-}3} + d_{3\text{-}4} \qquad \text{(Eq. 3A)}$$

Again, an apparent dip angle $e_{2\text{-}4}^{v}$ appears between the line connecting the non-adjacent electrode intersection points and the line normal to the tool axis and may be found by an equivalent tangent relationship:

$$\tan(\theta_{2\text{-}4}^{v}) = d_{2\text{-}4}^{v}/D_{2\text{-}4} \qquad \text{(Eq. 5).}$$

Here the symmetrically opposing displacements also provide an alternate expression for the 2-4 virtual displacement:

$$d_{2\text{-}4}^{v} = -d_{4\text{-}1} - d_{1\text{-}2}$$

It should now be apparent that through the use of such virtual displacements, perhaps even incorporating some of the symmetrically opposing displacements, virtual substitutes may be computed for cases where the actual displacements are missing or in doubt for use in comparison with the actual displacements. Further, by choosing orthogonal pairs (those at 90 degrees to each other) for such virtual displacements, such as those corresponding to the $D_{1\text{-}3}$ and $D_{2\text{-}4}$ diameters, standardized processing of displacements becomes possible because the actual displacements, wich may not always be available, can be computed when required.

It should be realized at this point that this invention and the above concepts apply not only to the illustrated four-electrode tool but also to dipmeter tools with only three electrodes and to tools with more than four electrodes. This concept of computing virtual displacements from combinations of two or more adjacent displacements applies in general to any array of electrodes or transducers which may be geometrically related, as for example, by assuming displacements measured between them correspond to the same planar feature. These computed virtual displacements also should not be confused with the coincidence that they correspond to actual possible diagonals as is the case in the four-pad tool used to illustrate the invention. Thus, virtual displacements, and in fact, orthogonal pairs of virtual displacements, may be computed from arrays with either an even or odd number of electrodes as long as their position relative to each other is known. The value of such pairs of orthogonal displacements, be they real or virtual, in processing and analyzing combinations of displacements will be further appreciated from the following figures.

Refer now to FIG. 9A in which there is illustrated four points indicated by the numbers 1 through 4 between which two orthogonal displacements may be determined. As was mentioned in regard to the previous FIGS. 8A through 8C, it will be appreciated that the displacements between the adjacent electrodes may be used to compute these orthogonal displacements, here shown as 1-3 and 2-4. Of course, the actual displacements may be determined by correlating the signals obtained from the opposing pairs of electrodes, but for simplicity in the following explanations, only displacements determined between adjacent electrodes will be discussed.

While it is admitted that the surfaces of geological formations may not in fact be planar, the plane serves as a useful reference for testing the relationships between two or more displacements. FIG. 9A illustrates the perfect case where all of the six displacements determined between signals derived from four illustrated points correspond to a perfect plane. In such a case, all displacements between each pair of signals indicate that the correlation process is dominated by a common feature and that this feature corresponds to a plane.

Two tests may be used to illustrate the above common feature and planar characteristics. These tests are the closure and planarity tests. The closure test is a common practice in surveying and simply requires, as indicated by its name, that the given traverse must close. In displacement form, this requirement simply means that the sum of all of the displacements in any continuous traverse which starts with a given electrode and returns to this electrode must equal zero. For the illustrated four-pad tool and for the traverse around the adjacent electrodes shown in FIG. 9A, this requirement may be expressed as:

$$d_{1\text{-}2} + d_{2\text{-}3} + d_{3\text{-}4} + d_{4\text{-}1} = 0 \qquad \text{(Eq. 6)}$$

When the sum does not equal zero, this sum is usually termed the closure error EC.

The lack of closure error EC essentially indicates that the same signal features controlled all the correlations from which the displacements were determined. Recalling FIG. 5A where two features A and A′ were present on Signal 1, it should be realized that displacements corresponding to traverse A-B-C-D-A would close, as well as traverse A′-B-C-D-A′ would close. If, however, the correlation between S1 and S2 was controlled by A because Feature B more resembled A and the correlation between S4 and S1 was controlled by A′ because Feature B more resembled A′ such that the complete traverse corresponded to A-B-C-D-A′, a closure error corresponding to A-A′ would result. The fact that this traverse would not close reflects the fact that two different features, here A and A′, were involved, and of course, in such cases planarity has no meaning.

Referring now to FIG. 9B, there is illustrated the effect of a closure error EC. Here, in regard to Point 3, a gap equal to EC appears along one of the diagonals here illustrated as the 1-3 diagonal with the closure error appearing between Points 3 and 3′. However, it will be appreciated that there is no way of fixing the exact location of the closure error. Of course, if the closure error cannot be assigned to one of the displacements, none of the displacements may be used with assurance to determine even one plane and in effect, planarity is undefined.

When four or more displacements are obtainable, as for example, in the illustrated four-pad tool, and these displacements indicate good closure, it is then possible to test for planarity.

The planarity test may be expressed in a number of ways. However, it is convenient to use the expression that reflects the expectation that the opposing displacements between the two orthogonal diameters should be equal and opposite, such as shown in FIG. 9A. Recalling the previously established conventions in regard to the sign for the displacements, this expression may be formulated as:

$$d_{1\text{-}2}-d_{2\text{-}3}+d_{3\text{-}4}-d_{4\text{-}1}=0 \qquad \text{(Eq. 7)}$$

which, when not equal to zero, may be regarded as the planarity error EP.

If, however, non-planarity is indicated, several possible planes may be considered. For example, as illustrated in FIG. 9C, the non-planarity error may be explained by hinging the surface along the 1-3 diagonal and dividing the surface into two planes, P1 and P2, using displacements $d_{1\text{-}2}$ and $d_{2\text{-}3}$ for P1 and $d_{3\text{-}4}$ and $d_{4\text{-}1}$ for P2. However, as illustrated in FIG. 9D, the non-planar surface could also be hinged along the 2-4 diagonal, defining P3 using displacements $d_{2\text{-}3}$ and $d_{3\text{-}4}$ and P4, using displacements $d_{4\text{-}1}$ and $d_{1\text{-}2}$.

The above four planes were determined from the four adjacent displacements and may be regarded as forming a tetrahedron as shown in FIG. 9E. Here, planes P1 through P4 form a closed volume. Planes P1 and P2 are hidden from view. The various displacements are also indicated. As indicated by the dimensions relating adjacent and diagonal displacements, it is apparent that in the four-plane tetrahedron shown in FIG. 9E that the sum of the two adjacent displacements equals the actual corresponding diagonal displacements. However, this need not be the case, and as shown in FIG. 9F, when the actual diagonals are considered, each diagonal doubles the number of planes, therefore producing four additional planes with diagonal 1-3 and four additional planes with diagonal 2-4. Thus, twelve possible planes may be found when all six actual displacements are available but only eight may be found when one displacement is missing, as for example, when the correlation quality is too poor to be acceptable. It should be understood that the equivalent virtual displacement may be computed and used in place of the actual diagonal displacement, and still further, pairs of virtual displacements may be used to define the equivalent twelve planes as illustrated in Table I. Where both actual diagonal displacements are available, these may also be used to compute a thirteenth plane.

Referring now to Table I, the table illustrates for the previously described cases, how any two related displacements may be combined to produce an equivalent pair of diagonal displacements. Here it is convenient to compute the orthogonal displacements in the illustrated four-pad case along the 1-3 and 2-4 diameters. By related displacements, it is meant that the displacements are related by having one curve in common and for the four-curve tool, since only two related displacements are required which utilize only three of the four curves, one curve may be ignored in each case.

Referring to Case 1 of Table I, for example, if the known related displacements correspond to $d_{4\text{-}1}$ and $d_{1\text{-}2}$, here related through common curve one, the information obtained from PAD 3 is not required, as indicated by $(\bar{3})$ notation in the table. The orthogonal displacements along the 1-3 diagonal and along the 2-4 diagonal may be computed from the relationship indicated in the Table, as was previously described in regard to FIGS. 8C and 8D, respectively. It will be shown that these relationships may also be derived by extending the algebraic subtraction process indicated in FIG. 8A while including the relationships derived from FIGS. 8C and 8D for the virtual displacements.

Consider now, for example, Case 6, where no information from Curve 4 is known and only $d_{2\text{-}3}$ and $d_{1\text{-}3}$ are to be used. Here, $d_{1\text{-}3}$ may be used directly for the virtual displacement $d_{1\text{-}3}{}^{v}$ indicated in the table, but the virtual displacement corresponding to the diameter 2-4 must be computed from relationships involving only $d_{2\text{-}3}$ and $d_{1\text{-}3}$. As an example of the above algebra, consider now how these latter relationships are derived.

From FIG. 8A, it can be seen that the difference $(d_{1\text{-}3}-d_{2\text{-}3})$ corresponds to $d_{1\text{-}2}$. Further, from inspection of FIG. 8C, which imposes a condition of planarity and therefore symmetry between opposing displacements, it can be seen that $d_{3\text{-}4}=-d_{1\text{-}2}$ and therefore, the relationship needed to compute $d_{2\text{-}4}{}^{v}$ from $d_{2\text{-}3}+d_{3\text{-}4}$ (Eq. 3A) is completed by substituting $-(d_{1\text{-}2})=-(d_{1\text{-}3}-d_{2\text{-}3})$ for $d_{3\text{-}4}$ which yields $d_{2\text{-}4}{}^{v}=d_{2\text{-}3}-(d_{1\text{-}3}-d_{2\text{-}3})=2d_{2\text{-}3}-d_{1\text{-}3}$ as shown in Table II for Case 6.

Similar substitutions using the planarity and symmetry assumptions lead to the completion of Table I. It should be noted, however, that different tables would be necessary for dipmeter tools involving different numbers and arrangements of electrodes and corresponding diameter measurements.

Recalling that FIGS. 8C and 8D illustrated how orthogonal virtual displacements may be computed in the 1-3 and 2-4 diagonal planes. Then by combing a virtual displacement with the corresponding diameter, a virtual tangent or apparent dip angle in the diagonal plane may be computed using Equations 4 and 5 which correspond to 1-3 and 2-4 diagonal planes. Further, Table I sets forth many additional combinations of related displacements which may be used to derive many sets of pairs of orthogonal displacements, some real, some virtual. When combined with their corresponding diameters as per Equations 4 and 5, these displacements provide a plurality of virtual tangents.

Figures 13A, 13B:
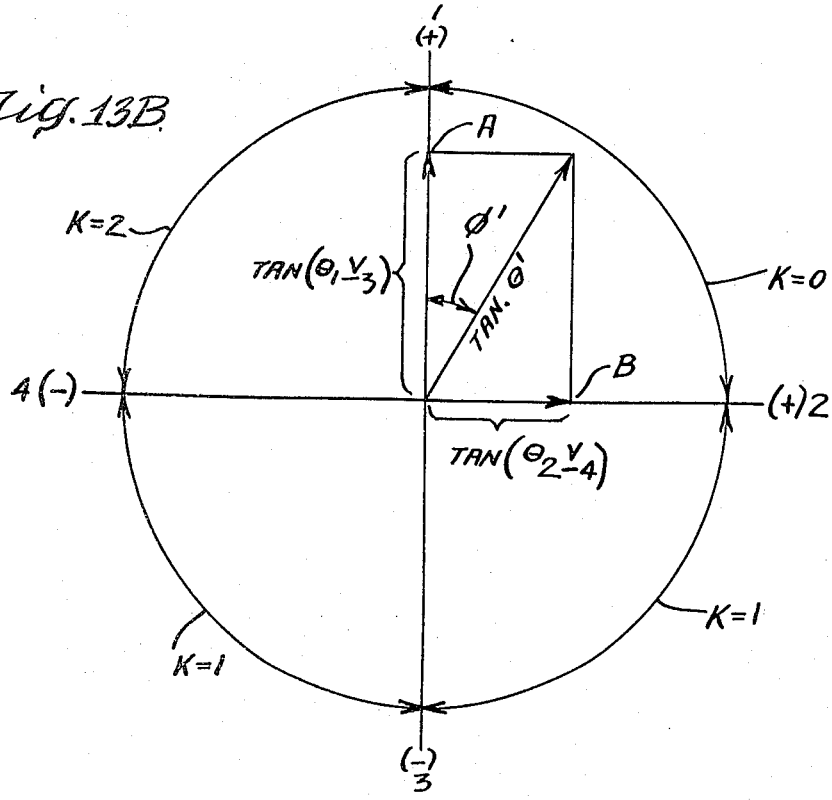
FIG. 13A shows a sequence of displacements obtained from correlations between various pairs of four signals and illustrates zones containing sequences of displacements indicated to be stable for various possible combinations of displacements.
FIG. 13B illustrates how diagonal displacements and their corresponding diameters can be combined and resolved as tangent vectors.

Refer now to FIG. 13B, where it will be illustrated how these virtual tangents, computed as above, may be combined to produce an apparent dip $\theta'$ and corresponding azimuth $\phi'$ which, as illustrated, are referenced to electrode No. 1 in the electrode plane. When the pair of virtual tangents, which of course are merely orthogonal displacement to diameter ratios, are treated simply as vector distances A and B along a corresponding pair of orthogonal axes, here shown along 1-3 and 2-4 diameters, the derivation of Equations 8 and 9 becomes apparent. The tangent of the dip angle $\theta'$ is equal to the resultant of the two virtual tangent vectors A and B, and can be found by taking the square root of the sum of the squares of these vectors as illustrated as Equation (8) shown in FIG. 13B. In a more abbreviated form, Eq. (8) may be written as:

$$\tan(\theta') = \sqrt{A^2 + B^2} \qquad \text{(Eq. 8A)}$$

where A and B are the results of Equations (4) and (5), respectively, which are also shown in FIGS. 8C and 8D.

The apparent azimuth $\phi'$ is found as the tangent of the angle between this resultant vector and Electrode 1 axis, since this is the standard reference direction. The tangent of this angle, of course, is given by the usual side-opposite over side-adjacent relationship and here corresponds to BA, or when expressed in terms of the virtual tangents, becomes as Equation (9) as shown in FIG. 13B. Note, however, that some consideration for which quadrant the vector falls in must be considered since the azimuth has the possibility of a range from zero to $2\pi$ radians (0–360 degrees). Thus, a correction term ($K\pi$ or K 180°) is added where K corresponds to zero, one, one and two for the first through fourth quadrants, respectively. The tangent of the apparent azimuth $\phi'$ expressed as radians obtained from Equation (9) may then be converted into degrees if desired.

Referring now to FIG. 10A, there is shown a method of treating apparent dip and azimuth values as a vector projected in a unit sphere. The vector is projected from the origin or center of the unit sphere to a point on the surface of the sphere with the tip of the vector defining a point corresponding to each dip termination. Note that the vectors are projected relative to the position of the pads in the electrode plane of the tool. The 1-3 diameters form the X axis, the 2-4 diameters form the Y axis and define an equatorial electrode plane. The axis of the borehole tool forms the Z axis. X and Y are considered positive towards Pads 1 and 2, respectively, Z increases downward along the tool axis. Azimuth values increase in a clockwise direction about the upwards or negative Z tool axis. The position of a vertical line which indicates the topside of the hole is separated from this tool axis by the deviation angle $\delta$ and from the No. 1 pad axis by the relative bearing $\delta$, which is not shown in FIG. 10A but is shown in FIG. 2.

A given dip and azimuth value may be described in terms of a vector, as shown in FIG. 13B, or as angular relationships in planes parallel to the tool axis and intersecting the orthogonal 1-3 and 2-4 diameters and thus forms a vector which originates at the origin and projects to the three-dimensional surface of the unit sphere. When a number of similar vectors are projected, such as illustrated at $G_1$ of FIG. 10A, a group or cluster of points would appear on the surface of the sphere.

Because the use of such a three-dimensional projection is somewhat inconvenient, it is desirable to transform such projects into two dimensions for most uses. However, it is an important characteristic in the analysis of such groups of vectors to preserve the equal-area statistical attributes of the three-dimensional spherical projection when it is transformed into two dimensions. Expressed in another manner, when a given surface area on the sphere, such as the area dA shown in FIG. 10A is transformed to a two-dimensional area da, the equal-area characteristic should be preserved.

This preservation may be obtained by the transformation formula indicated in FIG. 10A which scales the surface of the upper hemisphere, which has a unit radius R, by one-half to correspond to the area of the circle forming the two-dimensional representation. This transformation is such that the radial distance r from the origin to the two-dimensional projection point of the vector for a dip e may be obtained from:

$$r = R\sqrt{2}\sin(e/2).$$

Thus, if each apparent dip angle e' is transformed according to the above transformation, a group of vectors shown as G1 or G2 on the unit sphere would still project as groups g1' or G2' having the same statistical characteristics on the two-dimensional transformation, thus validating any statistical analysis performed on the two-dimensional transformation.

FIG. 10B shows how the two-dimensional transformed circular surface corresponding to the electrode or pad plane would appear if viewed from the top looking downward. The pads of the illustrated four-pad tool appear clockwise in the order 1, 2, 3 and 4. The position of magnetic North may be indicated as shown by the arrow to North as determined from the measured azimuth of Pad 1. The direction to the top or high side of the hole may be also indicated as determined from a relative bearing of Pad 1. The equal dip lines appear as a concentric circle about the tool axis or origin, with dip increasing in a somewhat non-linear manner according to the transformation formula towards the peripheral edge of the chart. Thus, FIG. 10B represents a grid which in effect might be inscribed on the electrode plane of FIG. 10A.

Figure 11A:
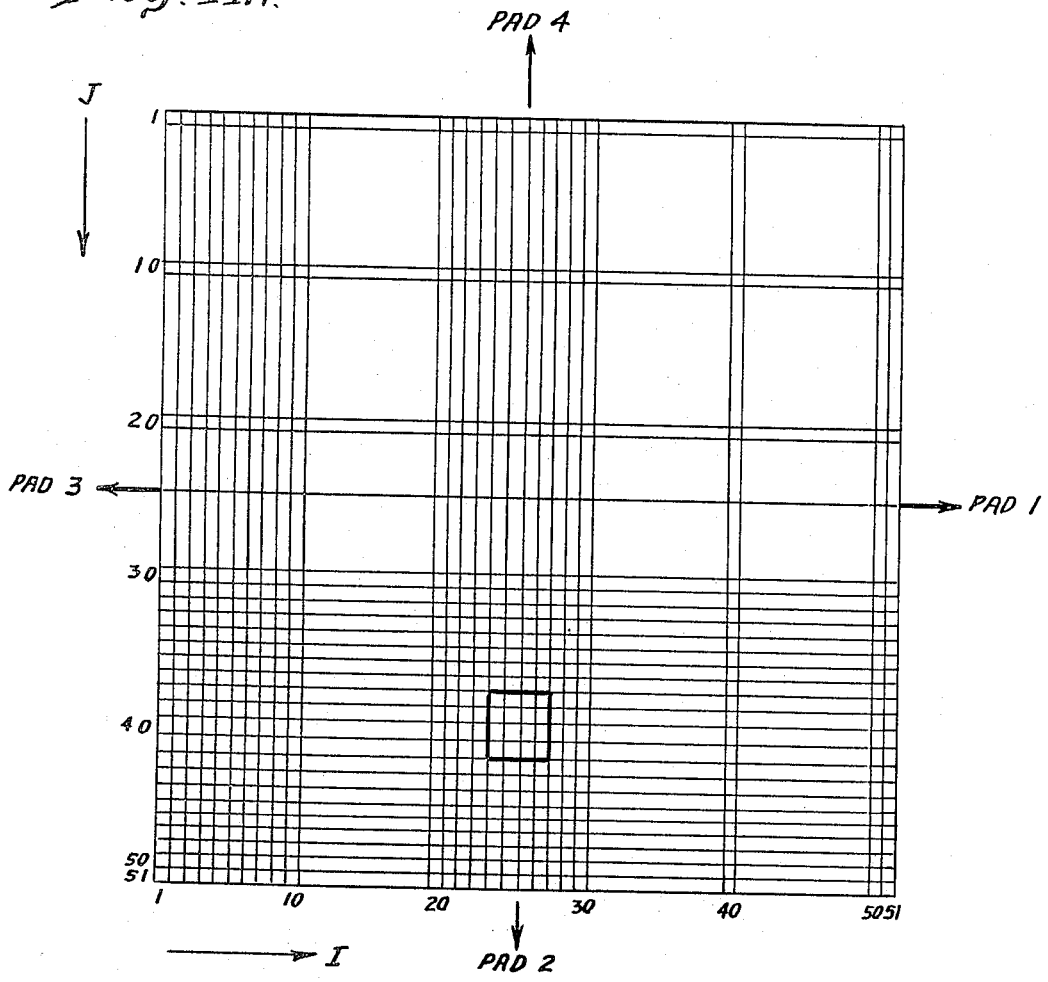
FIG. 11A illustrates the two-dimensional transformation when represented as an array of individual counters oriented to the tool, each counter or cell having a unique address which may, in one form, be considered as indices I and J.

While circular grids such as that depicted in FIG. 10B are useful in manual methods, they are not practical in that form in automatic methods. However, they may be represented as illustrated in FIG. 11A. Here, the grid is again oriented relative to the pads of the illustrated four-pad tool with each of the diameter representations forming central divisions of the four grid sides and each side corresponding to one pad. The two-dimensional representation now forms a grid of equal-angle cells, each cell being between three and four degrees on edge.

As shown, the two-dimensional transformation consists of a matrix of cells with 51 cells on each edge. Each cell has an I and a J index or axis value which may be used as the address of the cell and which may, in fact, correspond to a specific counter or storage address in a memory system. Further, it is not necessary that such a memory system be two-dimensional, but as can be shown, may actually be represented by $51 \times 51$ accumulators or counters each having a single address where that single address is computed from the I and J index values. Also, the matrix may be composed of more or less cells, as for example, $180 \times 180$. However, for purposes of illustration and for use in output in the form of 64 line pages such as shown in FIG. 12, it is convenient to consider the cells of the classification system shown in FIG. 11A as of 51 cells wide in each of the two dimensions.

Figure 11B:
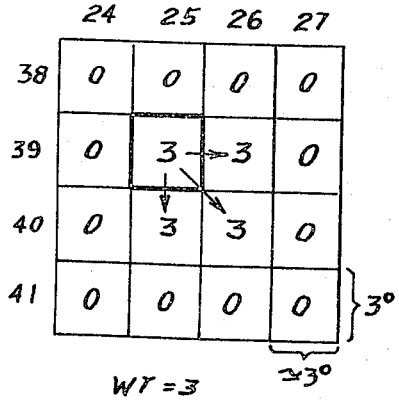
FIGS. 11B and 11C show how a finite vector falling in one counter or cell may be smeared from its particular counter into adjacent counters.

Referring now to FIG. 11B, there is shown an enlarged section of FIG. 11A, corresponding to a range of I indexes from 24 to 27 and a range of J indexes from 38 to 41. As mentioned above and as explained later, each apparent dip and azimuth value or dip vector may be transformed into a given address corresponding to an unique I and J value. Consider now the vector having the I and J address of I=25 and J=39, or:

CELL (25,39).

This cell is shown in FIG. 11B as containing a "3" along with the related cells to the right, below and right below. The origin and meaning of these contents will now be explained.

As previously mentioned, a given displacement may also be assigned a quality factor corresponding to some characteristic of the correlogram peak corresponding to the displacement. When two or more displacements are combined to produce a vector, the factors corresponding to the individual displacements may be averaged or also combined in some manner to produce a weight corresponding to the vector.

Returning to FIG. 11B, consider, as an example, such a weight to be equal to three, for the dip vector having the I=25 and J=39 address. If this vector was the first vector to fall in this area of the classification system for a given zone being classified, the contents of the cells or counters corresponding to this area will initially all contain a value such as the zero value indicated in FIG. 11B. The weight corresponding to the vector to be classified may then be added to this previous cell or counter contents, which in this case brings the contents from zero to three.

However, because of the quantization effect which occurs when dividing such classification systems into unique cells, it is preferred that certain adjacent cells also be influenced by this vector. These cells are considered as smear cells in that the weight of the vector will be smeared into these cells. The selection of the smear cells and weight given to these cells may be done in any manner consistent with the treatment of resulting classifications during the analysis which follows the classification phase.

In the illustrated case, the smeared cells are selected to be the three cells immediately to the right, just below and to the lower right of the cell actually corresponding to the vector. As illustrated, the contents of these cells are also increased the same weight, which in this case, is three. They might, however, be increased by a partial weight, such as one.

Figure 11C:
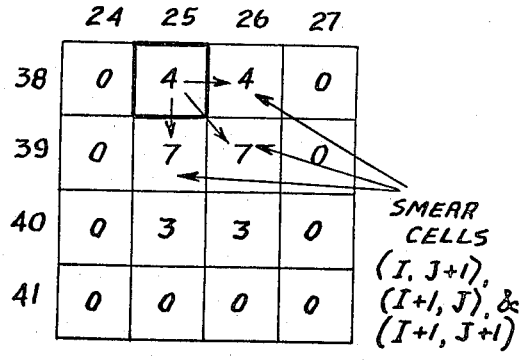

Referring now to FIG. 11C, there is shown this same area of the two-dimensional classification system at a later time. Now, a new vector with a weight of four which corresponds to CELL (25,38) is to be classified. Since the previous contents of this cell or counter was zero, it is now increased to four, as is the smear cell to its right. However, the cells below and to the lower right have been previously increased to three, and are now increased by four to seven. In this manner, both CELL (25,39) and CELL (26,39) are influenced by both of the above classified vectors.

Referring now to FIG. 12, there is shown a graphic representation of the classification system depicted in FIG. 11A. In this form, the contents of each cell is represented by a symbol, here a two digit number corresponding to the contents of the cell. Cells having zero counts are represented by blanks.

Rather than numbers, any set of symbols related to values or ranges of values for the cell contents could be used. The actual graphic output is such that it may be printed in this form on a conventional line printer or a typewriter. These output devices are normally connected to digital computers. Where words in the computer memory also serve as cells or counters in the classification system, the computer retrieves each I cell for a given J value and determines whether the cell contents should be represented in printed form as a blank or as a number corresponding to the actual contents or some scale thereof. Further, when blank cells are found, this print space may be utilized to form a grid to aid in referencing the printed numbers. When all the I cells for a given J value have been formatted and the grid imposed, the corresponding line may then be printed or output in other graphic form. Then the next J value is taken and the above process repeated until the entire I by J classification system has been formatted and output.

FIG. 12, like FIGS. 10A through 11B, is referenced to the pads or signal sources on the tool. Further, the position of magnetic North is designated by the symbol (*N) and the direction to the top of the hole indicated by the letter T on the periphery of the chart, here just above the Pad 1 designation. The intersection point of a vertical vector corresponding to the top of the hole could have been shown at its corresponding position within the chart, but experience has found that, for relatively low apparent dips plotting near the center, the top of the hole so represented may frequently conflict with the dip vector representations.

Recalling the two clusters of vectors, G1 and G2 shown in FIG. 10A, there are shown in FIG. 12 two clusters of points corresponding to such groups. The cluster labeled "dominant cluster" contains the most dip vectors and has one cell near its center with an accumulated weight of 78. A separate minor cluster is also indicated with a maximum cell content of 12.

In the upper right-hand corner of FIG. 12, there are indicated the I and J dimensions of a cluster table. As illustrated in the inset grid, this table includes the area from I=39 to 42 and J=26 to 29. As will be explained later, this area corresponds to the range of the I and J index values for the dominant cluster.

As previously mentioned, the output illustrated in FIG. 12 is of immediate value to those skilled in the dipmeter art, in that it may be interpreted in terms of dip and azimuth values. For example, the position of the dominant cluster is representative of the dip for this zone and the relatively minor cluster can be ignored. Since the dominant cluster is positioned midway along the Pad 1 axis, an apparent dip of about 45° is indicated. This, of course, must be corrected for the hole deviation. Further, since the position of magnetic North is also shown and the angle between magnetic North and the cluster can be readily measured, the apparent azimuth of the cluster corresponding to the dip may easily be obtained. Thus an approximation of the apparent dip and azimuth may be obtained from such an output. Further, since the corresponding I and J index values are also output, as indicated by the cluster table, these index values may be used with the relationships used to classify the apparent dip vectors to accurately define the dip and azimuth values. Thus, such an output is an important feature of the present invention. More details concerning the classification and analysis of the dip vectors will be provided in regard to the description of FIGS. 19 through 21.

In order to understand one aspect of this classification and analysis process, some considerations will now be discussed in regard to FIGS. 13A and 14.

FIG. 14A represents in tabular form the six displacements that may be obtained for each sequence or round of correlations between the four signals derived from the four-pad tool used to illustrate this invention. A series of four sequences are shown and designated here as Sequences 11 through 14. It has been explained how dominant features contained in overlapping correlation intervals of two signals in successive sequences are indicated by substantially stable displacements. This situation is indicated for Sequences 11 and 12 for all six displacements in that any given displacement in the round for Sequence 11 is substantially equal to the same displacement in Sequence 12. However, between Sequences 12 and 13, the displacements determined in the round of correlations between Signals 1 and 2 and Signals 2 and 3 change substantially. This change was defined by the two adjacent displacements $d_{1-2}$ and $d_{2-3}$ which have Curve 2 in common, and terminate the zone designated as Zone A.

Now considering the example illustrated in FIG. 13A and adjacent displacements $d_{3-4}$ and $d_{4-1}$ which have Curve 4 in common, comparison of the same displacement within the round from sequence to sequence finds both these displacements are substantially stable, indicating a second zone designated here as Zone B exists through the illustrated sequence. Similarly, a third zone designated as Zone C may be defined by comparing on a sequence-to-sequence basis the two diagonal displacements.

Recall that dips may be computed from the two adjacent displacements or two diagonal displacements as illustrated in TABLE I corresponding to Case 13. Thus, as illustrated in FIG. 13A, three different boundaries corresponding to changes in successive sequences in the stability of the same adjacent or diagonal pairs of displacements in the round may be located within the illustrated sequence of four levels.

If only successive sequences $d_{1-2}$ and $d_{2-3}$ were examined for stability, only Sequences 11 and 12 would be defined as a stable zone. However, when examining adjacent displacements $d_{3-4}$ and $d_{4-1}$, it becomes quite clear that all the sequences illustrated in FIG. 13A belong to the same stable group and should be classified together for purposes of statistical analysis. It will therefore be appreciated that the determination of zones of displacements for purposes of classification and analysis should consider all possibly corresponding combinations of displacements which are related in any manner that could be used to compute dip values.

As is now apparent from FIG. 13A, particularly when taken in view of TABLE I, there are many possibly corresponding combinations of displacements produced by the normal round of correlations performed at each sequence. For example, thirteen different combinations of displacements which relate or correspond through a common signal are possible for the four-pad tool. Each of these combinations is capable of producing a dip value. Therefore, twelve combinations might possibly be redundant. However, perhaps only one combination, and at this point it is difficult to determine which one, may be the valid combination.

Another form of redundancy is present in sequences of displacements such as shown in FIG. 13A. This is the expectation that if the same pair of corresponding displacements; i.e., related through a common signal, are combined for successive sequences, they should produce similar dip indications, particularly if they are from stable sequences of displacements. It will be recalled that such displacement stability indicates the successive correlations were dominated by the same corresponding features.

FIG. 14 illustrates a table of sequences of displacements which will be processed, beginning at the bottom and proceeding to the top of the table in the sequence indicated as 08 through 22. This table is useful for illustrating an automatic stable zone determination preferably used in the invention to determine which sequences of displacements contain possible corresponding displacements.

For simplicity, FIG. 14 lists on the left-hand side only the four adjacent displacements $d_{1-2}$ through $d_{4-1}$. Sequences of displacements for each such pad pair which are considered to be stable zones are indicated by heavy vertical rectangles and here include two or more displacements. For example, the displacements 2-3 obtained for sequences 8, 9 and 10 are considered to be relatively stable as indicated by their range of −5.46 to −5.68. Similarly, for the adjacent displacements, 3-4, Sequences 8 and 9 are considered stable. Thus, Sequences 8 and 9 contain adjacent sequences of stable displacements which have signal 3 in common.

In the intermediate columns, labeled "SEQ. CNT." or (SC) for sequence count, are listed values established by comparing in successive sequences the same displacement and counting the number of stable sequences found at that sequence level. In this illustration, Sequence 08 is considered to be the initial sequence; therefore, no previous displacements are available and each counter corresponds to an initial count of 0. However, at Sequence 09, the displacements 2-3 and 3-4 found at Sequence 08 are considered stable with those found at Sequence 09, and the corresponding 2-3 and 3-4 counters are incremented to 1, indicating the first occurrence of a stable sequence for the respective signal pairs. At Sequence 10, an additional stable displacement is found for the 2-3 signal pair and this counter is incremented to 2, indicating the occurrence of a successive stable displacement for the second time. However, for the 3-4 pair, the displacement at Sequence 10 is not at all similar to that of Sequence 09, thus indicating displacement instability with the result that the corresponding counter 3-4 is reset at this point to 0.

Beginning at Sequence 15, in FIG. 14, a longer continuous sequence of stable displacements is first found as noted by the sequence counter at Sequence 16 for the 1-2 signal pair. This stable sequence continues as indicated by the continued increase in the sequence counter contents, reaching at Sequence 19, the count of four. Here the additional value "0" separated by an inclined slanted line is also indicated and designates that the initial value "4" indicated above the line has been modified during processing to the value indicated below the line. Thus, at Sequence 19 for sequence counter 1-2, initial counter value of 4 has been reset to 0.

The heavy vertical rectangles indicated in both the displacement columns and the sequence count (SC) columns of FIG. 14 occur in the same positions and indicate for both the displacements and a sequence count columns, zones of stable displacements for one pad pair without any regard to any other pad pair.

However, in order to produce meaningful information, displacements from at least two pad pairs having a common signal are required. In this illustration, since only adjacent pairs are shown meaningful information may be derived only from stable zones including at least two adjacent sequences of stable displacements. Thus, Sequences 8 and 9, having stable displacements for adjacent pairs 2-3 and 3-4 are capable of producing meaningful information. These zones are indicated by heavy rectangles in the intermediate set of columns labeled "MIN. ADJ. CNT." or MAC for minimum adjacent count. Since adjacent sequences involve three curves, the MAC columns are identified by the three curve numbers, as for example, MAC 1-2-3 for corresponding adjacent displacements 1-2 and 2-3. Adjacent stable sequences are present in one "MAC" column or another for all sequences except for Sequences 10 and 20. It will be noted that many stable sequences begin and end with different sequence numbers and thus form overlapping adjacent sequences. It will now be explained how the beginning and end of stable zones are determined.

Consider now Sequence 09 in FIG. 14, the sequence counters (SC) for pairs 2-3 and 3-4 both indicate that a minimum sequence of two stable displacements has occurred; i.e., each counter equals 1. Consider now the corresponding minimum adjacent counter MAC 2-3-4. The setting of this counter may be determined by looking at the corresponding adjacent pair of the sequence counters for the same sequence and noting the minimum value. Thus, for Sequence 09, where the adjacent sequence counters 2-3 and 3-4 both contain a count of 1, the corresponding minimum count is also 1. For the same counters in Sequence 10, the adjacent sequence counters contain 2 and 0, of which the minimum value is 0, thus the corresponding minimum adjacent counter 2-3-4 is set to 0. Also, considering for Sequence 12, adjacent SC's 1-2 and 4-1, respectively contain 2 and 1, the minimum value is 1 and consequently the minimum adjacent counter 4-1-2 is set to 1. In this fashion, for a given sequence, adjacent sequence counters; i.e., those counters corresponding to one common signal, are compared and their minimum value taken as the minimum adjacent count.

As previously noted for FIG. 14 where a given table entry contains two numbers separated by an inclined line, the minimum adjacent counters MAC may also be reset to zero as indicated by this number below the line. For example, see Sequence 13 where MAC 2-3-4 originally contained a value of 1 which subsequently was reset to 0. Such resets occur where two or more adjacent stable sequences are found to overlap one another, as for example, for Sequence 12 where the adjacent stable sequences for the adjacent 4-1-2 signal combination is overlapped by an adjacent stable sequence for the 2-3-4 signal combination. As will be explained later, this overlap will cause the MAC values for Sequence 13 to be reset.

The finally selected zones are indicated in FIG. 14 by the cross-hatched rectangles in the minimum adjacent counter (MAC) columns. Note none of these zones overlap. The process which determines there non-overlapping zones or related stable displacements from sequences of adjacent stable displacements will be described in detail beginning with FIG. 15B.

For now, consider the columns in FIG. 14 which are to the right of the MAC columns. The column labeled "MC-ALL" is a value corresponding to the maximum count occurring in all of the minimum adjacent counters in a given sequence. For example, the MC value at Sequence 08 is 0 since all of the minimum adjacent counters for that sequence are also 0. However, for Sequence 09, the MAC for signal or curve combination 2-3-4 contains a 1, while all other counters for this sequence are 0. Therefore, the maximum count is 1 and MC is set to this value. For Sequence 18, the MAC for the combination 4-1-2 contains a count of 3 which exceeds all other counters. Consequently, MC for Sequence 18 is set to 3. Again, as for example at Sequence 13, subsequent processing may require re-setting of MC, usually to 0 and in FIG. 14 such a reset from the original value is again indicated by the inclined line. This subsequent processing and the use of the remaining columns in FIG. 14 will be explained in detail in regard to a step-by-step explanation of the stable zone selection process. However, some preliminary steps will be now considered.

FIGS. 15A through FIG. 21 illustrate in flow chart form the steps in the process which may be readily implemented by programming a general purpose digital computer to perform the illustrated steps in the indicated order.

Figure 15A:
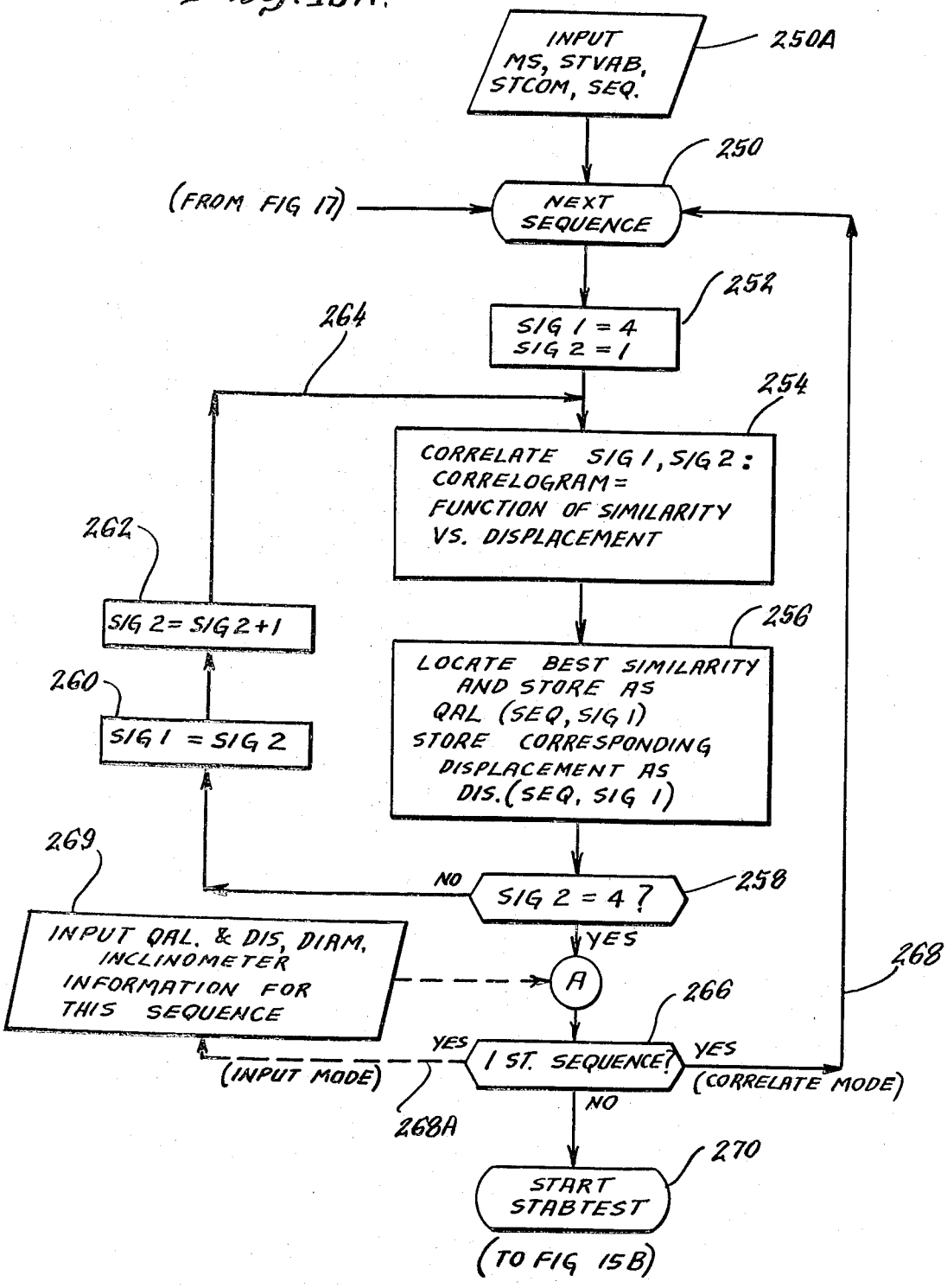
FIG. 15A illustrates some preliminary steps in the procedure used to obtain sequences of displacements and corresponding quality diameter and inclinometer information.

FIG. 15A illustrates well known steps which may be performed in order to produce displacements by correlating overlapping intervals of similar geophysical signals. Methods of employing either digital computers or special purpose analog devices to obtain a correlogram from two signals are well known and are not regarded as part of this invention since the required displacement may also be obtained as output from existing programs. One method is described herein as a preliminary process for the purposes of completeness and review.

Referring now to FIG. 15A, Block 250A corresponds to the inputting to the process certain initial control values. Illustrated is the minimum number of sequences MS which are considered as necessary in order to support an analysis process which follows. This minimum number is somewhat related to the extent of which the correlation interval used for each sequence overlaps each subsequent sequence. For example, if the correlation interval for a given sequence overlaps 75% of the correlation interval for a previous sequence, the minimum number of sequences required for analysis might be considered as four, whereas a lesser number might be considered for a lesser degree of overlap. Input parameters STVAR and STCOM pertain to a statistical variance and a constant used in the determination of displacement sequence stability and will be discussed further in regard to FIG. 15B. Input value SEQ simply corresponds to the starting sequence designation.

Block 250 of FIG. 15A corresponds to the beginning point for the processes illustrated on this and some additional figures. Block 252 corresponds to the first step in this preliminary process and as indicated therein defines the first two signals, here designated as SIG1 and SIG2, which are to be correlated. In the case of the four-pad dipmeter, the defined "4" could be used to designate the signal obtained from pad 4 while the "1" could designate the signal from Pad 1. Thus, the first correlation would be between the signals derived from sources corresponding to Pads 4 and 1.

Block 254 is next and corresponds to the actual correlation of the designated signals. This correlation produces a correlogram such as illustrated in FIGS. 7A through 7D and discussed in relation thereto. It will be recalled that the correlogram produces a function of the similarity between geophysical signals versus signal displacements.

The next step in the process, as illustrated in Block 256 of FIG. 15A is to locate the best similarity indicated in the correlogram and to store this similarity to serve later as a function of the quality of the correlation, herein designated as QAL(SEQ,SIG1). Also stored in the displacement corresponding to the best similarity, here designated as DIS(SEQ,SIG1). Thus, both the quality and the displacement are stored as functions of the sequence number (SEQ) and the first signal (SIG1) used in the correlation.

Next in the process, as indicated in Block 258, a test is made to see if all the signals have been correlated. In the illustrated case of four signals, the test is made to see if SIG2 has reached this number (here=4). If the answer is NO, the process continues as indicated to Block 260 to update SIG1 using the previous SIG2 designation and then as indicated in Block 262, to increment SIG2 to designate the next signal. The process then returns as indicated by Branch 264 to the correlation process but this time to correlate a different signal pair. Thus, in turn, the process will correlate each of the four signals in adjacent pair relationships; i.e., signals 4-1, 1-2, 2-3 and 3-4.

After correlating all the desired signal combinations, which are limited to the four adjacent combinations here to simplify this illustrated case, the test indicated in Block 258 answers YES, and the process continues through to Point A to Block 266, where it is determined if the two or more sequences need to be processed before the process indicated as beginning at Block 270 may be performed. It if is indeed the first sequence, the process may continue by returning to Block 250A to begin the next sequence as previously described at this point. Thereafter, the process will continue as indicated to start the procedure designated as STABTEST which will be described later in regard to FIG. 15B.

It will be readily apparent that many of the prior art correlation techniques may be used to obtain displacements and corresponding quality factors for the various parts of signals. As previously mentioned, these values are often output from available dipmeter computation programs. When this is the case, or when obtained from other forms of correlation such as manual correlation, the displacements and quality factors may be input directly to the process as indicated at Block 269 to begin the process starting at Point A. The test indicated in Block 266 would then, upon finding the first sequence, return as indicated by the dashed line designated 268A for an additional sequence and thereafter continue with the subsequent process starting at Block 270 of FIG. 15B.

Referring now to FIG. 15B and beginning at Block 270 which is the continuation point of FIG. 15A, the signal initially designated as SIG=1 as shown in Block 272 would first be tested for stability, as shown in Block 274 through 278. First the difference between the same two displacements, here both designated by SIG, in successive sequences SEQ and SEQ+1, is computed. As noted by the dark vertical bars around the quantity designating this difference |DIS(SEG,SIG)−DIS(SEQ+1,SIG|, it is convenient to use the absolute value of this quantity; i.e.; no attention is paid to the algebraic sign for this quantity.

Next in Block 276 of FIG. 15B, a stability tolerance is computed as TOL=|DIS(SEQ,SIG)|* STVAR+STCON. Again the algebraic sign is ignored. The values STVAR and STCON are input constants shown in Block 250 of FIG. 15A and correspond to nominal values of 0.1 and 0.2, respectively. These input parameters allow the user of this technique to control the variation allowed between displacements from sequence to sequence since this variation is expressed both as a percentage (STVAR) of actual displacement and a small stable amount (STCON).

Next, as indicated in Block 278, it is determined if the displacement sequence for signal SIG is stable, as indicated when the previously computed difference DIF does not exceed the computed tolerance TOL. In this case, the test shown in Block 278 answers NO and a sequence counter SC is incremented as indicated in Block 282. The particular sequence counter SC that is incremented in this case corresponds to the designated signal SIG being tested for stability at this point. In other words, there is one SC counter for each possible signal combination previously correlated or input as described in regard to FIG. 15A.

If not otherwise provided, the initial values of the SC counters may be set to zero in a preliminary step shown as in Block 271. Similarly, the MC counter, which will be described later, may be zeroed at this time.

If, however, the displacement difference exceeds the tolerance, the test indicated in Block 278 of FIG. 15B answers YES and the counter SC is set to zero as indicated in Block 280. Thus, a sequence of substantially stable displacements will result in a continuous incrementation of the SC counter corresponding to the signal, whereas the loss of stability will result in the corresponging SC counter being reset to zero.

In either case, and as indicated in Block 284, a test is made to see if all displacements corresponding to the various signal combinations have been processed. In the illustrated case, four signal combinations were being processed so if the value of SIG has not reached four, the test indicated in Block 284 answers NO and SIG is incremented as indicated in Block 285. The process then continues with the previously discussed Block 274. If, however, all of the four illustrated signal combinations have been processed, the test answers YES and the process continues as indicated at Block 286 to start the PAIRTEST procedure, which will now be described in regard to FIG. 15C.

Referring now to FIG. 15C, there is illustrated the steps of a process which may be used in conjunction with the values of the sequence counters determined in the previous process, to determine which of the stable displacement sequences are related to each other in such a way that they may be combined to produce a function of the position of the signals. In the illustrated case, the relationship desired is that of adjacent pairs of displacements.

It will be recalled that the sequence counters for each signal; i.e., SC(SIG) were defined in the previous process and as illustrated in FIG. 14 contained the number of stable displacements prior to the immediate sequence. The process depicted in FIG. 15C and referred to in Block 286 as PAIRTEST corresponds to comparing the adjacent pairs of sequence counters to determine their minimum contents and then testing this minimum to see if it corresponds to a new maximum count in the immediate sequence. Each combination of adjacent counters is processed in turn until all combinations in the sequence are processed, with the resulting maximum count indicating the maximum number of adjacent stable displacement pairs preceding the immediate sequence.

As illustrated in FIG. 15C, the process continues from FIG. 15B and at Block 288, the first adjacent displacement pair (SIG1 and SIG2) are defined as corresponding to signals 4 and 1, respectively. Thus, the first adjacent pair to be processed correspond to displacements $d_{4-1}$ and $d_{1-2}$, since by convention the sequence counter, like the displacement, is referenced to the first of the two signals.

Then, as indicated in Block 290, the minimum count in the adjacent counters (MAC) is determined from the corresponding adjacent sequence counters SC(SIG1) and SC(SIG2). Here the symbol (MINF) is understood by those in the computer programming art to mean the minimum of those values included in the paranthesis which follows this symbol. Thus, for example, if at Sequence 14 illustrated in FIG. 14, SC(4)=1 and SC(1)=0; i.e, there is one set of stable displacements in the sequence indicated for displacement $d_{4-1}$ and none indicated in the sequence $d_{1-2}$, the value of MAC determined as indicated in Block 290 is "0", which is indicated in FIG. 14 for Sequence 14 under the column labeled $MAC_{4-1-2}$.

Then, as indicated in Block 292 of FIG. 15C, a test is made to see if this MAC value exceeds the previous maximum count MC. For the first case, as previously discussed in regard to FIG. 15B in Block 271, MC has the initial value of "0". If, as is the case for this initial MC value, MC=MAC, the test indicated in Block 292 answers NO, the process continues directly to the test indicated in Block 296 to determine if SIG2 corresponds to the last signal to be considered. This last signal, in this case, will be 4, as previously discussed in regard to a similar test in FIG. 15A at Block 258. Thus, in the initial test, the answer will be NO and the process will continue by updating SIG1 to the previous value of SIG2 as indicated in Block 297, then subsequently incrementing SIG2 to the next signal as indicated in Block 298. The previously discussed process is then continued beginning at Block 290.

If the test indicated in Block 292 of FIG. 15C answered YES, i.e., MC is less than MAC, a new value of MC is defined as equivalent to MAC as indicated in Block 294. The process then returns to the test for the last signal as shown in Block 296.

Referring again to the example in FIG. 14 and Sequence 14, it will be seen that sequence counters for 1-2 and 2-3 both contain a "0" so that the MAC derived as indicated in Block 290 is again a "0" with no new value of MC resulting as before. Examination of Sequence 14 in FIG. 14 finds that for each adjacent combination of sequence counters as indicated at Sequence 14, the minimum value is always zero except for when the sequence counters for 3-4 and 4-1 are tested. Here the minimum value is "1" resulting in the final MC value being "1" as indicated in the righthand one-third of FIG.14 as "MC-ALL".

In this case, the process is then complete as indicated by SIG2=4, which results in the test shown in Block 296 answering YES. Thus, the process continues by starting AUTOZONE as indicated at Block 300 and which is further illustrated in FIG. 17.

If, however, as illustrated in FIG. 14, in Sequence 10 or 11, there are no stable sequences of displacements which are adjacent, the final value of MC is "0".

Values for MC resulting from considering all the adjacent displacement pairs in each sequence shown in FIG. 14 through the use of their sequence displacement counters SC are found to vary between 0 and 3 for Sequence 18 for example. When the same adjacent pair continues to remain stable as is illustrated for Sequences 15 through 18, the value of MC determined for each sequence also increases similar to that of the sequence counter SC. However, for example, if in Sequence 19 one of the displacement sequences is interrupted, MC takes on a new value corresponding to the maximum of the minimum of the adjacent sequence counters. In Sequence 19 this value is one, corresponding to either $d_{1-2}$ and $d_{2-3}$ or $d_{2-3}$ and $d_{3-4}$, as indicated in MAC columns labeled 1-2-3 and 2-3-4, respectively.

Thus, a non-zero value for MC corresponds to at least one adjacent stable displacement sequence, the minimum number to be considered as a possible stable zone. However, as previously discussed and as will now be further considered in regard to FIG. 16, more considerations may be used in determining an appropriate zone for analysis.

Figure 16:
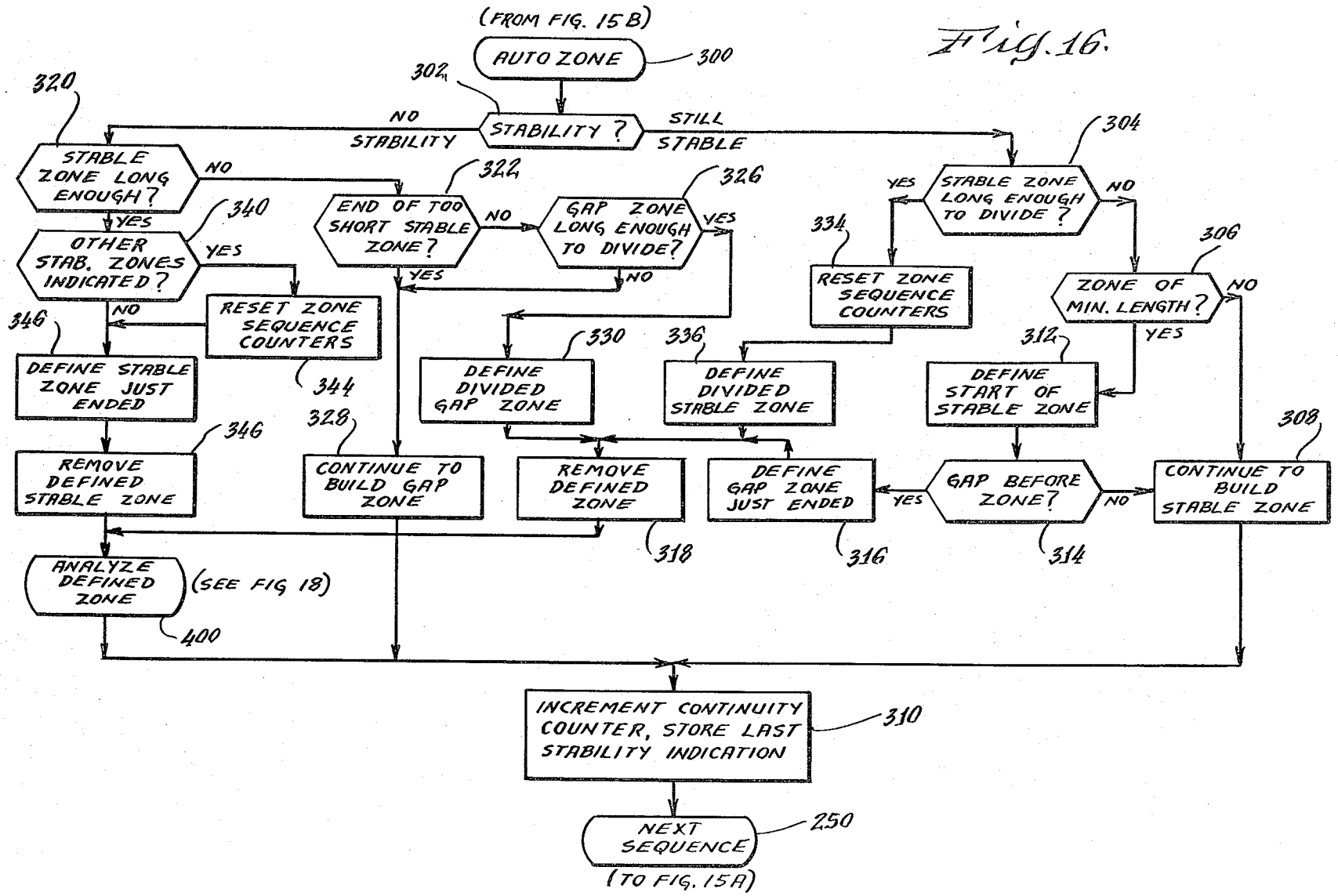
FIG. 16 describes a step in a procedure to automatically determine the starting and ending boundaries of zones of adjacent pairs of substantially stable sequences.

FIG. 16 illustrates the detailed steps which may be used in a process to automatically determine zones of displacements suitable as a group to be further analyzed. These zones may be of two types, those which are stable and contain an essentially contiguous sequence of substantially stable displacements for at least two related pairs of signals, and those unstable zones which are in the gaps between the stable zones. Further, the process determines that such a stable zone has the same related displacement in each sequence such that the displacements may be considered to correspond for dip computational purposes. In particular, such corresponding displacements usually have a common curve or signal source, which allows these displacements to be related to each other in a spatial sense.

Figure 17:
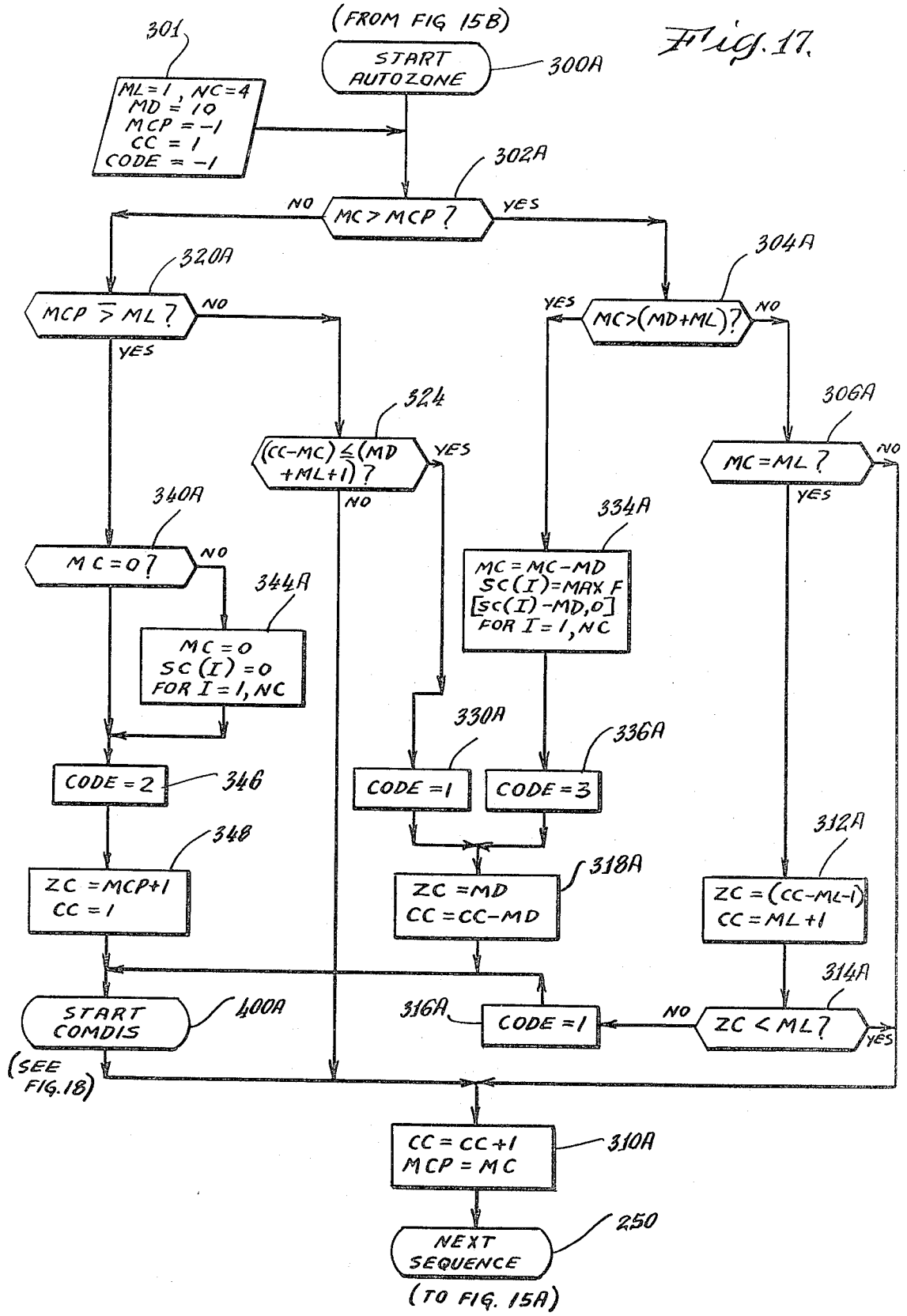
FIG. 17 illustrates the steps of a program corresponding to the procedure illustrated in FIG. 16.

The process designated here as "AUTOZONE" will be discussed once in general terms as shown in FIG. 16 and then in programming terms, as shown in FIG. 17. This process begins, as shown in FIG. 16, by testing a measure of stability such as shown at Block 302. This test may be performed in any manner consistent with a previous process which records stability histories of two or more related pairs of displacements. However, in this discussion, the stability test will consider only the previously described process illustrated in FIGS. 15A–15C and the parameter MC and its history, as recorded as MCP and shown in FIG. 14.

If the stability test shown in Block 302 indicates that at least one zone of adjacent stable displacements is still stable, the process continues as shown in Block 304 where the length of this provisional zone is tested to see if the zone is long enough to be divided into separate zones, each of which contains enough sequences to be analyzed. In actual practice, the minimum number of sequences in such a divided zone should be about ten. Where substantially overlapping correlation intervals are employed, it is preferred that at least four sequences be reserved to establish the minimum length for the next stable zone. Therefore, the test indicated in Block 304 should indicate if at least fourteen stable sequences have been accumulated, such that the first ten sequences could be divided into a separate zone at this time.

Usually this is not the case and the process would continue as indicated in Block 306, where it would be determined if the zone contained the minimum number of sequences to be considered for the analysis. Here, as stated above, for substantially overlapping correlation intervals, this minimum number might correspond to four sequences. If this requirement is not met, the process continues as indicated to Block 308 with the continuation of additional sequences to build a stable zone.

Thereafter, as in all cases, the process continues by incrementing various zone counters used for storage functions and, in particular, storing the last stability indication as indicated by Block 310. As shown in FIG.

14, this could correspond to simply storing MC as MCP. Then, as indicated in Block 250, the next sequence of displacements would be considered.

If the next sequences continue to indicate that the zone is still stable and the test indicated in Block 306 of FIG. 16 indicates that a minimum zone length has accumulated, for example, at least four stable sequences, the process continues as indicated to Block 312 where the definition of the start of a stable zone is made. This definition is determined from various sequence counter as will be explained later. It will be readily realized that the stable zone determination lags the actual occurrence of the stable zone and this lag is considered in the definition.

Then, as shown in Block 314, it is determined if the start of a minimum length stable zone indicates the end of a proceding unstable zone or gap zone. If YES, the definition of this gap zone may be made at this time as shown in Block 316. With this gap zone now defined, the process may continue as indicated to Block 318 to remove this zone from the automatic zoning process and submit it to further analysis. In the removal process indicated in Block 318, certain counters used to monitor the sequences in the defined zone are modified to, in effect, remove the defined zone, which, as indicated in Block 400, is then analyzed. The analysis process indicated in Block 400 will be discussed in detail in regard to FIGS. 18 through 21.

Subsequent sequences may continue to be stable for enough sequences to accumulate such that the test indicated in Block 304 finds that the stable zone is long enough to divide. This division then may start as indicated in Block 334 by defining the start of a new stable zone. This may be done by resetting the counters associated with a stable sequence to the values corresponding to the start of a new stable zone. The previous part of the stable zone is then defined and divided out or removed for consideration in a subsequent analysis.

This definition process is indicated in Block 336 where the end of the stable zone is specified. As discussed in regard to Block 318, the division or removal considers the lag characteristics of the determination process used in defining the zone. Thus, as previously described in regard to Block 318, the stable zone is removed and subsequently analyzed but in this case, as a divided stable zone. After analysis, the process continues as indicated in Block 310 with the usual counter incrementation and storage functions, continuing then with the next sequence as indicated at Block 250.

If, for subsequent sequences, the stability test shown in Block 302 of FIG. 16 indicates that the stability has been lost, the process branches to Block 320 to test the previously indicated stability history to see if a stable sequence long enough to be considered as a stable zone had occurred. If not, the test indicated in Block 320 would answer NO and the process would continue as indicated to Block 322. Here the nature of the sequence which just terminated for loss of stability would be determined. If the sequence was stable, it in effect lost its stability before the minimum required length could have been accumulated. It is then considered as part of an unstable or gap zone. In other words, at this point, which has been found are a few stable sequences followed by one or more unstable sequences. In this case, the stable sequences are considered as part of the unstable zone.

Then, as indicated in Block 328, the process continues to build a gap zone and completes this sequence as indicated and previously described in regard to Block 310.

If, as indicated in Block 326 of FIG. 16, a gap zone accumulates with enough sequences to be considered as two separate zones for the purpose of analysis, a given number of sequences may be divided out as a gap zone as previously described in the case of divided stable zones. Here, also, the division requires leaving a minimum number of sequences which start the next zone. When enough sequences occur in a gap zone, as for example, fourteen sequences, the test indicated in Block 326 would answer YES and, as in the case for the above example, the first occurring ten sequences may be defined as an automatically divided gap zone as indicated in Block 330, then removed as previously discussed in regard to Block 318 and analyzed as indicated in Block 400.

As previously described in regard to FIG. 14, in analyzing sequences of stable displacements it is frequently found that several stable zones may be indicated. For example, a stable zone may be indicated for related displacements $d_{1-2}$ and $d_{2-3}$ while a different stable zone may be indicated for displacements $d_{3-4}$ and $d_{4-1}$. Therefore, two or more stable zones which overlap each other may actually occur.

The test indicated in Block 340 of FIG. 16 corresponds to determining if such overlapping zones are indicated. If this is the case, then the loss of stability indicating the end of the previous stable zone should consider the possibility of continuing overlapping stable zones. Thus, if the test indicated in Block 340 indicates such an overlapping zone is present, the various sequence counters are reset as indicated in Block 344 to allow for the subsequent definition of this zone after the ending of the zone just indicated by the loss of stability. The resetting of the counters as indicated in Block 344 allows the immediate detection of the overlapping zone and subsequent determination if it is long enough to be considered for analysis. Thus, the ending of a stable zone need not necessarily follow with an unstable zone but could correspond to the start of another stable zone but between a different pair of related displacements; i.e., at least one of the three signals used in determining the displacements is different.

In any case, the process as indicated in Block 346 defines such a stable zone which just ended. Compensating for the inherent lag, of course, the process then, as indicated in Block 348, modifies the zone counters to, in effect, remove the zone just defined. Then, as previously discussed in regard to Block 400, this zone is submitted for subsequent analysis.

In summary then, the automatic zone determination process considers the length of the zone, the nature of the zone which precedes and follows each zone, along with the fact that stable zones may be followed by other stable zones, to define zones or groups of sequences which are then submitted for analysis. Stable zones must necessarily be of at least a minimum length and, if found to be shorter, are considered to be part of an unstable or gap zone.

In order to avoid extraordinarily long zones of either the unstable or stable type, provisions are made to automatically divide zones which have been determined to be long enough to support two or more separate analyses. The end of a zone corresponding to the earlier part of such a long zone is then defined along with the beginning of the zone which will follow. The just-ended zone is then removed from the zoning process and submitted for analysis.

Referring now to FIG. 17, there is illustrated one method of programming the AUTOZONE process just described in regard to FIG. 16. Corresponding steps already discussed in FIG. 16 are indicated by the same numbers in FIG. 17 followed by the letter "A". Where no corresponding steps are previously indicated, a different number is used.

The process continues from that discussed above in regard to FIG. 15C, starting at Block 300A. In the first sequence, the initial values indicated in Block 301 are considered. These may be input at the beginning of the routine or included in the programming. In the illustrated order, these values are: ML, which corresponds to the minimum number of levels or sequences of related displacements necessary to define an analysable zone; MD, which corresponds to the maximum number of sequences which may be considered as a separate zone; i.e., those to be divided from a longer continuing sequence of either stable or unstable sequences; MCP, which corresponds to the previous value of MC, as was determined from a previous sequence, and for the first sequence, is set to an artificial value of $-1$; CC, which corresponds to a continuity counter indicating the number of sequences already found in the current zone; for the first sequence, CC is set to 1 to compensate for a one-sequence lag in determining stable displacements; and the parameter CODE, which corresponds to the type of zone. These zone codes, as illustrated in FIG. 17, indicate the following definitions:

CODE=1 corresponds to an unstable or gap zone;

CODE=2 corresponds to a stable zone with both its beginning and end determined; and CODE=3 corresponds to a stable zone, as above but which has been divided out of a long zone and which remains with only its beginning defined.

Referring to Block 302A of FIG. 17, the previously determined counter value MC, is tested against the previous value for this counter, now stored as MCP, to determine the nature of any change in stability. When MC is larger than MCP, an increase in the number of stable sequences is indicated, since in general MCP, except for the initial sequence, can never be less than zero. This results in this test answering YES, indicating a stable sequence.

The process will then continue as indicated in FIG. 17 to Block 304A where MC is further tested to see if the stable sequence is long enough to be automatically divided into two zones. Dividing a zone may be done by removing MD sequences, which requires that the present stable sequence must be at least MD+ML long such that a zone of at least ML sequences remain after such a division. Thus, MC is tested against MD+ML as indicated in Block 304A.

In the initial sequences, this test of course will answer NO and the process will continue as indicated to Block 306A where MC is tested to determine if a minimum zone is present. This of course occurs when MC=ML, the minimum number of levels required, which would result in the test indicated answering YES. However, in the initial sequences, this test would also answer NO and the process would continue as indicated to Block 310A where the continuity counter CC is incremented by 1. Also, the current value of MC is stored as MCP for use in the next sequence.

In any case, the processing of each sequence would continue with the next sequence as indicated at Block 250, returning to the process previously discussed in regard to FIG. 15A. Consequently, another round of displacements would be determined between the signals for a subsequent sequence as described in regard to FIG. 15A, and the differences between displacements in this sequence and the same displacements in the previous sequence would be compared to update the stable sequence counters SC as discussed in regard to FIG. 15B. Then, as discussed in regard to FIG. 15C, the determination of pairs of stable displacements would be made and result in a new value for MC. At this point the AUTOZONE process would start again as illustrated in FIG. 17 beginning at Block 300A where this new value for MC is tested as indicated in Block 302A.

If a long zone of stable displacements has occurred as would be indicated by continually increasing values of MC and MCP, the test indicated in Block 302A of FIG. 17 would continue to answer YES until the value of MC equalled the value of ML, as indicated by the test in Block 306A answering YES. In this case, the start of a stable zone results in the initialization of both the zone counter ZC and the continuity counter CC. Thus, as indicated in Block 312A, ZC is set to a value corresponding to the current value of continuity counter CC less the minimum number of levels required, less an additional level to compensate for lag in the determination. Then the continuity counter CC is set to correspond to this minimum number of levels and the additional level due to the lag. Then, as previously discussed and indicated in Block 314A, beginning of a stable zone implies the possibility that the just previous zone may have been an unstable zone and if that were the case, the end of an unstable zone is now defined. This case would be indicated by the newly computed value for the zone counter ZC being less than the minimum number required for a stable zone and the test indicated in Block 314A would answer NO, resulting, as indicated in Block 316A, in a CODE=1 being assigned.

This unstable zone has already been defined in terms of the zone counter ZC and continuity counter CC as indicated in Block 312A. The process then continues to combine the related displacements now grouped into this zone as will be described later in regard to FIG. 18 in a process labeled "COMDIS" which begins at Block 400A. After COMDIS, the process illustrated in FIG. 17 will continue at Block 310A which has been previously described.

If, however, the test shown in Block 314A indicates that the previous zone was not an unstable zone but a prior stable zone involving perhaps different signal combinations, the test indicated would answer YES and the process would continue to build the stable zone by proceeding to Block 310A as previously described.

If a large number of stable sequences have been detected and the value of MC has increased such that it exceeds the value of MD by enough additional sequences to establish two zones; i.e., ML additional sequences, then the stable zone may automatically be divided at this point by dividing out or removing MD sequences from the beginning of the current sequence. This process is indicated by resetting the MC counter and the sequence counters SC as indicated in Block 334A. MD sequences are removed from MC. For SC, the MAXF function, like the MINF function, is well-known to those in the programming art and selects the maximum of the values which follow. In this case, either the previous SC value less the MD value or zero, whichever is the maximum, is selected for resetting each SC.

In the case of the automatically divided stable zone just defined, the indicator corresponding to CODE=3 is assigned as shown in Block 336A. The process continues then by setting the zone counter ZC to MD, and removing MD sequences from the continuity counter CC. The displacements in the now defined zone may now be combined in the previously mentioned COMDIS process and this sequence completed as previously described and indicated in Block 310A.

The next sequence will return the process to AUTOZONE at Block 300A and the stability test at Block 302A. If there is any instability, this test will answer NO because MC will be less than or equal to its previous value MCP and the process will continue as indicated at Block 320A.

When the loss of stability is indicated by the test in Block 302A, the previous sequences could correspond to a stable zone if at least a minimum number of sequences has accumulated. This determination is made by testing the previous MC value now stored as MCP against the minimum number ML, as indicated in Block 320A. If not enough sequences are present, this test will answer NO and the process will branch as indicated to Block 324 in FIG. 17. Here, the illustrated test corresponds to a combination of the tests indicated in Blocks 322 and 326 in FIG. 16. Thus, as previously discussed, stable zones which are too short and gap or unstable zones are treated the same. If either of the two cases occurs, the test indicated compares the continuity counter CC less the current maximum count MC, with the maximum number of levels need to warrant division, MD, of MC plus the minimum number of levels ML plus an additional level to compensate for the lag in determinate.

If the former quantity, CC-MC, is less than the latter, MD+ML+1, the test shown in Block 324 answers YES, indicating a large number of sequences were present and that the sequence was a gap zone. This is indicated by assigning CODE=1 as shown in Block 330A. This zone is then further described as shown in Block 318A by defining the number of sequences in the zone as indicated in the zone counter ZC, which in this divided zone, is equal to the maximum number MD. This zone is then removed from the continuity counter CC by subtracting this MD value, as also illustrated in Block 318A. The process would then continue as previously discussed to Block 400A to process this zone.

Returning now to Block 324 of FIG. 17, if the test indicated in this block answers NO, the number of stable sequences present is either small; i.e., a stable sequence has ended which was too short to be considered as a zone, or an unstable zone has just begun. The process thus continues to the next sequence after incrementing the continuity counter CC and storing the previous MC value as indicated in Block 310A.

If, however, the test indicated in Block 320A indicates that the previous value of MC, now stored as MCP, exceeded or equaled the minimum number of sequences ML, this test answers YES, and the process continues as indicated in Block 340A. Under these circumstances, the current value of MC not equalling zero indicates that other stable zones may be present in addition to the one just terminated. In this case, the test indicated in Block 340A answers NO and the counters indicated in Block 344A are reset. This allows immediate detection and evaluation of these other stable zones. Thus, in this case, the value of MC is reset to zero along with all of the individual sequence counters; i.e., SC for each of the related displacement combinations considered. In FIG. 14, four are illustrated but six could be considered even with the four pad tool.

Consider, for example, Sequence 13 indicated in FIG. 14 where a stable sequence between Signals 4-1-2 has just terminated with Sequence 12, yet another stable sequence is building between Signals 2-3-4. As is apparent on FIG. 14 both the values for MC and MCP equal 1 in this case. Similarly, for Sequence 15, MC=MCP=1 where the 3-4-1 sequence is terminated but a stable sequence for 2-3-4 is already building. Thus, MC not less than MCP and MC>0 indicates other stable sequences.

The resetting of the sequence counters SC and the maximum counter MC is also indicated by the notation in FIG. 14 by two numbers in the same column separated by an inclined line-the upper left-hand number corresponds to the original value and the lower right-hand number corresponds to the reset value. Thus, for the latter example in Sequence 15, all the SC counters not already at zero and the MC counter are reset to "0" as indicated in block 344A of FIG. 17.

After testing for the above case, as indicated in Block 340A, the stable zone is then defined as indicated in Block 346 by setting CODE=2. The stable zone just ended is then removed, as indicated in Block 348, by setting the ZC to MCP+1 which compensates for the one sequence lag, and resetting CC to "1" for the current sequence. Then, as previously discussed in regard to Block 400A, the displacements in this zone will be combined and analyzed. The process will then continue as previously described in regard to Block 310A, and return with the next sequence.

In review and referring again to FIG. 14, sequences of displacements corresponding to the same combination of signals are compared to determine if substantially the same displacement is indicated; i.e., if the displacement is stable. If this is the case, a corresponding sequence counter SC is incremented to indicate the number of such stable displacements for that signal combination. When all the combinations in the round of combinations have been thus considered, each sequence counter SC is compared to each other possibly related SC. This relationship is such that the corresponding displacements may be meaningfully combined as, for example, to define a plane. In the simplified case illustrated in FIG. 14, only adjacent displacements were considered and consequently only adjacent counters were compared.

The comparison selects the minimum value of such related counters. For each minimum selected, this minimum was compared with the previous maximum for such values and the maximum of all such minimums thereby derived. This maximum value indicates the number of sequences which have a related pair of stable displacements.

When this maximum value exceeds a minimum length for a stable zone, it defines the end of a prior unstable zone. When the length exceeds the number of sequences which may be divided into two zones, one zone is automatically divided out.

Tests for a decrease in the maximum value are used to detect an instability in the longest sequence of related stable displacements and, if this sequence is of at least minimum length, defines the end of this stable zone. If this sequence is not long enough, provisions are made to consider both other related stable sequences or, if none are present, to reconsider these sequences as part of an unstable sequence.

For sequences where no given pair of stable displacements are found for enough sequences, these sequences are grouped into unstable or gap zones between the stable zones. When the number of sequences in these gap zones exceed the number which may be divided into two gap zones, one zone is automatically divided out.

Each of the above defined stable or gap zones is then submitted as a group to processes which combine the related displacements, classify the combinations and determine the position of the dominant class. The displacement combination and classification processes will now be described in detail.

Figure 18:
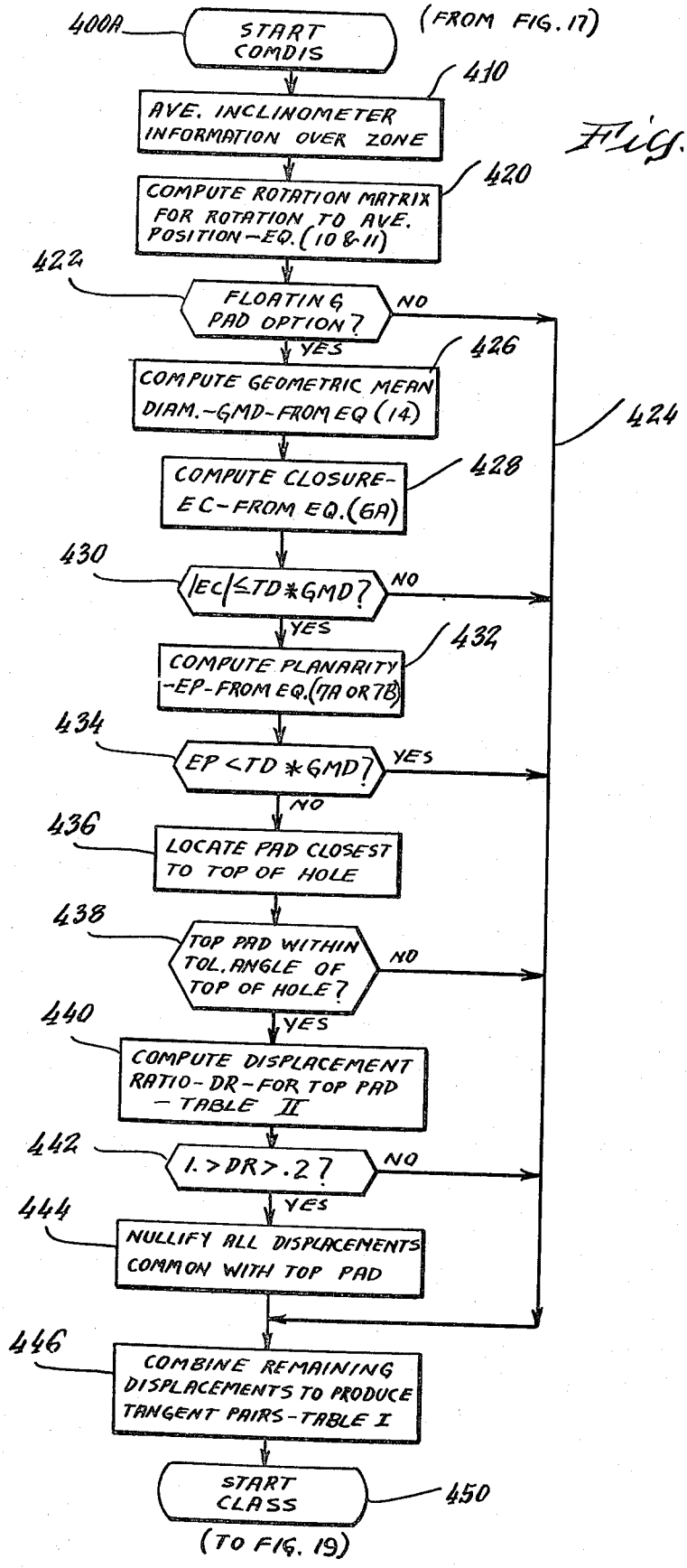
FIG. 18 illustrates in detail the steps of the procedure to combine corresponding displacements to produce functions representing the angular relationship between the displacements.

Referring now to FIG. 18 there will be described a process for combining corresponding displacements to produce a function of the angular relationship between three or more signals. In general, the process is oriented relative to the position of the tool. Sequences of displacements which may have been previously defined as from either a stable or unstable zone are usually processed as one sample group. Where the dipmeter tool is rotating throughout the zone, provisions are made to determine the average position of the tool throughout the zone to compensate each combination of displacements or their resulting angular relationship so that the zone is processed as if the tool was positioned at its average position. This compensation adds further to the integrity of the analysis of the zone.

As previously discussed, when the borehole is deviated, certain operating conditions may result in one pad leaving its preferred contact position against the borehole wall and floating toward the center of the hole. Usually, this floating pad is the pad on the top side of the hole. The displacement of this pad from the top side of the borehole wall corresponds to a partial collapse of the caliper apparatus supporting the top and opposing down side pads. This collapse is due to the weight of the tool pressing downward on the downside pad which overcomes the ability to maintain the top side pad contact.

To some degree, this collapse may be detected by comparing the two diameters normally available with the four-pad tool where each pair of opposing pads are independently calipered. In some cases the diameter measured between the top and downside pads may be less than the diameter measured between the other pads, implying this collapse. However, as previously discussed, such a difference in calipers may be due merely to an elliptical hole and in fact all the pads are in contact with the borehole wall. Therefore, it is preferred that other tests be made to determine if a floating pad is present.

It has been discovered that displacements associated with signals obtained from a floating pad generally exhibit good closure but frequently exhibit a planarity error. The geometry that explain this characteristic has been discussed in regard to FIG. 4B. In effect, what appears to happen is that the floating pad electrically extends itself from its position removed from the borehole wall to the wall. In other words, the effective diameter does not correspond to the actual measured diameter. How this effect produces a characteristic planarity error, or more specifically, a characteristic displacement ratio, will now be explained in regard to FIG. 23.

FIG. 23 illustrates Pad 1 as the floating pad which floats a distance $\Delta D$ away from the wall of the borehole of diameter D. The actual measured diameter is $D-\Delta D$. Assume for simplicity that the true dip of a feature is shown in the plane of the paper such that Electrodes 2 and 4 both detect the feature at the same depth. Consequently, an electrode plane normal to the borehole or tool axis may be drawn at this depth, i.e., $z_2=z_4=0$. Relative to this plane, the feature appears at electrode 3 at a depth $z_3$ below this plane. Because of the above symmetry, the feature would be expected to appear at Electrode 1 (on the floating pad) at a distance-$z_3$ above this plane. Thus, if the distance-$z_3$ is used in lieu of the actual $z_1$ distance to predict the position of the feature at the No. 1 electrode, the feature would occur at a position designated $P_E$ in FIG. 23. Stated in another manner, one expects $z_1$ to equal $-z_3$ or, more specifically, that the ratio $-z_3/z_1=1$.

However, if the floating pad condition is present, the feature would not appear at the expected position $P_E$ but would appear when the No. 1 electrode was directly opposite the actual position of the feature which is designated as $P_A$ in FIG. 23. It can be seen that this position is substantially above the expected position in that the distance $z_1$ is substantially larger in absolute value than the expected distance $-z_3$. This results in the ratio $-z_3/z_1$ being substantially less than one.

Since displacements are actually determined rather than the distances $z_1$ or $z_3$, these distances must be calculated from the displacements. Recalling the algebraic relationship shown in FIG. 8A, it can be shown that $$z_1=d_{1\text{-}2}-d_{4\text{-}1}$$

and $$z_3=d_{2\text{-}3}-d_{3\text{-}4}$$

so that the $z_3/z_1$ ratio becomes $$\frac{(d_{2-3}-d_{3-4})}{(d_{1-2}-d_{4-1})}$$

which may be regarded as a displacement ratio.

It can also be seen how differences between the $z_1$ and $z_3$ appear as a planarity error. By rearranging the planarity equation-(Eq. 7)-the planarity error becomes $$EP=(d_{1\text{-}2}-d_{4\text{-}1})-(d_{2\text{-}3}-d_{3\text{-}4})=(z_1)-(z_3) \qquad \text{(Eq. 7A).}$$

Of course, it can now be seen that for EP to equal zero (no planarity error) $z_1$ must equal $-z_3$ which of course does not occur in the floating pad case.

It is important to note that distance z corresponding to the floating pad ($z_1$ in FIG. 23) is always exaggerated when compared to the comparable distance for the opposing pad ($z_3$ in FIG. 23). This results in the displacements determined between the signal obtained from the floating pad and a signal obtained from an adjacent pad, 2 or 4 for example, also being exaggerated when compared with those obtained from the opposing pad. Thus, the floating pad may be indicated by calculating the distance corresponding to z for each pad and selecting the largest distance as corresponding to the floating pad.

Further in regard to planarity, it is preferred that the planarity error used to indicate possible floating pad conditions be related to the diameter of the borehole, such as a given percentage thereof. However, in truly elliptical holes or in round holes but where the above caliper collapse condition is present, the measured diameters often do not agree and a geometrical mean diameter GMD may be used for more accuracy.

Referring now to FIGS. 24A and 24B, there is shown a general relationship corresponding to the above GMD. Each measured diameter $D_{1\text{-}3}$ and $D_{2\text{-}4}$ is considered as a side of a right triangle and the diagonal side length computed by any well-known method. Then, using the well-known relationship between the side of a square and its diagonal side length computed by any well-known method. Then, using the well-known relationship between the side of a square and its diagonal, a geometrical mean side (diameter) is computed.

FIG. 24A illustrates for round holes that the actual diameter equals GMD and equals either $D_{1\text{-}3}$ or $D_{2\text{-}4}$.

FIG. 24B illustrates for elliptical holes how the corresponding GMD may also be calculated.

Of course, it will be appreciated that the degree of permissible closure as well as planarity error may be related to the borehole diameter and, more particularly, to the geometrical mean diameter GMD found as discussed above.

The floating pad condition is more prevalent in enlarged and highly deviated holes. Therefore, tests for this condition are regarded as optional. It is recommended that such tests be considered where hole deviations exceed 20° but this deviation figure will depend upon the mechanical characteristics of the particular dipmeter tool. Therefore, the testing of the borehole deviation, actual or measured diameter or opposing caliper measurements are not illustrated here.

When optioned, the floating pad detection tests should determine that only a small degree of closure error exists before the planarity errors are considered as significant. If a significant planarity error is found the pad closest to the top of the hole is located and tested to see if its position is close enough to the top of the hole to indicate that the mechanical forces necessary for partial collapse would be present. If such a position is not confirmed, again further tests for floating pad are abandoned. However, if this position is confirmed, a displacement ratio specific to this pad is computed and tested for presence of the type of displacement exaggeration corresponding both in direction and degree to a floating pad.

In the final test indicates that the specific pad is floating, the displacements related to this pad or signals derived therefrom are identified and regarded as not corresponding to the non-floating pad displacements and therefore disqualified for further processing. Displacements not disqualified are then combined within each sequence in the zone to produce pairs of virtual tangents, each pair requiring only two related displacements. With many combinations of related displacements possible, a multiplicity of such tangents result for each sequence. For example, thirteen virtual tangent pairs are possible in the four-arm dipmeter when no pad has been nullified because it is floating or for other reasons.

Referring now to Block 400A of FIG. 18, the indicated "combine displacements" or COMDIS process starts with the corresponding block in FIG. 17. As indicated at Block 410, the average inclinometer information for the zone is computed from the inclinometer information normally included with each round of displacements in the dipmeter information. The exact nature and reference points of the inclinometer information may vary with the type of tool. These details are well-known and will not be discussed herein.

Next, in Block 420, it is convenient to compute a rotation matrix corresponding to the average position found as indicated in Block 410. Again, such rotation techniques are well-known. However, for completeness, the following equations are provided.

The rotational position of the tool is usually expressed as an azimuth u of one of the pads, usually pad No. 1. The rotation matrix is conveniently stored as two vectors RM1 and RM2 which may be expressed as:

$$RM1 = \cos(u)\cos(u_{ave}) + \sin(u)\sin(u_{ave}); \quad \text{(Eq. 10)}$$

and $$RM2 = \sin(u)\cos(u_{ave}) - \cos(u)\sin(u_{ave}); \quad \text{(Eq. 11)}$$

where:

$$\cos(u_{ave}) = \frac{\sum_{i=1}^{i=N} \cos(u_i)}{\sqrt{[\Sigma \cos(U_i)]^2 + [\Sigma \sin(u_i)]^2}}$$

and $$\sin(u_{ave}) = \frac{\sum_{i=1}^{i=N} \sin(u)}{\sqrt{[\Sigma \cos(u_i)]^2 + [\Sigma \sin(u_i)]^2}}$$

The tool position at each sequence is expressed above as $u_i$ and the zone is considered to consist of N such sequences. The equations for rotating a vector corresponding to a given sequence in the zone to the average position for the zone and which utilize RM1 and RM2 are as follows:

$$x_{ave} = x_i RM1 - y_i RM2 \quad \text{(Eq. 12);}$$

and $$y_{ave} = x_i RM2 + y_i RM1 \quad \text{(Eq. 13);}$$

where x and y are the components of the vector.

The process of detecting a floating pad to find out which displacements might possibly correspond and which displacements do not correspond because they may be derived from signals obtained from such a floating pad is of course optional. Such a determination would be most likely unnecessary in very small holes where the mechanical arrangement is more than adequate to keep all pads in contact with the borehole wall, or where the hole is known to be nearly vertical and very little tool weight rests on the downhole pad.

Thus, as indicated in Block 422 of FIG. 18, a test is made to determine if the floating pad option is desired. If no such test is desired, the process continues immediately via Branch 424 to Block 446 which will be described later. If the option is desired, the process of detecting the floating pad begins as indicated at Block 426.

An expression of the closure error EC may be computed next as shown in Block 428 using the following equation:

$$EC = d_{1\text{-}2} + d_{2\text{-}3} + d_{3\text{-}4} + d_{4\text{-}1} \quad \text{(Eq. 6A)}$$

As indicated by the bracketed expression |EC| in Block 430, the absolute value of EC is compared with a given percentage TD, for example 10%, of the GMD computed as in Block 426. If EC exceedss TD percent of GMD, the test answers NO and the process branches directly to Block 446, without further floating pad testing. However, if good closure is found, the planarity error is next computed.

Thus, as indicated in Block 428 of FIG. 18, an expression of the planarity EP may be obtained from a four-pad dipmeter with the following equation:

$$EP = d_{1\text{-}2} - d_{2\text{-}3} + d_{3\text{-}4} - d_{4\text{-}1} \qquad \text{(Eq. 7B).}$$

As previously discussed in regard to FIG. 23, good closure but poor planarity is often indicative of the floating pad situation. Both the closure and planarity errors are more accurately judged when tested in relation to the borehole diameter and in particular, the GMD discussed in regard to FIG. 24B. It is convenient to compute GMD at this time as shown in Block 426. GMD may be found from the following equation:

$$GMD = \sqrt{\frac{(D_{1-3})^2 + (D_{2-4})^2}{2}} \qquad \text{(Eq. 14)}$$

Planarity, like closure, is also tested against TD percent of GMD as indicated in Block 434. However, if planarity is good, as indicated by EP being less than TD.GMD, the indicated test answers YES and again the process branches directly to Block 446 since a floating pad is not implied.

If planarity is poor, implying a floating pad may be present the test indicated in Block 434 answers NO and further testing is made to locate the pad closest to the top of the hole as indicated in Blocks 436 and 438. This may be done using the relative bearing $\beta$ of the reference pad from the top of the hole. For example, if at Block 436, $\beta$ is near zero (or 360°) Pad 1 is the top pad; near 90°, Pad 4; near 180°; Pad 3 and if $\beta$ is near 270°, Pad 2 is the top pad.

With the top pad identified, it should be also determined in a similar manner if this pad is within a given tolerance angle of the top side as indicated in Block 438. This tolerance angle should be less than 45° and preferably is an angle corresponding to, for example, 23°. If the test indicates that the pad lies outside of the tolerance angle relative to the top of the hole, the test answer NO with the process continuing via Branch 424 as previously discussed.

However, if the pad lies near the top of the hole such that the weight of the tool would tend to displace the topmost pad from the borehole wall, the test answers YES and a displacement ratio is computed for this top pad as indicated in Block 440. The specific displacements used in computing the displacement ratio differ for different pads, and are shown in TABLE II. For example, if the suspected top pad is Pad No. 1, the displacement ratio is given by:

$$DR = (d_{2\text{-}3} - d_{3\text{-}4})/(d_{1\text{-}2} - d_{4\text{-}1}).$$

As previously discussed in regard to FIG. 23, when a floating pad results in exaggerated displacements, the exaggeration of displacements occurs in a specific direction in relation to the suspected pad. The displacement relationship used in computing the displacement ratio DR is such that the expected exaggeration produces a DR value much less than 1. However, cases of DR less than 0.2 probably indicate miscorrelations and not floating pad exaggerations. Thus, the test indicated in Block 442 answers NO when DR equals or exceeds 1 or is less than 0.2, concluding no floating pad is present, and continues as indicated via Branch 424.

However, if the DR falls within this range, confirming the pad is floating, the test answers YES and the process continues to Block 444 where all the displacements common with the top pad are nullified or removed from any further combination or analysis. Thus, for example, if the floating pad was found to be pad No. 1, displacements $d_{1\text{-}2}$, $d_{1\text{-}3}$ and $d_{4\text{-}1}$ would be nullified from any further participation.

In addition, it might be convenient to indicate for outputting the identification of the floating pad at this point. Still further, it may be possible to correct the exaggerated displacements associated with the floating pad simply by increasing the corresponding diameter from that actually measured to a diameter approximating the diameter necessary to eliminate the planarity error. In such a case, the displacements would not necessarily be nullified but should be marked so as to indicate such a correction procedure.

Finally, as indicated in Block 446, all corresponding displacements which remain for analysis in each round are combined for each sequence in the zone. As previously explained, it is convenient to combine displacements corresponding to adjacent displacements to produce virtual orthogonal displacements and combine these orthogonal displacements with corresponding diameters to produce virtual tangent pairs. As previously discussed in regard to TABLE I, two adjacent displacements are capable of producing a pair of virtual tangents from which the angle of a plane representing the displacement between similar features on three dipmeter signals may be derived. At this point in the illustrated FIG. 18, the combination of displacements is performed in accordance with those displacements still available (not nullified) for up to eight pairs of tangents resulting for each round from the four adjacent displacements and one diagonal displacement which are normally available from the four-pad dipmeter tool. When two diagonal displacements are available, four additional tangent pairs plus an additional tangent pair, which is real rather than virtual, may be derived to make thirteen tangent pairs available for subsequent analysis from a complete four-pad round. The process indicated as COMDIS is then concluded as indicated at Block 450 with the beginning of a further process indicated therein as CLASS, to be further described in regard to FIG. 19.

As an example of the process of combining corresponding displacements, consider now the following example:

$$d_{1\text{-}2} = -1.5'',\ d_{2\text{-}3} = -0.5'',\ d_{3\text{-}4} = 1.0'',\ d_{4\text{-}1} = 1.0''$$
$$d_{1\text{-}3} = -2.0'',\ d_{2\text{-}4} = 0.7''$$

In the above example, we find that the closure error is correct, i.e., there is no closure error as seen from EQ. (6 or 6A); i.e., that $-1.5-0.5+1.0+1.0=0$. The test indicated in Block 430 answers YES independent of either TD or GMD. However, there is a planarity error in the above example as can be calculated by EQ. (7A):

$$EP = -1.5+0.5+1.0-1.0 = -1.0.$$

Assuming that diameters $D_{1-3}=8''$ and $D_{2-4}=9''$, one can compute a geometrical mean diameter somewhat larger than 8" and less than 9" and in any case the planarity error of 1" exceeds 10% of this diameter value. Thus, the test indicated in Block 434 of FIG. 18 answers NO and the next procedure might be to determine which pad is closest to the top of the hole.

As an example, assume $\beta=13°$, indicating Pad 1 is the top pad and lies within 23° of the top of the hole, the test in Block 438 would answer YES, then the displacement ratio indicated in Block 440 would be computed for Pad 1. In accordance with TABLE II, the displacement ratio DR corresponding to the top pad equaling number 1, is given by the previously cited equation for DR. Substituting corresponding displacements, one finds that:

$$DR=(-0.5-1.0)/(-1.5-1.0)=(-1.5)/(-2.5)=0.60.$$

As expected in a floating pad situation, this ratio is less than one yet greater than 0.2 and results in the test indicated in Block 442 answering YES with the further result that displacements $d_{1-2}$ and $d_{4-1}$ are removed from further analysis. This would not prevent dips from successfully being computed within the round, because displacements $d_{2-3}$ and $d_{3-4}$ may be combined and in addition each may be combined with $d_{2-4}$ to produce a multiplicity of tangent pairs for this sequence.

For example, according to Table I, since we know displacements $d_{2-3}$ and $d_{3-4}$, as illustrated in Case 3 in TABLE I, the virtual orthogonal displacements $d_{1-3}^{v}$ and $d_{2-4}^{4}$, may be computed, respectively, as $$d_{1-3}^{v}=d_{2-3}-d_{3-4}=-0.5-1.0=-1.5''$$

$$d_{2-4}^{v}=d_{2-3}+d_{3-4}=-0.5+1.0=+0.5''.$$

Still further, since we know $d_{2-4}$ as well as $d_{2-3}$, we have a further possible combination illustrated as Case 10 in TABLE I. Here $d_{1-3}^{v}$ corresponds to $d_{2-3}-d_{2-4}=2(-0.5)-(0.7)=-1.7$. In addition, as in Case 11, $d_{3-4}$ in combination with $d_{2-4}$ produces an additional $d_{1-3}^{v}$ value equal to $-2\ d_{3-4}+d_{2-4}=-2(1.0)+0.7=-1.3$. Thus, these $d_{1-3}^{v}$ virtual displacements, in combination with the actual $d_{2-4}$ displacement and the $D_{1-3}$ and $D_{2-4}$ diameters produce two more pairs of tangents for further processing, as illustrated, for example, by the process starting at Block 450 of FIG. 19, which will now be discussed.

Referring now to FIG. 19 and Block 340 which continues from the previously described FIG. 18, this block corresponds to the start of a classsification procedure called "CLASS" as indicated therein. In brief, this procedure uses the correlation quality information associated with the displacement determination process to weight vectors resulting from combining possible corresponding displacements. These vectors represent angular relationships between two pairs of signals wherein one signal is common to both pairs. In the previously described procedure, corresponding pairs of displacements have been combined into a multiplicity of tangent pairs. Each tangent pair will be combined in this procedure to produce an x-y vector such that it may be weighted and classified in a two-dimensional classification array.

The classification process is performed on each possible combination within one correlation round or sequence, and on all the sequences belonging to a previously established zone. This zone may be used to provide an average tool position and a representative quality to serve as a basis to analyze the zone. Prior to classification, the vectors from each round may be rotated from their actual position to the average position of the tool over the zone.

The classification is performed by computing I and J cell address corresponding to the x and y vector components, respectively. The vector-to-cell address conversion includes the previously discussed translation of a three-dimensional vector into a two-dimensional vector in a manner such that the statistical characteristics of the three-dimensional vector are preserved in the two-dimensional classification system.

With the cell address determined, the weights associated with the individual vectors are added to the previous cell contents of the addressed cell, thus accumulating for each cell a weighted sum of the vectors that correspond to the cell address. Further, as previously described in regard to FIG. 11C, a technique is employed for compensating for the quantization of the vector in such a celled classification system. This compensation is obtained by smearing the effect of the vector into adjacent cells according to a predetermined pattern, which of course is also considered in the analysis of the relationship between the contents of adjacent cells.

It is also convenient during this classification procedure to test the contents of each cell against the previously determined quality value which may be regarded as a contour level for the zone. In the illustrated method, this contour level is determined by summing all the quality factors or weights for those displacement combinations, or in the illustrated case, tangent pairs still remaining in the zone. It will be recalled that, when the floating pad option is employed in the previous process, the displacements and tangent pairs associated with the floating pad are removed from the analysis and of course would be removed from consideration in determining the contour level.

When the contents of any cell is found to exceed the previous ly determined contour level, it is convenient to table the address of the cell, its content and the sequence number. When such a cell is found, a check is made to see if the cell address already has been tabled, thus preventing duplicate entries. For previously stored cells, the tabled cell content is merely updated. A check may be made to see if a new sequence is involved and, if so, the table entry if flagged to indicate that its contents are derived from a plurality of sequences.

When all of the combinations in each round and all of the sequences present in a zone have been processed as described above, the resulting classifications are further analyzed as indicated in a subsequent process which will be described later in regard to FIG. 20.

Referring now to FIG. 19 beginning at Block 450 which indicates the start of the process "CLASS", the initial step correspond to summing all the quality factors associated with all the sequence in the zone. For example, when the results from a dipmeter correlation process which describes only one quality factor for each sequence has been used as the input to the process as described in regard to FIG. 15A, the sum of these quality factors would be derived. However, when the process includes correlation, the individual quality factors for each correlation are available, these may be combined, like the displacements and summed.

The summation considers all displacement combinations and quality factors present in the zone which are to be classified to develop a normalized quality factor pertinent to the analysis which will follow. The summation may be performed by assigning and summing incremental values to various ranges for the quality factors, which of course will vary with the type of quality rating system employed. The summation may also include compensation for cases where some combinations of displacements should be given more weight than others, because more integrity can be assigned to that type of combination. For example, when actual diagonal displacements are employed in a given combination, its presence may be considered as contributing twice the usual weight as that of an adjacent displacement.

Similarly, the sum is adjusted in the case where several individual weights are present in a given round. In effect then, the process indicated in Block 460 of FIG. 19 represents accumulating representatives of all the quality factors which will be used as weights in the subsequent process, such that when properly adjusted for the number of confirming dips expected in the zone, will indicate meaningful accumulations of the better quality factors.

The next step in the process as indicated in Block 470 of FIG. 19 represents the determination of the best quality factor actually present in the zone, and is smilar to the process indicated in the previous block, except that the maximum value of all the quality factors is determined. It may be convenient to combine the processes illustrated in Blocks 460 and 470, as both are performed from the start of the sequence to the end of the sequence and include all such quality factors in the entire zone.

Then, as indicated in Block 472, the maximum and sum of the quality factors previously determined are compared. The comparison includes compensating the maximum and the sum so that they are comparable. In the illustrated case, this compensation includes taking three times the maximum value and comparing it with one-half of the sum value. If the former exceeds the latter, the illustrated test answers YES, and the former is assigned to a value subsequently used to contour the classification system, as will be later described. If the test indicated at Block 472 answers NO, indicating that SUM/2 is larger, this value is used to do the above mentioned contouring.

In either case, the contour level should correspond approximately to a level which readily distinguishes large accumulations of vectors with good quality weights from the smaller and less significant accumulations. For example, a contour level approximately equal to 50% of the usual maximum accumulation found for a zone of a similar number of sequences would be appropriate. As an alternate routine, which is not illustrated, the contouring could be delayed until the zone is classified, and the value of the actual maximum cell may be determined. The contour level could be set at approximately 50% of this value.

Returning now to Block 478 of FIG. 19, the actual classification of the displacement combinations in the zone begins by setting all of the cells in the classification array to an initial value which is preferably zero. However, any value which is appropriately considered in the subsequent processing may be used, as for example, an initial value of -CONTOUR. This value would result in cell contents which are negative below the contour level and positive above the contour level.

As illustrated next in Block 480, it is convenient to use two indicators, LS and LE, corresponding respectively to the sequence number at the start and end of the zone. These counters will be used to detect when the entire zone; i.e., all the sequence in the zone, have been processed. As will be recalled, the zone has been defined both in terms of the number of sequences present and the beginning and ending sequence numbers in the process referred to as "AUTOZONE", previously described in regard to FIG. 17.

Processing for each sequence begins as illustrated in Block 482 with the computation of a vector from each tangent pair in the round. It is convenient to express these vectors in terms of their x and y components which may be derived from the tangent pairs previously computed as described in regard to Block 446 of FIG. 18. Of course, it will be recognized by those skilled in this art that the x-y vectors may also be computed from the displacements, using the well known trigonometric relations appropriate for each particular displacement combination. The use of orthogonal tangent pairs, here $\tan(\theta_{1\text{-}3})=A$ and $\tan(\theta_{2\text{-}4})=B$, has the convenience and computational advantage that generalized relationships such as Equations 8 and 9 shown in FIG. 13B may be used.

In general terms, EQS. (8) and (9) become:

$$\tan(\theta') = \sqrt{[\tan(\theta_{1-3})]^2 + [\tan(\theta_{2-4})]^2} = \sqrt{A^2 + B^2}$$

and $$\tan(\phi') = \frac{\tan(\theta_{2-4})}{\tan(\theta_{1-3})} = B/A.$$

The process which computes the x and y vector components from these tangent pairs and which is convenient when used in combination with the previously determined rotation matrix to compensate for rotation within the zone will now be described.

The computation and rotation of the x and y components from each tangent pair in the sequence, as indicated at Blocks 482 and 484 of FIG. 19, may be conveniently performed in any order. It should be remembered, however, that these tangent pairs are in the three-dimensional system. When the dip vector is projected as illustrated by the projection previously discussed in regard to FIG. 10A, these components need to be transformed to two-dimensional components so they can be properly classified in a two-dimensional cell array. Further, the expected vector rotation should be considered.

Thus, in a programming sense, it is convenient and efficient to do the computations in a certain order and to keep the vector components in various forms for later combination. For example, it may be best to first square each tangent in the pair, then sum these squares, and store this sum, since this sum represents $\tan^2(\theta')$. In this form it is useful in the trigonometric identity:

$$\cos(\theta') = \sqrt{\frac{1}{1 + \tan^2(\theta')}}.$$

The usefulness of this identity will become apparent when $\cos(\theta')$ is related to the three-dimensional to two-dimensional transformation function illustrated in FIG. 10A which includes a sin $(\theta/2)$ term. Here, sin $(\theta'/2)$ has the identity:

$$\sqrt{\tfrac{1}{2}-\tfrac{1}{2}\cos(\theta')}.$$

Thus, sin $(\theta'/2)$ may be computed without trigonometric functions from:

$$\sin(e'/2) = \sqrt{0.5 - \frac{0.5}{\sqrt{1.0 + A^2 + B^2}}}$$

For later use in rotation, the cosine and the sine of the apparent azimuth $\phi'$ may be computed from tan $(\theta')$ (the square root o the $A^2+B^2$ sum.) and tangent pairs A and B. These relations are:

$$\cos(\phi')=A/\tan(\theta')$$

$$\sin(\theta')=B/\tan(\theta').$$

The sine and cosine are useful in this form in the rotation matrix previously derived in regard to Block 420 of FIG. 18 because the rotation equations correcting x and y vector components are:

$$X'=RM1\cos(\theta')-RM2\sin(\theta')$$

and $$Y'=RM2\cos(\theta')+RM1\sin(\theta')$$

These later equations may now be re-written as:

$$X' = \frac{RM1A}{\tan(\theta')} - \frac{RM2B}{\tan(\theta')} \qquad \text{(EQ. 15)}$$

$$Y' = \frac{RM2A}{\tan(\theta')} + \frac{RM1B}{\tan(\theta')} \qquad \text{(EQ. 16)}$$

These vectors also carry the superscript because they correspond to components relative to the coordinates of the tool, rather than the usual geographic coordinates.

Thus, referring to Block 484 of FIG. 19, the components of the vectors indicated in Block 482 may be actually computed using EQS. (15) and (16) above, which include the rotation of RM1 and RM2 corresponding to the average position of the tool over the zone. After the rotaion and as indicated in Block 486, the I and J addresses of the classification cell are computed for each vector. As previously discussed, it is convenient to express these addresses in terms of the sin $(\theta'/2)$ transformation.

From FIG. 10A, it is apparent tht the relation $r=R\sqrt{2'}\sin(\theta/2)$ acts as a scaler for the x and y components over a range of $\pm R$ from the center of the sphere or circle of radius R. Since the indices for the corresponding classification system shown in FIG. 11A start at the edge, rather than the center, these indexes are also biased by R and become:

$$I=R+rX' \qquad \text{(EQ. 17)}$$

and $$J+R+rY' \qquad \text{(EQ. 18)}$$

where X' and Y' were computed using EQ. (15) and EQ. (16) respectively. R for the illustrated 51 by 51 cell array is 26.5. The constant $R\sqrt{2'}$ then becomes 36.0624. Combining the above with the previously described identity for sin $(\theta/2)$, produces an efficient relation for r which becomes:

$$r=36.0624\sqrt{0.5-\tfrac{1}{2}\cos(\theta')'}.$$

The classification procedure discussed above and illustrated in Blocks 482–486 in FIG. 19 will now be demonstrated by the following example. Consider for now only one pair of orthogonal displacements from a given sequence. They may be real or virtual and in any case represent only one pair from as many as thirteen possible pairs in a complete round (see Table I) for the four-pad tool in the given sequence. Thus it will become apparent that use of efficient relationships is important:

$$\text{EXAMPLE}\left\{\begin{matrix} d_{1-3} = -13.07, D_{1-3} = 10.1, RM1 = 0.99500 \\ d_{2-4} = +19.11, D_{2-4} = 11.4, RM2 = 0.09987 \end{matrix}\right.$$

$$R = 26.5 = (51 + 1 + 1)/2$$

| STEP | EQUATION | EXAMPLE RESULTS |
|---|---|---|
| 1 | $A = d_{1-3}/D_{1-3}$ | $= -13.07/10.1 = -1.294$ |
| 2 | $B = d_{2-4}/D_{2-4}$ | $= +19.11/11.4 = 1.676$ |
| 3 | $\tan^2(\theta') = A^2 + B^2$ | $= (-1.294)^2 + (1.674)^2 = 4.483412$ |
| 4 | $\tan(\theta') = \sqrt{\tan^2(\theta')}$ | $= \sqrt{4.483412} = 2.1174069$ |
| 5 | $\cos(\phi') = A/\tan(\theta')$ | $= -1.294/2.1174069 = -0.61112$ |
| 6 | $\sin(\phi') = B/\tan(\theta')$ | $= 1.676/2.1174069 = +0.79152$ |
| 7 | $X'\left\{\begin{matrix} = RM1\cos(\phi') \\ RM2\sin(\phi') \end{matrix} -\right\} = \left\{\begin{matrix} 0.09500(-0.61112) \\ 0.09987(+0.79152) \end{matrix} -\right\}$ | $\left.\begin{matrix} -0.6080644 \\ -0.079052 \end{matrix}\right\} = -0.687116$ |
| 8 | $Y'=\left\{\begin{matrix} RM1\cos(\theta') \\ RM1\sin(\theta') \end{matrix} +\right\} = \left\{\begin{matrix} 0.09987(-0.61112) \\ 0.99500(+0.79152) \end{matrix} +\right\}$ | $= \left\{\begin{matrix} -0.0610349 \\ +0.7875624 \end{matrix}\right\} = +0.726527$ |

-continued $$\text{EXAMPLE}\left\{\begin{array}{l} d_{1-3} = -13.07,\ D_{1-3} = 10.1,\ RM1 = 0.99500 \\ d_{2-4} = +19.11,\ D_{2-4} = 11.4,\ RM2 = 0.09987 \end{array}\right.$$

$$R = 26.5 = (51 + 1 + 1)/2$$

| STEP | EQUATION | EXAMPLE RESULTS |
|---|---|---|
| 9 | $\left\{\begin{array}{l} \frac{1}{2}\cos(\theta') = \\ 0.5/\sqrt{1+\tan^2(\theta')} \end{array}\right\}$ | $= \left\{\sqrt{\frac{0.5}{1.0 + 4.483412}}\right. = 0.21352$ |
| 10 | $r = R\sqrt{2}\ \sqrt{0.5 - \frac{1}{2}\cos(\theta')}$ | $= 36.0624\sqrt{0.5 - 0.21352}$ <br> $= 36.0624 \times 0.53524 = 19.301976$ |
| 11 | $I = R + rX'$ | $= 26.5 + 19.301976(-0.687116) = 13.2373$ <br> $= 13$ |
| 12 | $J = R + rY'$ | $= 26.5 + 19.301976(0.726527) = 40.5234$ <br> $= 40$ |

At the top of the above tabulated example are given values for the orthogonal displacement $d_{1\text{-}3}$ and $d_{2\text{-}4}$, the corresponding diameters $D_{1\text{-}3}$ and $D_{2\text{-}4}$ and the rotation matrix coefficients for the zone RM1 and RM2. Also given is a value of R corresponding to the illustrated $51 \times 51$ cell array. It is understood that other size arrays could also be used, perhaps as an alternative to the previously described cell smearing technique, for example.

The first two illustrated steps in the example correspond to computing the tangent pairs, A and B. Recall that this step was previously discussed in regard to Block 446 of FIG. 18. Each of the tangents is computed simply by taking the ratio of the diagonal displacements to the corresponding diameters, which results in values of $-1.294$ and 1.676. While A and B are related through appropriate trigonometric relations to the desired x and y components of the dip vector, the steps that follow illustrate that the use of trigonometric functions are not required at this point.

For example, in Step 3 of the example, it is convenient to compute the value of $\tan^2(\theta')$ as the sum of the squares of the tangent pairs, which in this case equals 4.483412. In the next step, it readily follows that the tan $(\theta')$ may be easily obtained by taking the square root, which results in the value 2.1174069. This result is used in the next two steps to compute the sine and cosine of the apparent azimuth value $\phi'$ by simply dividing the values of A and B, respectively, by the above result. Accordingly, in Steps 5 and 6 cos $(\phi')$ equals $-0.61112$ and sin $(\phi')$ equals $+0.79152$.

It will be appreciated that these cosine and sine values correspond to untransformed and unscaled x and y vector components when no rotation correction is required, as would be illustrated where RM1 equals 1.0 and RM2 equals 0. However, it is best to make a rotation correction for rotation within the zone. The nonimal values of RM1 and RM2 correspond to the average tool position in the zone. Steps 7 and 8 correspond to correcting the above cosine and sine values to this position and produce the x and y components which, in this case, have the values of $-0.687116$ and $+0.726527$, respectively.

As previously discussed with regard to FIGS. 10A and 10B it is preferred that the classification system preserve equal area properties which requires an additional transformation from the three-dimensional system to the two-dimensional classification array Step 9 corresponds to computing a coefficient used in this transformation and as previously described, relates to a trigonometric identity for the sin $(\theta'/2)$ transformation below. The equation used in Step 9 utilizes the interim result obtained in Step 3, corresponding to $\tan^2(\theta')$, thus facilitating this evaluation, which in this case yields $\frac{1}{2}$ cos $(\theta') = 0.21352$. This factor is then used as given in Step 10 to complete the scaler r which includes the previously discussed constant, $R\sqrt{2} = 36.0624$. The scaler r varies with each value of $\theta'$ and as given in Step 10 equals 19.301976.

Steps 11 and 12 of the tabulated example remain and relate to the computation of the I and J cell addresses indicated in Block 486 of FIG. 19. Steps 11 and 12 add the index bias R to the previously computed x and y vector components after they have been rescaled by the scaler r computed in Step 10. As illustrated in the example, this operation results in a value with some significant digits remaining to the right of the decimal point. However, the truncation operation associated with creating integers drops any significance for digits less than one, producing the resulting value of I of 13, and J of 40. Thus, the final values of I and J given in this example are I equals 13 and J equals 40. When used as subscripts of a two-dimensional array which one might choose to label of CELL, the corresponding cell becomes CELL(13,40).

Referring now to Block 488 of FIG. 19, the previous contents of this cell would be read and the weight of the current vector added to its previous contents and restored in the same cell.

As previously described in regard to FIGS. 11B and 11C, it is desirable to smear the effect of vectors falling in one particular cell into given adjacent cells. Thus, in addition to the above-described process performed on the example CELL(13,40), cells to the right, below and lower right all are treated in a similar fashion. These cell addresses are respectively, (13,41), (14,40) and (14,41). As illustrated in FIG. 11D, the quality factor weight illustrated there as WT=4 as an example is added to each of the above four addressed cells in the process illustrated in Block 488 of FIG. 19.

Then, as indicated in Block 490 of FIG. 19, or during the above addition process, the contents of each of the four addressed cells is compared with the previously determined contour level. If the contents of any of these four cells exceeds this contour level, a convenient tabulation, as shown in Table IIIA, is made of the cell addresses, the current contents of the cells and, temporarily, the originating sequence number, as indicated by the process shown in Blocks 492 through 496 of FIG. 19.

As shown in Block 492, when a cell is addressed for the first time within the zone, as indicated by this test answering YES, its address (Block 493) and content (Block 496) are stored. However, to prevent the possibility of a single sequence creating a cluster or group of classifications out of the many vectors within this one round, the sequence number which first generated this address may be also stored as is also shown in Block 493. Then if additional sequences also contribute to this cell, as would be indicated if the test shown in Block 494 answered YES, this sequence number could be replaced with a flag indicating that the contents of this cell did not result from a single sequence.

If the same cell was addressed subsequently with only the same sequence number, the test indicated by Block 494 would only answer NO and this sequence number would remain, indicating the single sequence case. As previously explained in regard to FIGS. 7B and 7C, a dominant signal feature is expected to repeat for several overlapping correlation intervals or sequences. Thus, such a single-sequence cell should not be the sole basis for a reliable cluster. The above procedure allows subsequent detection of such cells, as will be explained in regard to Block 534 of FIG. 20.

Referring again to FIG. 19 and Block 490, if the individual contents of none of the above addressed cells exceed the contour, the test in Block 490 answers NO and the process continues to the test indicated in Block 497. It is then determined if all of the zone has been processed and if not, the test answers NO and the next sequence is considered by incrementing the level or sequence counter as shown in Block 498. This sequence is then processed as described above, until all of the sequences in the zone have been processed, as indicated by the Block 497 test answering YES. At this point, the classification system is ready for analysis, as all of the possible combinations of displacements from the zone have been classified. The subsequent analysis process will be described in regard to FIG. 20.

Referring now to Table IIIA, there is shown a simplified example of the information generated and stored as the result of the process just described in regard to FIG. 19. Illustrated are six entries, their corresponding I and J cell addresses, the accumulated contents of these cells and, in some cases, the sequence number which first generated the cell address for this zone. Also shown is a cell link which will be described later in regard to FIG. 20.

Recalling the determination of the contour level, designated CONTOUR, as shown in FIG. 19, and determined as illustrated in Blocks 460 through 476 thereof, and that the I and J cell addresses computed as illustrated in Block 486 and their contents accumulated as indicated in Block 488, are not entered into a cell table unless as indicated by the test in Block 490, the contents exceeds CONTOUR Since all the cell contents illustrated in Table IIIA are at least eight, the contour level for the illustrated zone is indicated to be less than eight. These contents, however, could result from weights accumulated from several vectors which were previously processed, perhaps for example, with weights of 4 and 4, or 2, 4 and 2. Thus, these cell contents are not indicative of the number of vectors actually contributing to the cell. If this information is required, it may be accumulated in an additional 51×51 cell array in which, rather than accumulating weights, the number or count of corresponding vectors is stored.

Table IIIA, as illustrated, includes some additional simplifications. For example, in order to uniquely determine that only one sequence contributed to a given cell, the sequence number stored as indicated in Block 493 of FIG. 19 and shown in Table IIIA should be considered when the first contents are placed in the cell as well as when the contents exceed CONTOUR. As illustrated, sequences contributing to the tabled cell before its contents exceeded CONTOUR are ignored for purposes of simplicity. Further, for the six table entries illustrated, only entry numbers 1 and 6 still have their original sequence numbers, indicating that only sequence numbers 11 and 13 contributed to these entries, respectively.

The remaining entries have had their sequence numbers altered to a flag value of "0", indicating the test in Block 494 of FIG. 19 answered YES on at least one occasion resulting in this flag as indicated in Block 495.

Referring now to the right-hand column of Table IIIA, which is labeled "CELL LINK" there is shown an indicator useful in grouping adjacent cell addresses to determine classes or clusters of cells. For example, entries Nos. 1 and 2 both have the same cell link; e.g., "1", indicating that adjacent cells are also present in the table. In this case, it is readily apparent that entries 1 and 2 are adjacent since the I indices are adjacent integers 13 and 12, respectively, while the J index is the same, e.g., "19". Similarly, entries 3, 4 and 6 which are indicated as having a cell link equalling 3, are found to be adjacent when examining their I and J addresses. Entry 5 is indicated as having a cell link of 5 but for purposes of simplification, the adjacent cells for this entry have not been shown.

CELL LINK indicators shown in Table IIIA may be utilized to rearrange the table as shown in Table IIIB. This arrangement results from sorting the table on the CELL LINK indicator. Table IIIB indicates the resulting arrangement when the cell links are arranged by groups of increasing link numbers. Now, for example, Entry 6 of Table IIIA appears with Entries 3 and 4 which are adjacent cells, and Entry 5, which is not adjacent to the above cells, appears as the last entry. It is therefore apparent that groups of adjacent cells each having contents which exceeded CONTOUR now are indicated by similar link numbers which allow grouping these cells into clusters.

Table IV illustrates how these classes of linked or adjacent clusters of cells may be further defined in terms of boundaries expressed as maximum and minimum I and J address ranges for groups having like link numbers. Recall now that the minimum I value would correspond to the left-most boundary, the maximum I value would correspond to the right-most boundary, the minimum J value to the top boundary and the maximum J value to the bottom boundary of a rectangular area, in a cell system such as shown in FIG. 11A. Thus, these boundaries are indicated, respectively, by the letters L, R, B, and T in Table IV. For example, cells with link numbers equaling 1 form a cluster having left and right boundaries of I=11 and 13, and top and bottom boundaries of J=18 and 19, respectively. Note here that the left-hand and top boundaries have both been decreased by one cell to the left and to the top, respectively from the previous minimum index values of 12 and 19. This decrease compensates for the smearing effect previously described which, it will be recalled, was in the opposite directions, affecting the right and bottom boundaries. Further note, in Table IV, that the quantity indicated as "CLUSTER SUM" for the above bounded cluster exceeds the contents of the two cells for entries 1 and 2 illustrated in Table IIIB. This is because the boundaries indicated in Table IV include many additional cells. All the cells within the left-right and top-bottom boundaries are included in the "CLUSTER SUM". The remaining entries in Table IV will be explained further in regard to FIG. 21.

Referring now to FIG. 20 and Block 500 which continues from previously described FIG. 19 and corresponds to the start of the process "ANALY" indicated therein. It is the purpose of the procedure which follows to analyze the various classifications corresponding to the accumulated displacement combinations. These classifications result from the previous processing of all such possible combinations within each sequence and for all sequences within the zone to be analyzed. In particular, the analysis may be facilitated by use of the previously generated information such as illustrated in Table IIIA.

In this process, the addresses of cells containing accumulated weights greater than a given value, such as CONTOUR, are compared to determine which cells may be grouped into clusters of adjacent cells and thereby indicate a statistically significant class of dip vectors. It will be recognized that a given zone may produce several such clusters at different locations in the classification system. Further, the size and shape of each of the clusters may vary. Therefore, the location of the clusters may best be defined in terms of their boundary index values. In addition, the relative importance of the several clusters which may result from processing a given zone will vary and accordingly, these clusters are ranked to indicate their order of importance. As illustrated, this ranking may be performed by summing the weights accumulated in all of the cells within the boundaries of each cluster.

The above cluster location, boundary definition and ranking process may use an intermediate classifier designated herein as "LINK" to designate cells which are linked in adjacent cell fashion, as indicated by their I and J index values. Adjacent cells are assigned a common link number which is used to sort and further group the adjacent cells into provisional clusters. The I and J boundaries of these clusters are then defined. A flag used to indicate that more than one sequence has made contributions to a given cell may then be examined for all the cells within the cluster boundary. If it is indicated all the cells resulted from the same sequence, the provisional cluster is deleted as having no confirming support from other adjacent or nearby sequences within the zone. The remaining clusters are then ranked in accordance with the sum of the accumulated weights of all the cells within its boundaries. This ranking determines which cluster is dominant and the order of importance of the remaining clusters. This ranking is useful in a retrieval process which follows and which is illustrated in FIG. 21.

Referring now to FIG. 20, an initial step in the analysis process is indicated in Block 502 and corresponds to zeroing the cell linking classifier CELL LINK, for each of the cells to be considered as forming a possible cluster. These cells, of course, have been indicated in the process described in regard to FIG. 18 and are illustrated in Table IIIA. Thus, initially, the entries in the column labeled "CELL LINK" in this table are set to zero.

Next, as indicated in Block 504 of FIG. 20, the initial value of two counters, LINK and K, are assigned here as 0 and 1, respectively. Then, as shown in Block 510, the cell link class for entry K is tested. Entry K serves as a base cell for the adjacent cell testing which follows. Here for the first time, $K=1$ and corresponds to the first entry as illustrated in Table IIIA. If the original CELL LINK for this entry remains which, as indicated in Block 502, would be "0", the test indicated in Block 510 answers YES and the process continues to Block 512 where a new LINK value is obtained as illustrated by incrementing this LINK value. Since its initial value was 0, the first value of LINK actually used in the subsequent process is 1.

Then, as indicated in Block 520 of FIG. 20, the I and J addresses of the base cell tabled as Entry K are used to locate all other cells within $I\pm1$ and $J\pm1$, which are the cells adjacent to Entry K. For each such adjacent cell, the current value of LINK is also assigned to the cell link class. As illustrated in Table IIIA for $K=1$, only Entries 1 and 2 are found to be adjacent and are assigned the $LINK=1$ class.

The above adjacent cell address comparison and link assignment process is performed on all entries in the table. Then the next table entry is used as an adjacent cell test base, as indicated by Block 522, which increments K to the next entry, and Block 524 which tests to see if all entries have been processed. When entries remain, this test answers NO and the process continues to the previously described link entry test indicated as Block 510.

For subsequent entries, it is now possible that the initial cell link class has been replaced by a previous value of LINK. In this case, the test indicated in Block 510 would answer NO, and as indicated in Block 514, the previous LINK class would be used for this entry in the process which follows as shown in Block 520.

As indicated in Block 520 of FIG. 20, each entry in turn is considered, and its I and J addresses used to determine adjacent cells; i.e., cells lying within one cell above, below, to the left or right, or within diagonal combinations of the above adjacent locations, as indicated by the $I\pm1$ and $J\pm1$ address variations. If the K entry used to determine I and J has been previously assigned a cell link class, any new adjacent cell determined in this process would receive this same cell link class, since it was not changed as indicated in Block 514 above. However, it Entry K had not been previously determined to be adjacent to any prior entry, as would be indicated by the original CELL LINK class of "0", a new CELL LINK class, as indicated by LINK and determined in Block 512 above, would be assigned at this time. In turn, and as indicated in Block 522, each entry is similarly considered as Entry K and assigned either a previous value of LINK or a new value indicating a new class of adjacent cells. Finally, when all entries have been so considered, the test indicated in Block 524 answers YES and these cell link classes are used to sort the resulting groups of adjacent cells as shown in Block 530.

In this subsequent sort and as illustrated in Table IIIB, the above cell link classes form the basis of a well known sorting procedure which will not be described here, but which results in collecting together those entries having common cell link class. As shown in Table IIIB for three different cell link classes, three groups of entries are formed. Then, as indicated in Block 532, and I and J addresses are each considered separately for each such group to determine the maximum and minimum range for each of these indices.

For example, the maximum range for those entries having a cell link of Class=3 is 16 for I and 24 for J. The minimum values for this group are 15 and 23. Note, however, in Table IV for the class with CELL LINK=3, the minimum I and J values are shown in 14 and 22, respectively. Thus, the actual left and top boundaries of 15 and 23 have been adjusted to compensate for the cell smear technique previously discussed. Thus, the boundaries of those adjacent cells indicated by CELL LINK=3 are determined to be from I=14 to 16 and from J=22 to 24, inclusive, which, in this case, forms a square cluster. This need not be the case, as illustrated by the class of adjacent cells having CELL LINK=1, for example. In fact, rectangular clusters are common occurrences. In most cases, however, clusters are usually small and for the 51×51 cell representation are only a few cells in each dimension.

As previously discussed, an additional requirement may be made to eliminate those clusters which have been derived from a single level or sequence. Thus as indicated in Block 534 of FIG. 20, a test is made on the previously stored sequence number associated with the sequence which made the original contribution to the cell. This test is made on each of the cells within the now-known boundaries for the cluster. If all the cells within the cluster boundaries still have the same sequence number, it would indicate that the entire cluster is comprised of cells and smeared cells originating from the same sequence. If this is the case, the test indicated in Block 534 would answer YES, and as indicated in Block 536, this cluster would be deleted from further consideration.

However, if the sequence numbers show that two or more different sequences were indicated as contributing to two or more different cells within the cluster boundaries, or that at least one cell with the cluster was flagged to indicate a plurality of sequences contributed to that cell, then confirmation of this cluster is assured from more than one sequence within the zone. In this case, the test indicated in Block 534 of FIG. 20 would answer NO, and the cluster would be considered for further analysis in Block 540.

Finally, in an analysis process, and as indicated in Block 540 of FIG. 20, the sum of the contents of all of the cells within the cluster boundaries is derived for each cluster. These sums are indicated for each cluster in Table IV in the column labeled "CLUSTER SUM". These sums need be obtained only for each cluster remaining in the analysis. They are then used to rank these clusters in accordance with these sums, with the cluster having the largest sum ranked first and the clusters wth lesser sums ranked in order proceeding to the cluster with the least sum, which is ranked last. This ranking is also indicated in Table IV.

The remaining column in Table IV labeled "SEQ. NO." as in Tables IIIA and IIIB, illustrates the single sequence cluster case. Note that while the first entry in Table IIIB corresponding to CELL LINK=1 had a sequence number equal 11. The second entry which had the same cell link class indicated by the "0" value flag for its sequence number that more than two sequences contributed to this cell. Thus, for the cluster common to CELL LINK=1, the single sequence indicator "11" is of no further value and the sequence number indicator for the cluster is flagged, like Entry 2, as "0".

However, for the single entry and cluster corresponding to CELL LINK=5, no additional sequence numbers or flags were found for this cluster with the result that the sequence number "13" remains, indicating that all the cells (which are not shown as entries in these simplified tables) in the entire cluster is from the same sequence. As previously discussed in regard to the test indicated in Block 534, this cluster would be deleted as indicated in Block 536 and its cluster sum need not be obtained. Thus, in the illustrated case, only two clusters remain to represent the zone and to be further considered in the retrieval process which begins next as indicated in Block 550 of FIG. 20. This process will be described in regard to FIG. 21.

Refer now to the process labeled "RETRV" and illustrated in FIG. 21 which begins at Block 550, and continues from this block as illustrated in FIG. 20. Recalling now that in the previous process, a zone consisting of several sequences has been defined and submitted for classification and analysis. Each possible combination of displacements resulting from the round of correlations in each sequence has been combined to produce a multiplicity of tangent pairs corresponding to possible dip vectors. For each such vector, an I and J cell address was derived and used to classify the vector. Thus, for a given sequence, a plurality of such vectors and I and J cell addresses has been derived and stored, if storage capacity permitted. Using the I-J cell classification system, each vector was classified by accumulating its weight in the corresponding CELL (I,J).

After all vectors in each sequence and all sequences in the zone have been so classified, the final cell contents are analyzed to determine classes of adjacent cells containing large accumulations of such weights. The boundaries of these classes or clusters of adjacent cells have then been determined along with the assurance that no class was derived from a single sequence. Each remaining class or cluster was then ranked, the final result of the previous processing being a series of clusters ranked in accordance with their content, and with the boundaries of each such cluster determined as ranges of I and J index values.

In the process which follows, the previously derived I and J addresses corresponding to each vector in a given sequence are retrieved, or if necessary, re-computed. These I and J cell addresses are then compared with the I and J boundaries for the highest ranking cluster. If the individual vector previously contributed to this cluster as indicated by its I and J addresses, this is noted by increasing a count for the given sequence and by summing the weights for such vectors. This process is repeated for each vector in the given sequence to determine the number of vectors from the sequence which contributed to the highest ranking cluster.

If at least one vector from this given sequence contributed to the highest ranking cluster, corresponding dip and azimuth values for this sequence are determined from the average of all of the vector components from this sequence which contributed to this cluster. These dip and azimuth values may be considered, in one form of the invention, as the final value for this sequence. However, in another form of the invention wherein several dip and azimuth values from adjacent sequences are pooled into a single value, the above result would merely contribute to the final dip and azimuth values. In any case, these values for this sequence may be stored at this time.

If, however, in comparing the I and J addresses for the individual vectors corresponding to a given sequence with the boundaries of the highest ranking cluster, no vectors from this sequence are found to have contributed to this cluster, two alternate procedures may be considered. The first procedure correspond to expanding the size; i.e., enlarging the boundaries of the cluster. If this procedure is optioned, the range of I and J values corresponding to the boundaries of the cluster are expanded by a given cluster expansion coefficient, KE, and the previous process repeated. If contributions from this sequence are now found within this expanded cluster, the result for this sequence is taken from these contributing vectors.

In the case where no contribution is found from any vector in a given sequence, either within the original boundaries or the expanded boundaries of the highest ranking cluster, lower ranking clusters would be considered in turn in the order of their decreasing importance or rank. If, however, none of the clusters nor expanded clusters corresponding to the zone received contributions from a given level, this level would be considered as unreliable and dip and azimuth values would not be computed for this sequence.

When all of the sequences comprising the given zone under consideration have been processed as described above, a dip and azimuth value is available for each sequence which contributed to, first, the dominant class or cluster, or, if not, at least, to one of the lesser classes or clusters representing the zone. Since the use of overlapping correlation intervals is preferred, a substantial number of such results are available and it may be desired to reduce the quantity while improving the quality of such results by pooling the dip and azimuth values from nearby sequences which do not vary from one another to any large extent.

In this case, the stored dip and azimuth results for each sequence may be retrieved and compared for adjacent sequences. The difference between the dip values and the azimuth values in adjacent sequences may be computed and each difference compared to a given tolerance considered permissible to allow the pooling of the results. If substantial differences are indicated in either the dip or azimuth results for adjacent sequences, these results will not be pooled into a result representing neither sequence. Rather, the two different results are output. However, if substantially the same result is indicated for a number of adjacent sequences, these results may be pooled as a single result for all such sequences. All of the sequences within the zone may be so considered, resulting in possible output for a number of individual sequences and one or more pooled sequences.

The output may take place in several forms, varying from conventional tabular listings, which may include various quality factors which now, of course, might include the rank of the cluster corresponding to the dip and azimuth values, the count of the number of individual vectors which contributed to the result, and in the case of pooled results, the deviation of both the dip and azimuth values which contributed to the pooled result. In addition, it may be interesting to output the nature of the zone; i.e., stable or unstable, and the number, size and characteristics of each cluster found while analyzing the zone. In addition to these tabular outputs, various graphic presentations which are well known in this art may be made with improved results. FIG. 22 allows a comparison of the results presented in the form of arrow plots with and without the above processing.

Referring again to FIG. 21, Block 552 indicates some initial values which may be either input or incorporated in the programming procedure. Illustrated are: KE = 1, corresponding to an indication to allow a one cell expansion in the cluster expansion technique previously described and further described herein in regard to Blocks 602 and 604; NPL, corresponding to a maximum number of adjacent sequences which may be pooled into a single result and which in this case is indicated to be 4; POOL, here shown as equaling 1, which indicates, like NPL > 1, a desire to pool the results from a given zone, and where a zero would indicate no pooling was desired; and DTOL, here indicated as 3° which is the permissible dihedral angle between results for adjacent sequences which would allow them to be pooled into a single result. As indicated by optional Branch 554, it is optional how these initial values are established in this procedure.

As indicated by optional Branch 556 of FIG. 21, as previously discussed, it may be desired to output previously derived information in regard to this zone in the form of a cluster plot, as illustrated by FIG. 12 and which may include tables such as TABLE IV. The programming necessary to create such a graphic output on an output device such as a line printer is well known by those skilled in such art, but in brief, it is convenient to divide the plot into symmetrical octants or quadrants in order to create the general grid which of course should correspond as close as possible to that shown in FIG. 10B. Various characters may be used to indicate the divisions of the grid. Usually the grid is not output but now stored temporarily in a number of storage locations corresponding to the divisions of the plot until the entire plot is ready for output.

The classification system is then scanned systematically from cell to cell, for example, by increasing either the I or the J index value while holding the other index constant. A numerical value corresponding to the contents of the cell is determined and converted into a graphic representation or output character corresponding to this value, which is entered into the previously mentioned storage at a location corresponding to the cell. This location may already be occupied by output characters representing the grid. Where previously blank or grid characters are indicated, representations of the cell contents are now placed.

Further, since the average position of the tool is known, this position may be designated and included in the output. Normally, the position of magnetic North (or South) and the position of the top (or bottom) side of the borehole are indicated. Since all of the other information is related to the position of the tool, these indications are useful in converting the position of clusters into the more normal geographic references.

The optional cluster plot output is indicated by Block 560 of FIG. 21, but may be included in any point of FIG. 21. As illustrated, the process would continue by returning through optional Branch 562 to begin with the initializing process for retrieving the sequences in the zone as indicated in Block 580. Here, two indicators shown as LS and LE are conveniently used to monitor the processing of each sequence between the start and end of the zone. The indicator LS is set to designate the first sequence in the zone and the indicator LE the last. Then, as indicated in Block 584, the highest ranking cluster is designated by the indicator NRANK = 1.

As previously described and indicated in Block 586, the I and J cell addresses for each of the vectors in a given sequence, here indicated by LS, are retrieved or, if necessary, re-computed. For example, with a four-pad tool as illustrated in TABLE I, thirteen such vectors and corresponding addresses may be available for each sequence. Then, as illustrated in Block 588, the I and J addresses for each of these vectors is compared to the maximum and minimum ranges for the I and J index boundaries of the cluster whose rank is designated by the NRANK indicator.

Initially, for each sequence, the highest rank cluster is considered. Both the count and a sum is made of each vector from the sequence falling within the above cluster boundaries. The sums may correspond to not only the summing of each of the vector components but also to the summing of the weights of each vector.

After all vectors within sequence LS have been so considered the above derived count is compared as indicated in Block 590 to determine if any vectors from sequence LS fell within the boundarie of cluster NRANK; i.e., had this sequence contributed to any cell in this cluster. If there has been a contribution from this sequence, the test indicated in Block 590 of FIG. 21 would answer NO and the process continue as indicated in Block 592 to compute the dip and azimuth value corresponding to this sequence from the previously accumulated vector component sum and the individual relative bearing, deviation angle and azimuth values of the tool corresponding to this sequence. This computation is well known and will not be explained further here.

Then, as indicated in Block 594, these results may be stored and referenced to this sequence. As previously explained and as will be further explained in regard to pooling, these results may not represent the final results.

As indicated in Block 596 of FIG. 21, each sequence within the zone is so analyzed until the test indicated in this block determines that all sequences within the zone have been analyzed. As illustrated, this would correspond to LS=LE. If this is not the case, the test indicated therein would answer NO and the process would continue by increasing the sequence indicator LS by one as indicated in Block 598 and the process previously described would be repeated for this sequence, beginning again as indicated in Block 584 with the highest ranking cluster.

If, however, the test indicated in Block 590 of FIG. 21 found that for any sequence no vectors contributed to the highest ranking cluster as indicated by a COUNT="0", the test indicated therein would answer YES and the process would branch as indicated by Line 600 to Block 602 where it would be determined if cluster expansion is permissible. As indicated therein, two conditions may be used, the first indicated by assigning a value larger than 0 to the coefficient KE which corresponds to the number of cells by which the current cluster may be expanded for reconsideration. The second condition is indicated as CODE greater than 1 which, it will be recalled, corresponds to a stable zone; i.e., cluster expansion might not be considered for unstable or gapped zones which are indicated by a lesser code. In which case, the test would answer NO and no cluster expansion would take place.

However, if as indicated in Block 602, KE is greater than 0 and CODE is greater than 1, the process continues to Block 604, temporarily increasing the maximum and minimum ranges of the I and J indices used to define the boundaries of the current cluster. This expansion, as indicated, could correspond to increasing the the cluster by KE cells on each side. The process previously considered for this sequence, as indicated in Block 588, would then be repeated for these additional cells, again to determine if any contribution is made from this sequence.

If even this falls, as indicated by a YES answer to the test indicated in Block 590 and a NO answer to the test indicated in Block 602, the process may continue as indicated to the test in Block 607, where it is determined if the current cluster corresponds to the least ranking cluster as would be indicated by NRANK=LRANK. In the initial case in zones where there is more than one cluster, this test would answer NO, since only the highest ranking cluster had been considered to this point. The process would continue as indicated to Block 608 where the rank indicator NRANK would be increased to indicate the next cluster in the order of importance. The process would continue again as indicated to Block 588 to consider now the second most dominant cluster. If no contribution from sequence LS was found to this cluster with or without expansion, the next ranking cluster would be considered until all clusters representative of this zone had been processed as indicated by NRANK=LRANK, after which the test indicated in Block 607 would answer YES.

In the case where even the least ranking cluster has not been contributed to by the instant sequence, no valid answer may be computed for this sequence and this condition is so indicated as shown in Block 610. This indication is stored like the results for this sequence would have been if a contribution was found, and as shown in Block 594, completing the process for the sequence at this time.

If, for example, it is desired only to obtain dips corresponding to the dominant cluster for the zone, as may be the case when structural dip is sought, the process could proceed as indicated by optional Branch 606 directly to Block 610 without considering lesser ranking clusters as indicated in Blocks 607 and 608. Thus, the options indicated by Blocks 602 through 610 may be used to: allow cluster expansion, particularly when stable zones are indicated; consider clusters of lesser rank; or consider only the dominant cluster to determine dip and azimuth values for the individual sequences in the zone. Since at least some of the sequences must have had vectors corresponding to at least the dominant cluster, dip and azimuth values are assured for at least some of these sequences, and therefore, for the zone.

An additional method of reducing the number of dip and azimuth results, other than by utilizing the above options, is to pool the resulting dip and azimuth values from adjacent sequences. The test indicated in Block 620 of FIG. 21 indicates the selection of this option and, if desired, the indicator POOL or, for that matter, the indicator NPL, would be given a value different from 0. If "0", for example, the test would answer NO and the process would proceed directly to Block 660, beginning at Point AA and bypassing Blocks 662 through 656. However, if pooling is desired, the test indicated in Block 620 will answer YES and the process will proceed by initially resetting the sequence designator LS as shown in Block 622 and begin the pooling process as shown in Block 630.

The pooling process may be performed using the dip and azimuth values as previously described but is preferably done using vector components so that the disadvantage of separating the closely related dip and azimuth values is overcome. These vectors would also be available as the result of the previously described vector summing indicated in Block 588 of FIG. 21. However, these vector components should be first normalized for the number COUNT of vectors summed, as for example, the X component could be normalized by:

$$X = \frac{SX}{\sqrt{SX^2 + SY^2 + SZ^2}}$$

where SX, SY and SZ (if used) are understood to mean the sum of all (COUNT) the X, Y and Z components, respectively.

As illustrated in Block 630 of FIG. 21, the X, Y and Z components may also be computed from the dip $\theta$ and azimuth $\phi$ values for a given sequence—here indicated by LS—which was set initially to the first sequence in the zone like in Block 580 and as indicated now in Block 622. The Z component may be computed from $Z = -\cos(\theta DTR)$ where $DTR = \pi/180$ converts degrees to radians. Now a common factor CF may be computed as $CF = \sqrt{1. - Z^2)}$ which is used in computing $X = CF \cos(\phi DTR)$ and $Y = CF \sin(\phi DTR)$. These X, Y and Z values are then used respectively as the initial sums SX, SY and SZ and may be used as components of a sum vector SV. Also as shown, the QAL or quality factors representative of sequence LS may be used to initialize the quality sum SQ and the number of pooled sequences NPOOL is started at 1.

Next, as shown in Block 632 of FIG. 21, the vector components X, Y and Z for the next sequence LS+1 are computed. This, of course, may be done as it was for sequence LS in Block 630 using the relations given above. There are several ways to test the angular difference between the dip-azimuth results at LS+1, which may be considered a vector V, with that at LS or, even better that of the pool—considered as SV above. The relation shown in Block 632 indicates the dot product of the two vectors SV and V, which equals the cosine of the angular difference $\theta$ may be used in comparison with DTOL, which is now converted to radians and used in the form of the cos (DTOL). It should be recalled that in such tests the cosine function decreases as this angular difference $\epsilon$ increases. Therefore, a dot product exceeding cosine (DTOL=3°) indicates the angular difference $\epsilon$ is less than 3°.

The dot product shown as $\overline{SV} \cdot \overline{V}$ in this test is known to those in vector analysis but will be reviewed here, since normalization may be required as when NPOOL exceeds 1. It is known that the dot product $\overline{SV} \cdot \overline{V} = \cos(\epsilon) |\overline{SV}| \times |\overline{V}|$, from which $$\cos(\epsilon) = \frac{\overline{SV} \cdot \overline{V}}{|\overline{SV}| \times |\overline{V}|}.$$

In terms of vector components this becomes:

$$\cos(\epsilon) = \frac{X\,SX + Y\,SY + Z\,SZ}{\sqrt{SX^2 + SY^2 + SZ^2} \times \sqrt{X^2 + Y^2 + Z^2}}.$$

Thus, when cos ($\epsilon$) or $\overline{SV} \cdot \overline{V}$ exceeds cos (DTOL), only a small angular difference is found and the test shown in Block 632 answers YES and pooling continues as shown in Block 634 by individually summing the components, quality factors, etc., for sequence LS+1, and incrementing NPOOL to add this sequence into the pool.

As indicated in the test shown in Block 636, there usually is an upper limit designated here as NPL for the number of sequences whic may be pooled in a given pool. Thus, if the pool already consists of NPL sequences, the test indicated in Block 636 answers YES, ending temporarily the pooling for this series of sequences. If, however, additional sequences may be pooled, the test answers NO, and the process continues as indicated in Block 640 by incrementing the sequence designator LS to the next sequence and testing to determine if all of the sequences in the zone have been considered as indicated by LS=LE and shown in the test in Block 642. If further sequences remain, this test answers NO and the process continues as shown in Branch 644 to return to Block 632 to compute additional components and a new dot product as previously described. If the angular difference exceeds the tolerance DTOL, as tested in their cosine forms, this pool is ended as the test indicated in Block 632 will answer NO and the process will continue to Point BB designated here as 650.

Similarly, if all of the sequences in the zone have been processed as indicated by the LS=LE test shown in Block 642 answering YES, the process will also continue at point BB. In a similar manner, if NPOOL=NPL as indicated by a YES answer for the test in Block 636, pooling is temporarily closed and a single result computed as indicated in Block 654. Here the pooled dip $\theta$ and azimuth $\Phi$ is computed from the accumulated vector components. Here the relations used to compute the vector components are expressed as $$\Phi = RTD\ ATAN(SY/SX) + IQ \text{ and}$$

$$\theta = RTD\ ATAN(CFR/SZ)$$

where RTD=180/$\pi$ and converts radians to degrees; IQ is the azimuth quadrant factor, and as can be seen from FIG. 13B, may be expressed as K 180° such that when both X and Y are negative, for example K=1 and $\Phi$ ranges between 180° and 270°; and CFR is another common factor given by $CFR = \sqrt{SX^2 + SY^2}$.

The standard deviation DEVA of the pooled vectors is an important quality indicator as in NPOOL. DEVA may be computed in two steps. First, DEVD is computed from the vector sums as $$DEVD = \sqrt{\frac{SX^2 + SY^2 + SZ^2}{NPOOL}},$$

where the $\sqrt{}$ part has been already computed in obtaining the dot product as in Block 630. The standard deviation is then given by $DEVA = RTD\sqrt{1. - DEVD^2}$, as shown in Block 654. Other pooled values, such as the quality factors may be used to compute the counterpart for the pooled sequences as for example, the quality for the pooled sequences may be found from QAL=SQ/NPOOL.

Then, as indicated in Block 656 of FIG. 21, since additional sequences may be present in the zone which may not have been considered for pooling where pooling has only temporarily been ended, and as indicated by the LS=LE test shown in Block 656 answering NO, the pooling process is begun again with the current value of LS and the initialization of the component and various other accumulators as shown in Block 630, and previously discussed.

In review, any of three conditions may terminate a pool: (1) as indicated by the test in Block 632 when the difference between results from adjacent sequences exceeds tolerances and this test answers NO; (2) if the number of sequences pooled exceeds NPL, as indicated by a YES answer from Block 636; or (3), if the pooling process considers the last sequence in the zone, as indicated by the Block 642 test answering YES. In this latter condition, the test shown in Block 656 would also answer YES, indicating that all of the sequences in the zone which could have been pooled have been so processed.

The processing then continues at Point AA shown at 660 in FIG. 21, as it would have if no pooling had been desired, in which case, it would have continued from Block 620. The final step of the process for this zone is indicated in output Block 670, where as much as desired of the stored information, and if desired, compute combinations thereof, may be output. As indicated by Block 670, some of these output may include the zone CODE, the sequence number or depth, of course the dip $\theta$ and azimuth $\Phi$ for each sequence or pooled sequence and, in the latter case, the number and deviation of the pooled dips and azimuths. Also optional is NRANK for the cluster and the count of the vectors participating in the results from each sequence. The two diameters $D_{1\text{-}3}$ and $D_{2\text{-}4}$ may be output as well as the customary relative bearing, deviation and azimuth measurements. The above may be output for each sequence or pooled sequence. With the zone analysis complete, the process would then return to Block 400A as shown in FIG. 15B previously described and the process labeled AUTO-ZONE, to determine the beginning and end sequences for an additional zone, if desired.

Thus, all of the displacements produced in each round of correlations for each sequence have been analyzed as groups of sequences which may be considered either as stable or unstable zones. Each zone is analyzed, through the use of a classification system to determine the dominant mode or class for all the various possible combinations of displacements within each sequence and for all sequences within the zone. These combinations are then reviewed, sequence by sequence, to determine their contribution to this dominant mode and if required, or if desired, to lesser modes or clusters of different ranks. Different dip and azimuth values for each sequence are determined only if that sequence is found to contribute to such a class or cluster. Similar dips from adjacent sequences may be pooled to provide a single result. However, clusters resulting from a single sequence may not be used in the determination of the final results.

Referring now to FIG. 22, there is illustrated in the form of portions of two conventional arrow plots, the usefulness of the techniques of the present invention. Areas to the left of the depth number column indicate, for correlation purposes, the general resistivity of the formations versus depth. Depths are shown increasing towards the bottom of the figures. Normally, logging is performed while withdrawing the tool from the borehole and, therefore, logging information is recorded in sequences corresponding to decreasing depths.

In the portion of the figure to the right of the depth column are dip arrows corresponding to the individual sequences or depths. In the portion labeled "STANDARD", these arrows were obtained using the standard processing techniques but which included the use of relatively short correlation intervals—here, one meter long—and an equal correlation step to produce as many dip arrows as practical.

The position of the circles associated with each dip arrow corresponds to the dip angle, with dips increasing from zero on the left to about 40° for the right-most dips shown. Closed circles are used to indicate the better quality correlations. The direction of the arrows radiating from each circle indicates the azimuth of the dip.

In general, wide variations in dip values are indicated in the standard processing output. As expected, the azimuths of very low dips are poorly defined. The azimuths of the dips corresponding to about 10° are generally to the South-Southeast.

However, as the dip value increases, increasing scatter is also apparent in the azimuth indications, particularly in the upper part of the figure. The same trend to the Southeast is apparent for the higher dip values. Two dip value trends seem to be present, the most common value being about one-half of that of the higher dip trend. As such, a clear interpretation of these results is difficult.

In the right half of FIG. 22 is shown to the same scale, corresponding results for the new techniques disclosed herein. Again, the same correlation length (one meter) was used, but now a 75% overlap between successive correlation intervals specified; i.e., the correlation step was one-fourth of the correlation length and the standard program used to obtain the corresponding displacements. The resulting displacements are then processed using the techniques of the present invention. Since the hole deviation was high; i.e., near 40° as shown by the right-most portion of the figure, the "floating pad" detection and nullification techniques described herein were used. In addition, pooling was allowed for up to four adjacent sequences as long as the angular difference in the results did not exceed about 3° from sequence to sequence. Pooled results are indicated here by closed circles. Therefore, the open circles indicate single sequence results but of course it is understood that confirming results were found in the same cluster from other sequences in the same zone.

In general, the new technique output is devoid of the higher dip trend present in the standard processing output. It may be that most of these high dips resulted from exaggerated displacements produced from correlating a signal obtained from the floating pad. Such displacements would have been nullified in the new technique, and therefore, would produce no exaggerated dips.

Still further, the scatter present for the lower dip trend in the standard processing is much less apparent in the new technique output. For example, the lower part of the figure is clearly characterized now by a dip of about 10°. In addition, the azimuth of these dips seems to be more consistently toward the Northeast, rather than to the South-Southeast.

In addition, a sharp trend break appears at about depth = 1350, particularly as seen in the pooled results (solid circles). At and above this break, many "No Answer" sequences are apparent by the lack of dip arrows but enough pooled and single sequence results remain to continue the previous trend, which is no longer concealed in the scatter of perhaps meaningless dips.

There has been described a new technique for processing displacements which may be obtained between signals derived from conventional sources such as a borehole dipmeter. These displacements may be obtained using existing techniques by specifying correlation steps which are only a small part of the correlation length and thereby overlapping the correlation intervals for adjacent sequences.

Preferably these displacements are zoned into groups of stable displacement sequences. Zones having no stable displacements or adjacent pairs of stable displacements are grouped into unstable zones. The stable and unstable zones are then separately processed but with essentially the same technique.

Corresponding displacements from each sequence are combined to produce a function of the displacement or apparent dip angle between signal features present in the signals obtained from three different signal sources. These sources are illustrated herein as either three adjacent dipmeter pads, or two diagonal pads and one adjacent pad, or both pairs of diagonal pads on the conventional four-pad dipmeter tool. It should be understood that other pad arrangements and, in fact, dipmeter tools, may also be utilized.

A technique is disclosed for disqualifying as possible corresponding displacements, those displacements associated with a signal obtained from a source not in the proper position, such as a floating pad. Even so, several possible corresponding combinations are still present in each sequence. This technique is particularly significant in highly deviated holes.

The combined displacements are conveniently represented as pairs of orthogonal displacements, either real or virtual (computed from displacements obtained between signals from sources not necessarily orthogonally positioned). The orthogonal displacements are combined with corresponding distances between the signal sources (diameters, as illustrated) to produce pairs of tangents. Each pair of tangents may represent a different dip vector for a given sequence. For example, up to thirteen such vectors are possible in the illustrated four-pad tool case.

The different dip vectors, or their two-dimensional x-y components are then classified and analyzed relative to the position of the signal sources, here, the dipmeter pads. To do so they are converted into indices or an address corresponding to one address in a multi-address classification system. The cell or register in this array designated by this address is used to monitor the occurrence of vectors corresponding to this address. For example, cells or registers may be used to sum preferably weights or quality factors representing in some way the reliability of the correlations which produced the combined displacements. Of course if all such weights were the same, this would be equivalent to merely counting the number of such occurrences.

After all possible combinations in each sequence and all the sequences in each zone have been so classified, the resulting classification is then analyzed. This analysis determines groups of adjacent cells or clusters. Several such clusters or classes; i.e., cells linked by adjacent cell indicators into a common class, may be determined in a single zone.

The addresses of the cells in each such class are then examined to determine the range in addresses or boundaries of the class. The total number or weight of all the cells within these boundaries and therefore for the class is then determined. This results in a ranking of the clusters which varies from the most important or dominant cluster to the least important cluster.

Subsequently, the individual vectors in each sequence are again used in relation to the above clusters. Now it is determined how many, if any, vectors from each sequence contributed, preferably to the highest ranking or dominant cluster. The components of such contributing vectors are then combined to produce a more accurate average dip vector or dip and azimuth values to represent the sequence.

If, however, no contributions to the dominant cluster are found from this sequence, several options may be used as desired. In one option useful particularly in stable zones, clusters are expanded in size which may compensate, for example, for an inaccurately chosen contour level used to define the original cluster boundaries.

If no contributions are found, another option may be used in which the next highest ranking cluster is considered in the above manner of the dominant cluster. If still no contributing vectors are found, each cluster present in the zone is considered in the order of its rank or decreasing importance. No results are obtained only if no such contributors are found or all the contributors of a cluster are found to be from the same sequence.

Each sequence in the zone is in turn retrieved and considered in the above process with the possibility of as many dip and azimuth results as there are sequences in the zone. To provide some possibility to reduce the volume of the results without significantly affecting the interpretation thereof, an option volume reducing technique called pooling may be employed. Here, closely comparing dip and azimuth results determined from adjacent sequences in the same zone are pooled into a single result. However, if the differences between the results for adjacent sequences are too large, the pool is broken at this point and a new pool started. Single sequences differing substantially from adjacent sequences thus are still retained as separate result.

While the four-pad dipmeter tool has been used as an example to illustrate the techniques of the present invention, it should be understood that any multi-pad tool may be used. Further these techniques may be practiced using sources for signals other than dipmeter pads or electrodes. For example, multi-element acoustic transmitter or receiver systems which are separately spaced at known positions may be used as the signal sources.

While the techniques of this invention have been illustrated as may be practical by programming a general purpose computer such as a PDP-10 made by Digital Computer Corporation, the techniques may be performed on other apparatus, such as smaller special-purpose processors controlled by read-only memories containing instructions to perform the steps of specific parts of the technique, with some parts performed, perhaps, substantially at the same time.

While FIG. 22 illustrates comparable volumes of results may be produced by the prior art practice of using only the two "best" corresponding displacements in each sequence, as compared to the techniques of the present invention, it also illustrates a considerable improvement results from considering all possible corresponding displacements in each sequence. Thus an advantage is obtained by combining even apparently redundant displacements in each sequence. A further advantage is realized by using overlapping correlation intervals for successive sequence to provide indications of displacement stability and the presence of dominant features in these intervals.

Still further, advantage is taken of the distribution modes for the above redundant displacement combinations in defining and using their location to guide the selection of the most valid displacements.

The above described embodiments are, therefore, intended to be merely exemplary and all such variations and modifications are intended to be included within the scope of the invention as defined in the appended claims.

What is claimed is:

1. A method for determining the attitudes of earth formation features in the vicinity of a borehole comprising the steps of:

(a) passing a plurality of at least four transducers through a borehole to obtain a plurality of depthvarying signals, each of said transducers being urged in the direction of the borehole wall to achieve transducerwall contact;

(b) detecting which, if any, of said transducers fail to achieve transducer-wall contact; and (c) combining said plurality of depth-varying signals, less the signal from any transducer failing to achieve transducer-wall contact, to generate improved, less error prone, tangible representations of the attitudes of said earth formation features.

2. A method as in claim 1 wherein said detecting step includes:

(i) producing displacements between pairs of said depth-varying signals by comparing the similarity of the features of said signals;

(ii) finding displacements which possess the property of closure; and (iii) using displacements found to possess the property of closure to detect which transducer is most likely to have failed to achieve transducer-wall contact.

3. A method as in claim 1 in which the step of detecting which transducer is most likely to have failed to achieve transducer-wall contact comprises testing the transducer closest to the top side of a devaited borehole for transducer-wall contact.

4. A method as in claim 1 wherein said detecting step includes comparing said plurality of depth-varying signals in a variety of combinations.

5. A method of mapping the attitudes of earth formation features in the vicinity of a borehole comprising the steps of:

(a) passing a tool having at least four transducers through a borehole to obtain a respective depthvarying signal from each transducer, each of said transducers being urged in the direction of the borehole wall to achieve satisfactory transducer-wall contact;

(b) detecting which, if any, of the transducers fail to achieve satisfactory transducer-wall contact; and (c) combining at least three of said depth-varying signals, less the signal from any transducer failing to achieve said satisfactory transducer-wall contact, to generate a tangible representation of the attitudes of said earth formation features.

6. A method as in claim 5 in which the detecting step includes combining the depth-varying signals obtained in step (a) to find displacements between corresponding signal features thereof, combining said displacements to find groups of displacements where each group substantially possesses the property of closure but substantially fails to possess the property of planarity, and detecting which transducer fails to achieve satisfactory transducer-wall contact only for said groups which substantially possess the property of closure but not of planarity.

7. A method as in claim 6 in which the step of finding said groups of displacements includes the use of a signal indicative of the borehole diameter.

8. A method as in claim 6 in which the step of finding said groups of displacements includes the use of a signal indicative of the geometric mean diameter of the borehole.

9. A method as in claim 6 in which the step of detecting which transducer fails to achieve satisfactory transducer-wall contact comprises at least initially selecting the transducer nearest the topside of the borehole as the most likely one to fail to achieve satisfactory transducer-wall contact.

10. A method of mapping the attitudes of earth formation features in the vicinity of a borehole comprising the steps of:

(a) passing a group of at least four transducers through a borehole to obtain a respective depth-varying signal from each transducer, each of said transducers being urged toward a selected position relative to the borehole;

(b) detecting which, if any, of the transducers fail to achieve their respective selected positions relative to the borehole; and (c) combining the depth-varying signals, less the signal from any transducer failing to achieve its respective selected position relative to the borehole, to generate tangible representations of the attitudes of said earth formation features.

11. A method as in claim 10 in which, in the case of depth-varying signals obtained from transducers when passing through a borehole which has at least a selected deviation, the detecting step comprises detecting the transducer closest to the top of the borehole as the one which fails to achieve its respective selected position relative to the borehole.

12. A method as in claim 10 in which the detecting step includes detecting which, if any, of the transducers fail to achieve direct contact with the borehole wall.

13. A method as in claim 10 in which the combining step comprises combining the depth-varying signals obtained from at least three of said transducers.

14. A method as in claim 10 in which the detecting step includes combining the respective depth-varying signals to find displacements among them which correspond to a match of signal features thereof, finding groups of displacements where each group substantially has the property of closure, which is indicative of the likelihood that the group corresponds to a formation feature, but substantially lacks the property of planarity, which is indicative of the possibility that at least one transducer has failed to achieve its selected position relative to the borehole, and detecting which one or more transducers fail to achieve their respective selected positions relative to the borehole only for those groups of displacements which substantially possess the property of closure but substantially lack the property of planarity.

15. A method as in claim 10 in which the detecting step includes combining the respective depth-varying signals and a signal indicative of the borehole diameter in the course of detecting which, if any, of the transducers fail to achieve their respective selected positions relative to the borehole.

16. A method as in claim 15 in which said borehole diameter is the geometric mean diameter of the borehole.

17. A method of mapping the attitudes of earth formation features in the vicinity of a borehole comprising the steps of:

(a) passing a group of at least four transducers through a borehole to obtain a respective depth-varying signal from each transducer, each of said transducers being urged toward a selected position relative to the borehole, and combining respective pairs of said depth-varying signals to find probable displacements therebetween corresponding to a probable match of signal features thereof;

(b) filtering the probable displacements to retain as the most valid ones those which indicate that the transducers from which the depth-varying signals resulting in the displacements were obtained were substantially in contact with the borehole wall; and (c) producing, from the displacements selected as the most valid ones through said filtering, tangible representations of the attitudes of earth formation features in the vicinity of the borehole.

18. A method as in claim 17 in which each of said probable displacements comprises a displacement ratio specific to each transducer.

19. A method as in claim 18 in which the transducers which are substantially in contact with the borehole wall correspond to displacement ratio most closely corresponding to a plane.

20. A system comprising:

(a) means for obtaining a respective depthvarying signal from each of at least four transducers passed through a borehole in an earth formation while urging each transducer toward a selected position relative to the borehole; and (b) means for detecting which, if any, of the transducers failed to achieve their respective selected positions relative to the borehole while passing therethrough, and for combining the depth-varying signals, less the signal from any transducer failing to achieve its respective selected position relative to the borehole, to generate tangible representations of the attitudes of earth formation features in the vicinity of the borehole.

* * * * *